United States Patent [19]

Futamase

[11] 4,343,218

[45] Aug. 10, 1982

[54] ELECTRONIC MUSICAL INSTRUMENT

[75] Inventor: Tsuyoshi Futamase, Hamamatsu, Japan

[73] Assignee: Nippon Gakki Seizo Kabushiki Kaisha, Hamamatsu, Japan

[21] Appl. No.: 208,268

[22] Filed: Nov. 19, 1980

Related U.S. Application Data

[63] Continuation of Ser. No. 27,244, Apr. 5, 1979, abandoned.

[30] Foreign Application Priority Data

Apr. 11, 1978 [JP] Japan ..... 53/42431

[51] Int. Cl.[3] ..... G10H 1/02

[52] U.S. Cl. ..... 84/1.21; 84/1.22; 84/1.01

[58] Field of Search ..... 84/1.01, 1.03, 1.19, 84/1.21, 1.26, 1.22, 1.1

[56] References Cited

U.S. PATENT DOCUMENTS 3,809,786 5/1974 Deutsch ..... 84/1.01
3,809,789 5/1974 Deutsch ..... 84/1.01
3,908,504 9/1975 Deutsch ..... 84/1.19
4,033,219 7/1977 Deutsch ..... 84/1.03
4,083,285 4/1978 Chibana ..... 84/1.26
4,205,577 6/1980 Deutsch ..... 84/1.21

*Primary Examiner*—J. V. Truhe
*Assistant Examiner*—Forester W. Isen
*Attorney, Agent, or Firm*—Spensley, Horn, Jubas & Lubitz

[57] ABSTRACT

An electronic musical instrument is of a type wherein a tone is synthesized by combining partials and of a type which utilizes a tone production assignment technology including a small number of tone generating circuits for a large number of playing keys. When a key is depressed to designate a tone to be produced in a certain tone color, generations of the partials for constituting that tone are respectively assigned to time slots of time division multiplexing channels. Upon depression of keys, frequencies and envelopes are designated partial by partial and each of such designations is separately assigned to an available one of the time slots.

Thus the time slots are efficiently used for production of a large number of tones.

28 Claims, 35 Drawing Figures

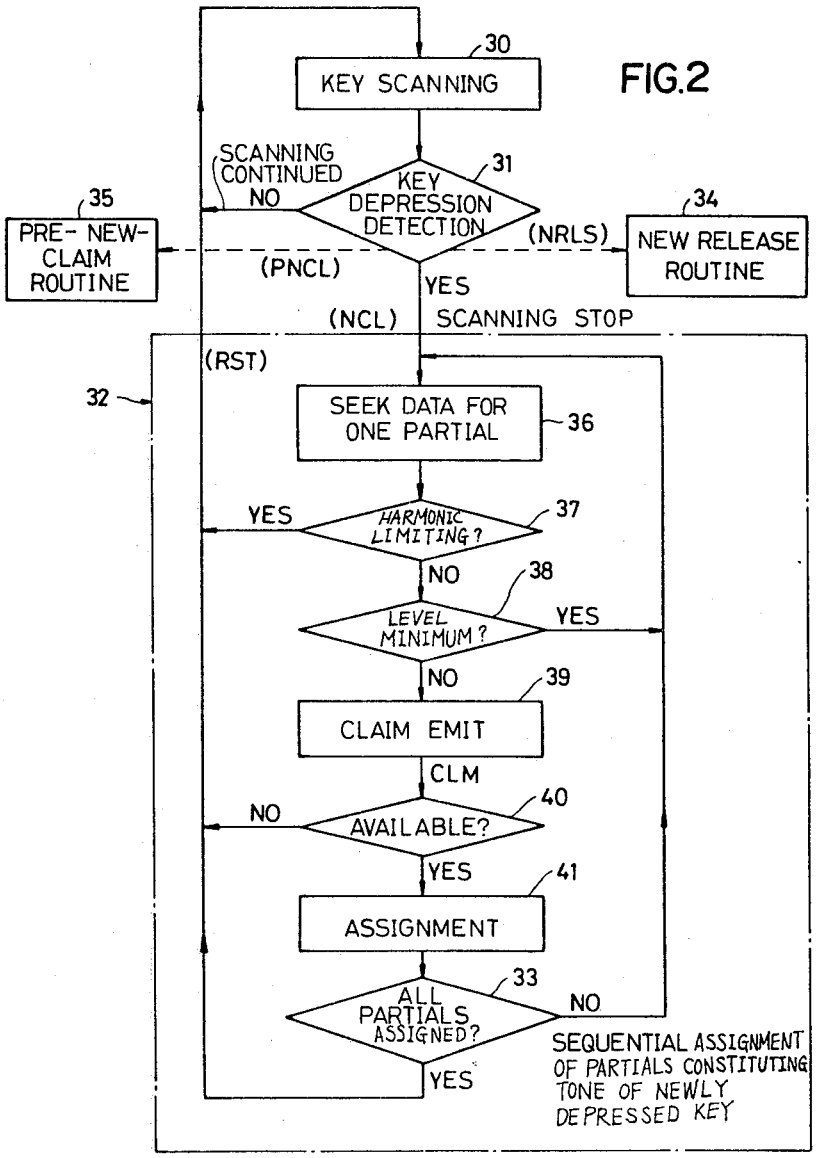
FIG.2
30
KEY SCANNING
31
KEY DEPRESSION DETECTION
SCANNING CONTINUED
NO
35
PRE- NEW-CLAIM ROUTINE
(PNCL)
(NRLS)
34
NEW RELEASE ROUTINE
YES
(NCL)
SCANNING STOP
(RST)
32
SEEK DATA FOR ONE PARTIAL
36
YES
HARMONIC LIMITING?
37
NO
38
LEVEL MINIMUM?
YES
NO
39
CLAIM EMIT
CLM
40
NO
AVAILABLE?
YES
41
ASSIGNMENT
33
ALL PARTIALS ASSIGNED?
NO
YES
SEQUENTIAL ASSIGNMENT OF PARTIALS CONSTITUTING TONE OF NEWLY DEPRESSED KEY

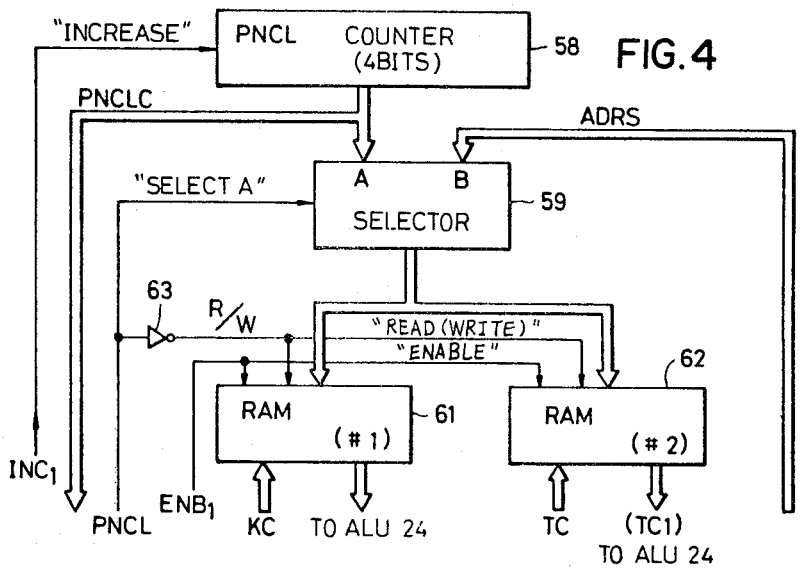
FIG. 4
FIG. 5
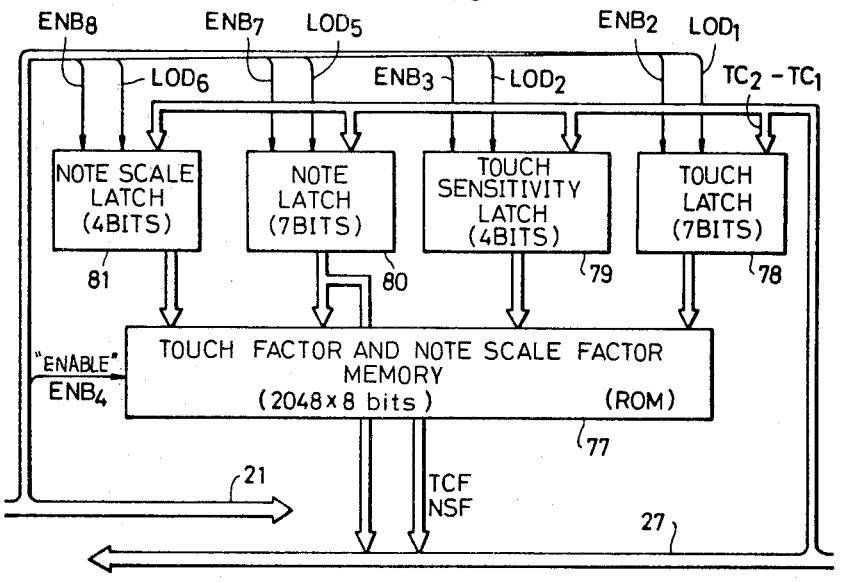

FIG. 13(b)
| ADDRESS | |
|---|---|
| 1024 | H (TOTAL PARTIAL NUMBER) |
| 1025 | DR, EM, INHM |
| 1026 ⋮ 1031 | EMPTY |
FIG. 13(c)
| ADDRESS | |
|---|---|
| 1032 | n (ORDER) |
| 1033 | LPTSENS, LPNS |
| 1034 | LP |
| 1035 | TDTSENS, TMNS |
| 1036 | $TD_1$ |
| 1037 | $TD_2$ |
| 1038 | TATSENS, LD |
| 1039 | TA |
FIG. 13(a)
ADDRESS STRUCTURE OF TONE PARAMETER MEMORY 82
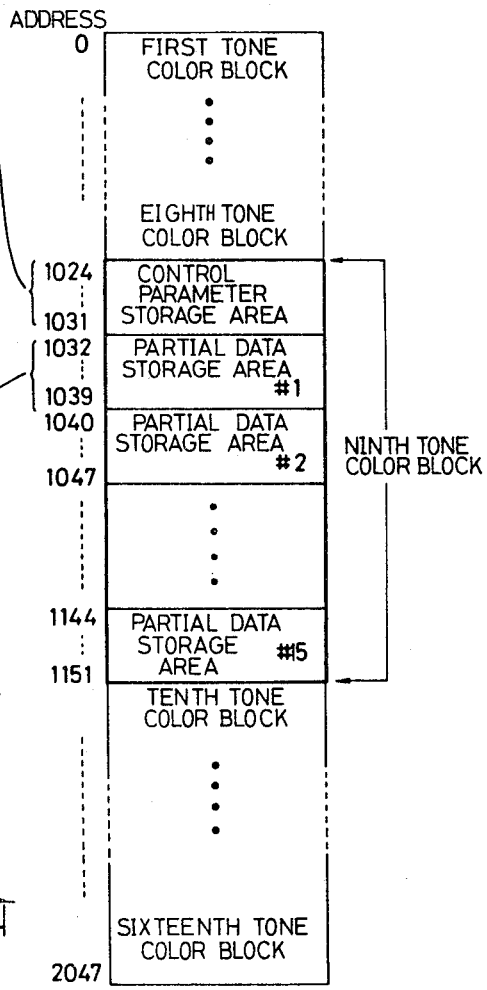
FIG. 14(a)
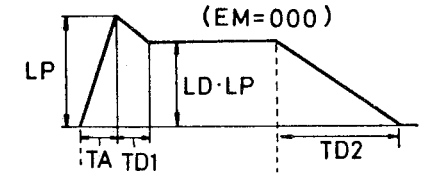
FIG. 14(b)
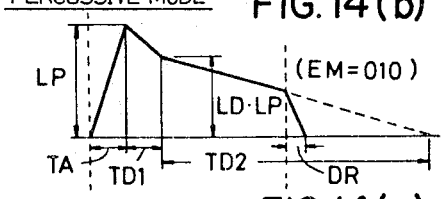
FIG. 14(c)
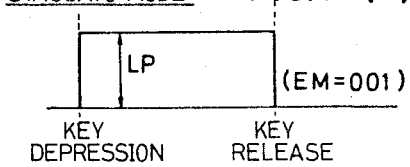

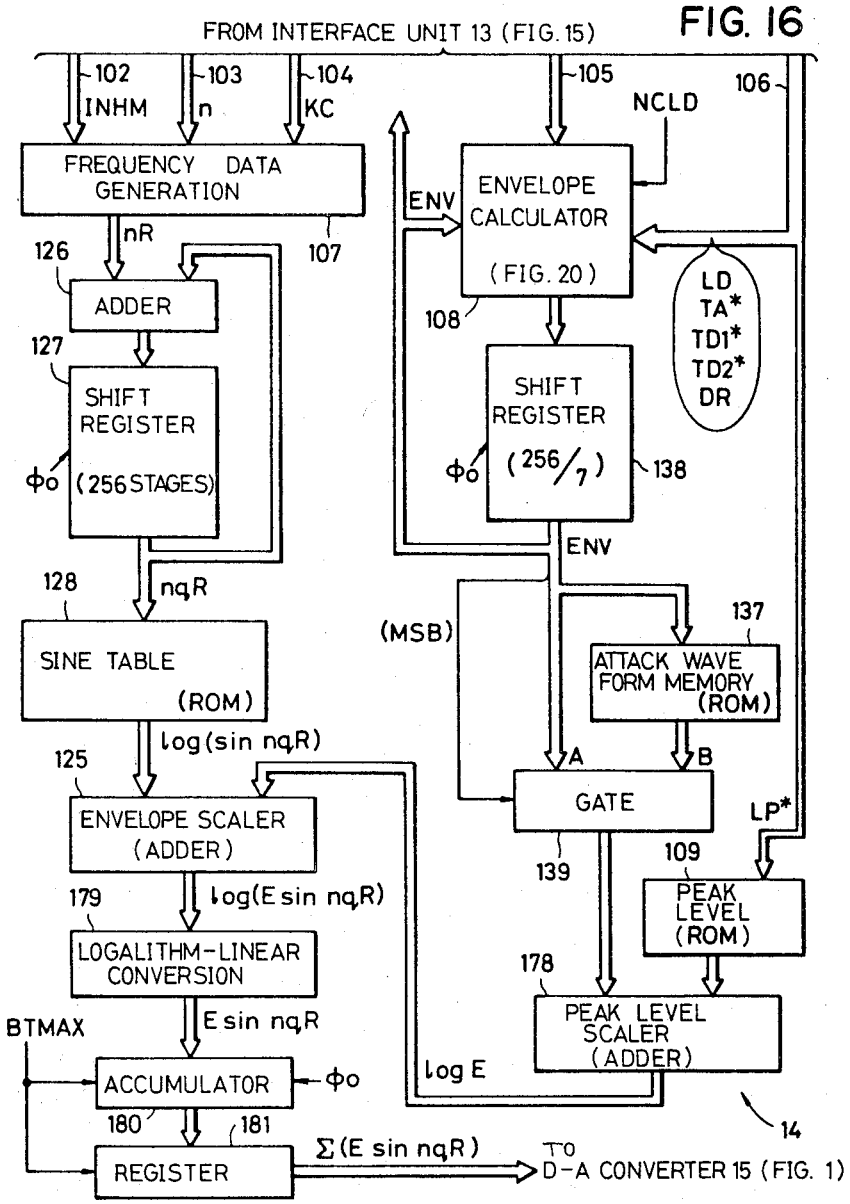
FIG. 16
FROM INTERFACE UNIT 13 (FIG. 15)
102
INHM
103
n
104
KC
105
NCLD
106
FREQUENCY DATA GENERATION
107
nR
126
ADDER
127
SHIFT REGISTER
φo
(256 STAGES)
128
nqR
SINE TABLE
(ROM)
log(sin nqR)
125
ENVELOPE SCALER
(ADDER)
179
log(E sin nqR)
LOGALITHM-LINEAR CONVERSION
E sin nqR
BTMAX
ACCUMULATOR
φo
180
181
REGISTER
Σ(E sin nqR)
TO D-A CONVERTER 15 (FIG. 1)
ENVELOPE CALCULATOR
(FIG. 20)
ENV
108
LD
TA*
TD1*
TD2*
DR
SHIFT REGISTER
φo
(256/7)
138
ENV
(MSB)
137
ATTACK WAVE FORM MEMORY
(ROM)
A
B
GATE
139
LP*
109
PEAK LEVEL
(ROM)
178
PEAK LEVEL SCALER
(ADDER)
log E
14

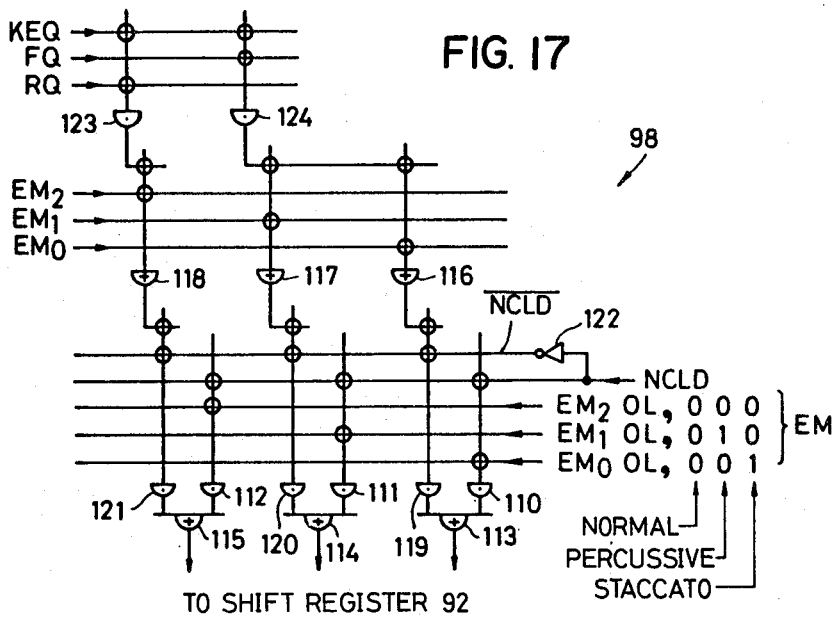
FIG. 17
FIG. 18
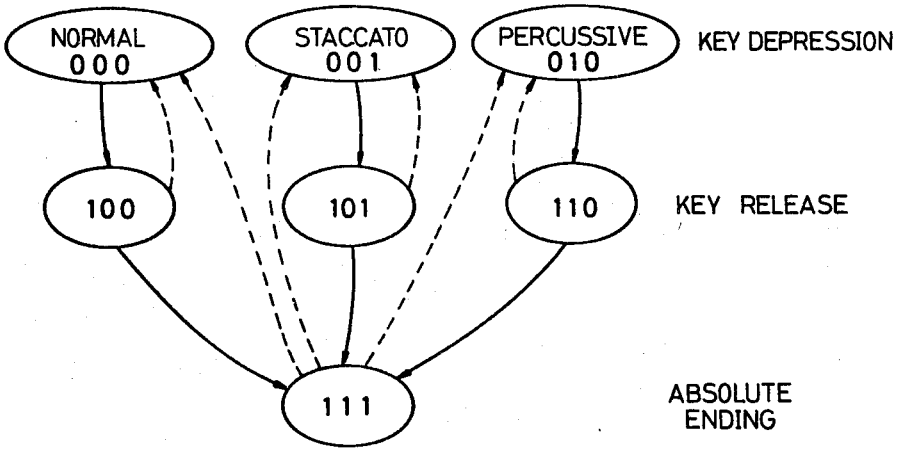

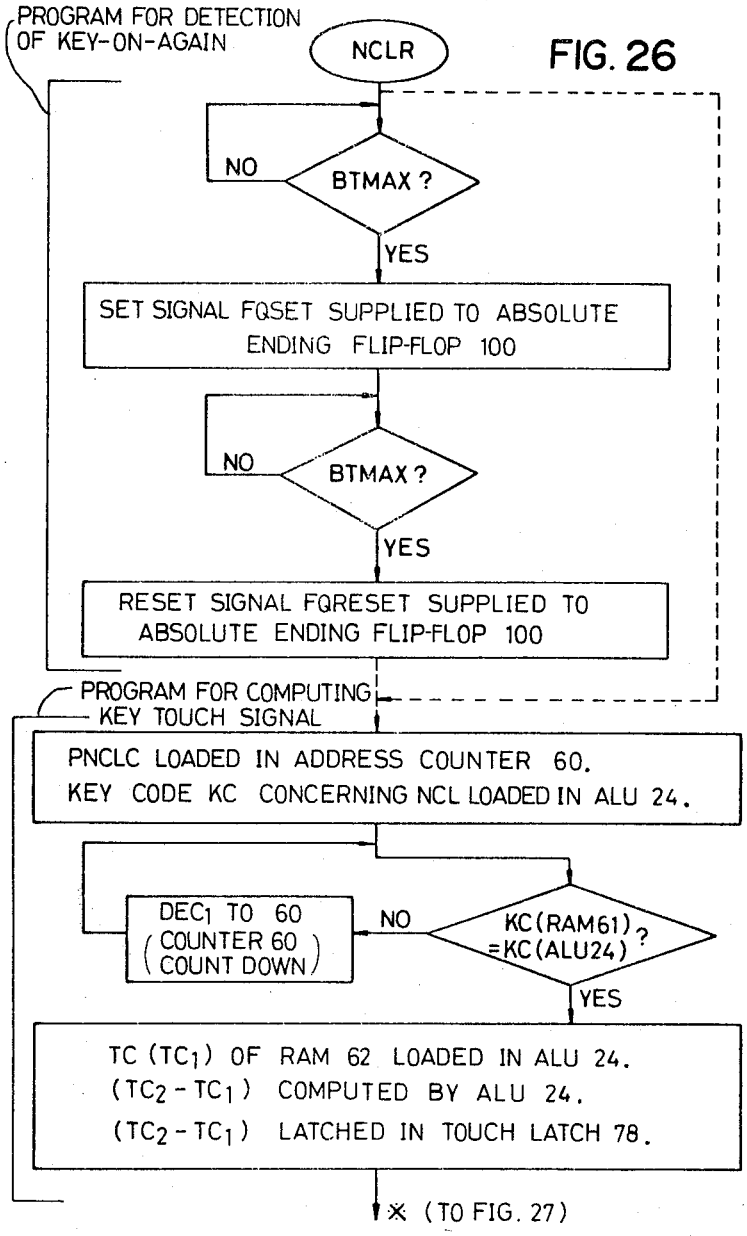
PROGRAM FOR DETECTION OF KEY-ON-AGAIN
NCLR
FIG. 26
NO
BTMAX ?
YES
SET SIGNAL FQSET SUPPLIED TO ABSOLUTE ENDING FLIP-FLOP 100
NO
BTMAX ?
YES
RESET SIGNAL FQRESET SUPPLIED TO ABSOLUTE ENDING FLIP-FLOP 100
PROGRAM FOR COMPUTING KEY TOUCH SIGNAL
PNCLC LOADED IN ADDRESS COUNTER 60.
KEY CODE KC CONCERNING NCL LOADED IN ALU 24.
DEC1 TO 60
(COUNTER 60 COUNT DOWN)
NO
KC(RAM61) ? =KC(ALU24)
YES
TC (TC1) OF RAM 62 LOADED IN ALU 24.
(TC2 - TC1) COMPUTED BY ALU 24.
(TC2 - TC1) LATCHED IN TOUCH LATCH 78.
※ (TO FIG. 27)

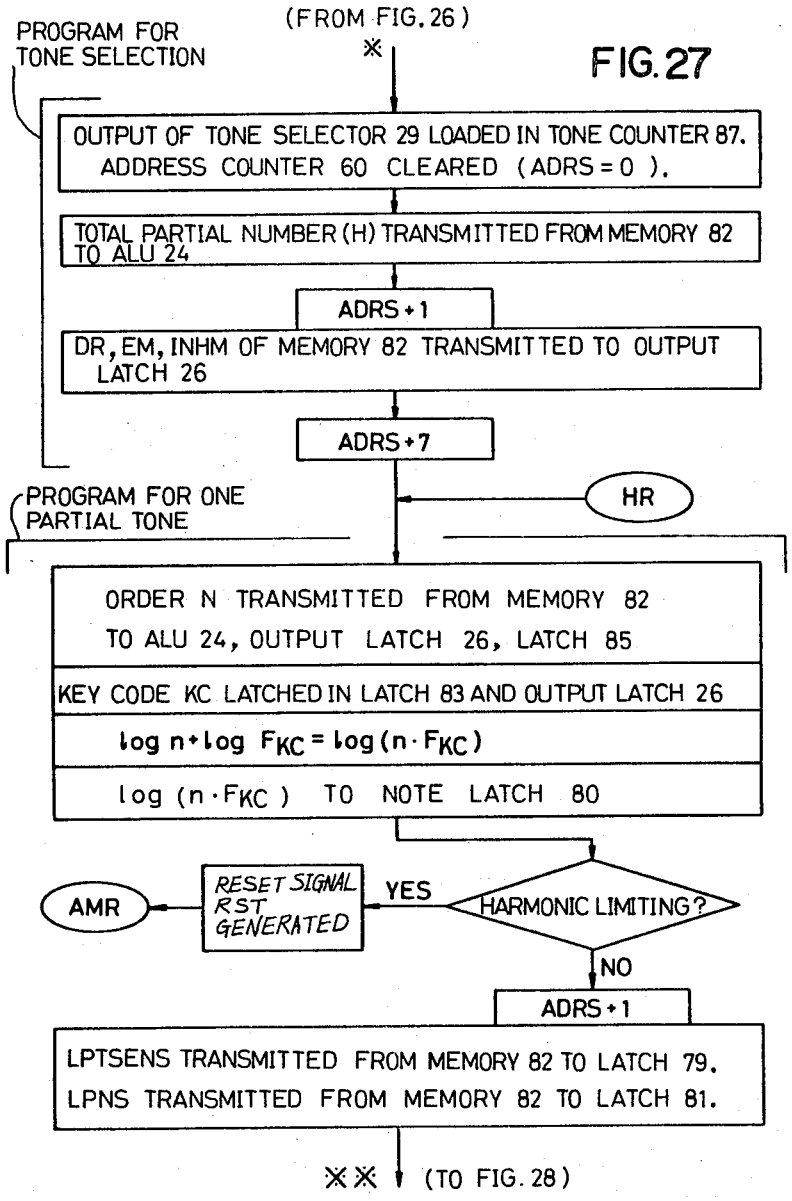
FIG. 27
PROGRAM FOR TONE SELECTION
(FROM FIG. 26)
※
OUTPUT OF TONE SELECTOR 29 LOADED IN TONE COUNTER 87.
ADDRESS COUNTER 60 CLEARED (ADRS = 0).
TOTAL PARTIAL NUMBER (H) TRANSMITTED FROM MEMORY 82 TO ALU 24
ADRS + 1
DR, EM, INHM OF MEMORY 82 TRANSMITTED TO OUTPUT LATCH 26
ADRS + 7
HR
PROGRAM FOR ONE PARTIAL TONE
ORDER N TRANSMITTED FROM MEMORY 82 TO ALU 24, OUTPUT LATCH 26, LATCH 85
KEY CODE KC LATCHED IN LATCH 83 AND OUTPUT LATCH 26
log n + log FKC = log (n · FKC)
log (n · FKC) TO NOTE LATCH 80
HARMONIC LIMITING?
YES
RESET SIGNAL RST GENERATED
AMR
NO
ADRS + 1
LPTSENS TRANSMITTED FROM MEMORY 82 TO LATCH 79.
LPNS TRANSMITTED FROM MEMORY 82 TO LATCH 81.
※※
(TO FIG. 28)

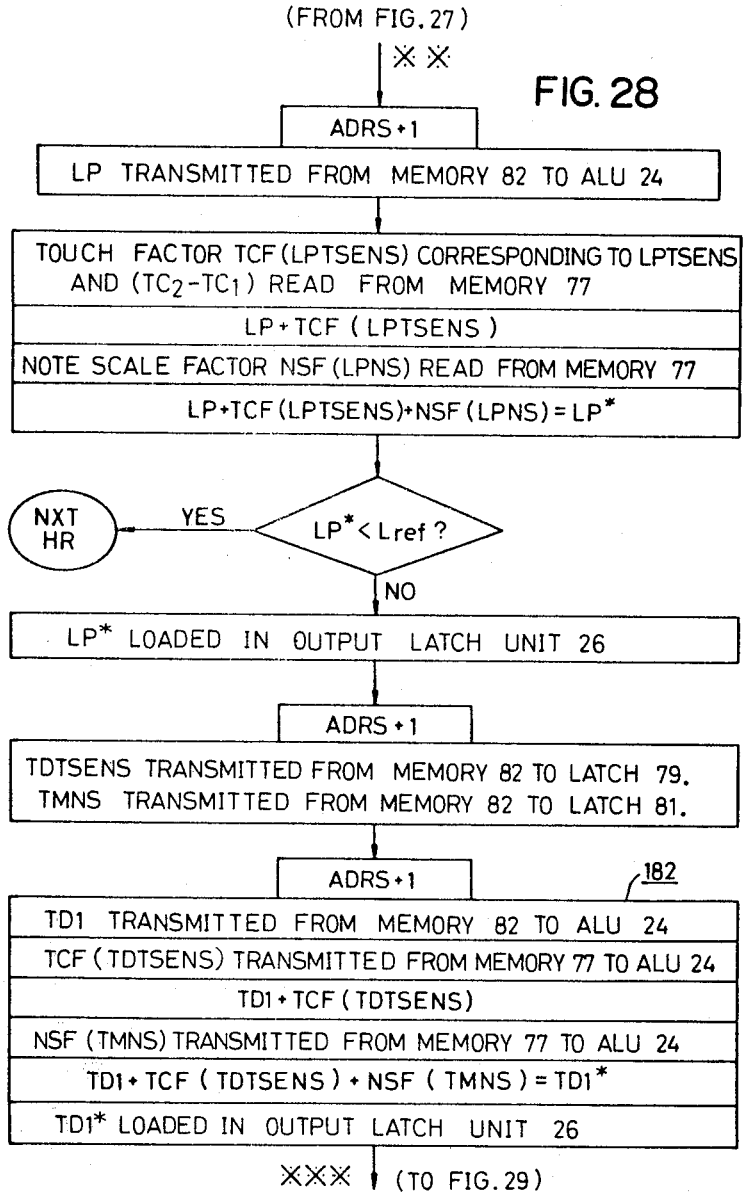
(FROM FIG. 27)
※※
FIG. 28
ADRS+1
LP TRANSMITTED FROM MEMORY 82 TO ALU 24
TOUCH FACTOR TCF (LPTSENS) CORRESPONDING TO LPTSENS AND (TC2-TC1) READ FROM MEMORY 77
LP+TCF (LPTSENS)
NOTE SCALE FACTOR NSF (LPNS) READ FROM MEMORY 77
LP+TCF (LPTSENS)+NSF (LPNS) = LP*
NXT HR
YES
LP* < Lref ?
NO
LP* LOADED IN OUTPUT LATCH UNIT 26
ADRS+1
TDTSENS TRANSMITTED FROM MEMORY 82 TO LATCH 79.
TMNS TRANSMITTED FROM MEMORY 82 TO LATCH 81.
ADRS+1
182
TD1 TRANSMITTED FROM MEMORY 82 TO ALU 24
TCF (TDTSENS) TRANSMITTED FROM MEMORY 77 TO ALU 24
TD1+TCF (TDTSENS)
NSF (TMNS) TRANSMITTED FROM MEMORY 77 TO ALU 24
TD1+TCF (TDTSENS)+NSF (TMNS) = TD1*
TD1* LOADED IN OUTPUT LATCH UNIT 26
※※※
(TO FIG. 29)

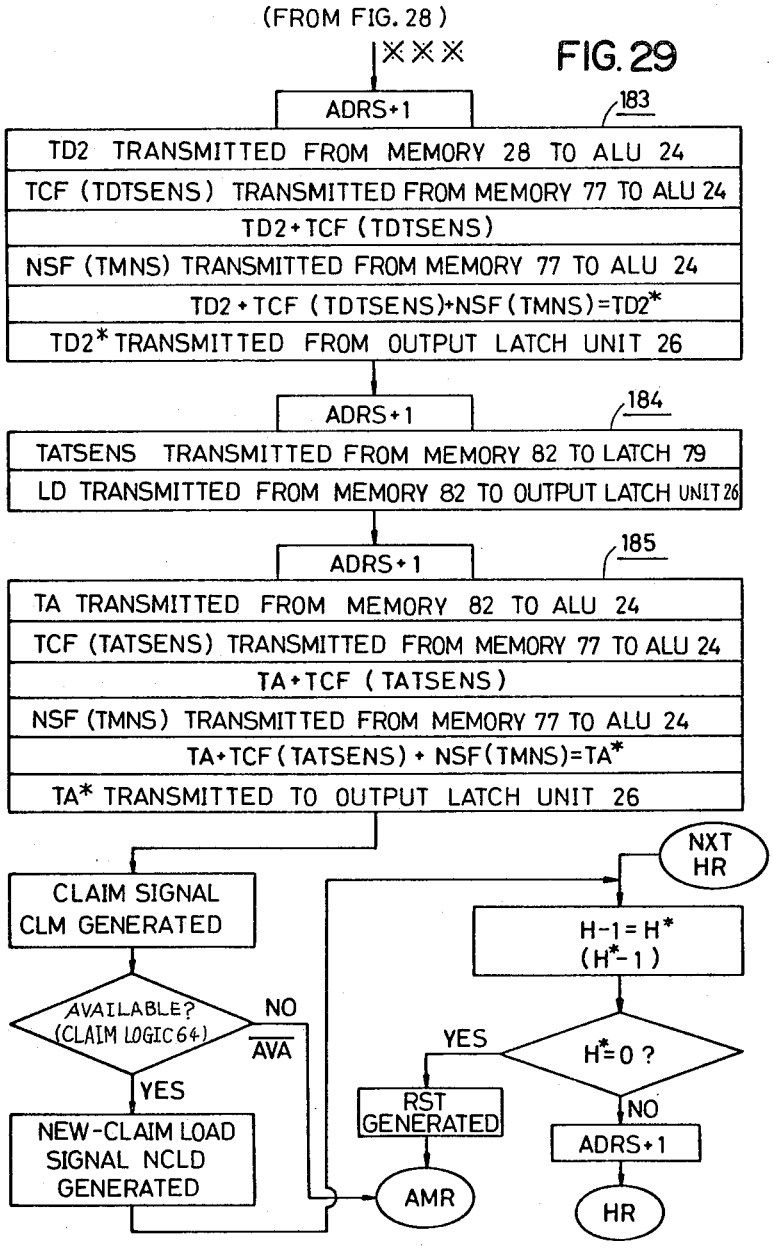
(FROM FIG. 28)
※※※
FIG. 29
ADRS+1
183
TD2 TRANSMITTED FROM MEMORY 28 TO ALU 24
TCF (TDTSENS) TRANSMITTED FROM MEMORY 77 TO ALU 24
TD2+TCF (TDTSENS)
NSF (TMNS) TRANSMITTED FROM MEMORY 77 TO ALU 24
TD2+TCF (TDTSENS)+NSF(TMNS)=TD2*
TD2* TRANSMITTED FROM OUTPUT LATCH UNIT 26
ADRS+1
184
TATSENS TRANSMITTED FROM MEMORY 82 TO LATCH 79
LD TRANSMITTED FROM MEMORY 82 TO OUTPUT LATCH UNIT 26
ADRS+1
185
TA TRANSMITTED FROM MEMORY 82 TO ALU 24
TCF (TATSENS) TRANSMITTED FROM MEMORY 77 TO ALU 24
TA+TCF (TATSENS)
NSF (TMNS) TRANSMITTED FROM MEMORY 77 TO ALU 24
TA+TCF(TATSENS)+NSF(TMNS)=TA*
TA* TRANSMITTED TO OUTPUT LATCH UNIT 26
CLAIM SIGNAL CLM GENERATED
AVAILABLE? (CLAIM LOGIC 64)
NO
AVA
YES
NEW-CLAIM LOAD SIGNAL NCLD GENERATED
AMR
NXT HR
H-1=H*
(H*-1)
H*=0 ?
YES
RST GENERATED
NO
ADRS+1
HR

ELECTRONIC MUSICAL INSTRUMENT

This is a continuation of application Ser. No. 27,244, filed 4/5/79, now abandoned.

BACKGROUND OF THE INVENTION

This invention relates to an electronic musical instrument and, more particularly, to an electronic musical instrument wherein a tone is synthesized by generating partial tones of the tone and combining the partial tones.

Known in the art of a digital type electronic musical instrument employing the system of a tone partial synthesizing type is an instrument disclosed in the specification of U.S. Pat. No. 3,809,786. In the known instrument, amplitudes of W (quantity) harmonic contents of a tone are individually computed in a continuous time period $t_c=tx/w$, where tx is a time interval for computing an amplitude value of one sample point of a musical tone waveform. The time period $t_c$ for computing each harmonic content is determined by dividing the time interval $t_x$ by the number W of the harmonic contents. Each harmonic content is computed in a specific one of the time periods $t_c$ fixedly corresponding to the harmonic content. That is, a first harmonic (fundamental) is computed in first time period ($t_{c1}$), a second harmonic content in the second time period ($t_{c2}$), . . . a sixteenth harmonic content in the sixteenth time period ($t_{c16}$) respectively.

It will be observed from the above description that a time slot or a channel for generating a partial tone (hereinafter referred to as a partial when applicable) is always fixed. Accordingly, the sixteenth time period (time slot), for example, cannot be used for computing the second harmonic. Besides, if there is a harmonic which is of a higher order than sixteenth, a time slot (or a channel) exclusively allotted to that harmonic must be specially provided.

In some cases, a tone color can be formed with a relatively small number of partials, and in other cases, it needs a large number of partials. It is therefore necessary to keep as many partials as possible for possible necessity.

For meeting such requirements, the known electronic musical instruments employing the partial tone synthesizing system are designed to have as many time slots or channels (i.e. time periods for computing partials) as possible for generating partials. Since, however, each of the partial generating time slots is fixedly allotted to a specific one of the partials, there exist time slots which are not used at all in a case where a tone is synthesized only with a small number of partials or where an upper limit is imposed on a frequency component (harmonic frequency) of a produced tone by harmonic limiting. If, for instance, an 8-foot Tibia tone is to be produced by the aforementioned electronic musical instrument, the computation time period $t_{c1}$ for computing the first harmonic and the computation time period $t_{c3}$ for the third harmonic only are used and the remaining time periods for the second harmonic and the fourth through sixteenth harmonics are wasted. According to the prior art instrument, in a case where the frequency of a harmonic component of a musical tone is greater than the frequency of a sampling frequency at which the waveform of the musical tone is sampled, the harmonic is subject to "harmonic limiting" as disclosed in U.S. Pat. No. 3,882,751 resulting in non-use of time slots allotted for partials subject to harmonic limiting.

The prior art electronic musical instrument of the partial tone synthesizing type is disadvantageous also in that generation of plural tones on a time shared basis requires division of each time slot (i.e. time division channel) allotted for generation of each tone into sub-time slots for producing partials constituting the tone with a result that a maximum number of tones to be produced simultaneously cannot be sufficiently large for it is limited by the upper limit of the frequency of the system clock pulse. If the maximum number of tones to be produced simultaneously is represented by M, the number of partials prepared for synthesizing a tone by N, the period of time slots for producing the partials (i.e. the period of the system clock) by $t_c$, and the sampling period by St, the sampling period St is $St=M\cdot N\cdot t_c$.

The sampling period St cannot exceed a certain limit by reason of auditory sensation. The number N of the partials cannot be reduced beyond a certain limit if a satisfactory tone color is to be synthesized. There is also a certain limit in shortening the period $t_c$ of the system clock for technical reasons. For this reason, St and $T_c$ are fixed at certain limits and if a sufficient number of N is to be secured, the maximum number of tones M has to be reduced. In the prior art electronic musical instrument, the number of time slots for producing partials is fixed to N and, accordingly, the maximum number of tones to be produced simultaneously is also fixed to M which is rather an insufficiently small number once the system of the electronic musical instrument has been decided. Thus, a large number of time slots allotted for production of partials are left unused and these unused time slots are in no way utilized for increasing the maximum number of tones to be produced simultaneously.

SUMMARY OF THE INVENTION

It is, therefore, an object of the present invention to eliminate waste which has occurred in the provision of time slots for production of the partials in the prior art electronic musical instrument. In this specification, the term "partial tone" or "partial" is intended to mean not only a harmonic overtone but also a frequency component which is of a non-integer multiple of a fundamental wave.

For achieving the above described object, the electronic musical instrument according to the present invention is designed to assign production of each partial to any empty time slot available among a specific number of time slots instead of providing time slots which correspond fixedly to respective orders of harmonics. According to the invention, production of partials of a musical tone is sequentially assigned to different time slots (i.e. channels) upon depression of a key for the musical tone. Accordingly, production of a musical tone is not assigned to a certain fixed channel but a musical tone of a depressed key is produced by synthetizing partials production of which is individually assigned to suitable time slots (channels) then available.

Each of the partial generation time slots of a specific number is capable of receiving assignment of any partial so that all of such partial generation time slots are utilized without waste. If, for example, the number of partials constituting a selected tone color is small, the number of time slots used for producing one tone is likewise small so that the maximum number of tones which can be produced simultaneously is relatively large. Further, since no assignment is required with respect to partials which are subject to "harmonic limiting", time slots can be utilized to that extent for production of other partials.

According to the present invention, truncating of an old tone (i.e. a tone which is being produced and is to be extinguished) is made with respect to each of partials constituting the old tone and a new partial is assigned to a time slot in which a partial which is of the smallest amplitude among the partials constituting the old tone is being produced. Upon the assignment of the new partial, the old partial with the smallest amplitude is truncated.

Accordingly, a partial which attenuates quickly is truncated quickly whereas a partial which should be prolonged is sufficiently prolonged without being truncated. This also enables an efficient utilization of time slots in the truncating of the musical tone.

A preferred embodiment of the invention will now be described in detail with reference to the accompanying drawings.

BRIEF DESCRIPTION OF THE DRAWINGS

In the accompanying drawings:

FIG. 2 is a flow chart for a brief description of a partial assignment system in the example shown in FIG. 1;

FIG. 4 through FIG. 9(*a*) show examples of circuits included in an arithmetic and logic operation unit (ALU) peripheral logic shown in FIG. 1, respectively; more specifically, FIG. 4 is a block diagram showing a circuit for performing processes concerning a pre-new-claim data PNCL;

FIG. 5 is a block diagram showing a circuit for allowing a touch factor and a note scale factor to produce for every partial;

FIG. 6 is a block diagram showing a circuit for providing in logarithmic expression the tone pitch of a key represented by a key code KC;

FIG. 7 is a block diagram showing a circuit for converting the degree of a partial into a logarithmic expression;

FIG. 8 is a block diagram illustrating a circuit for deciding a usable time slot to produce a new claim load signal NCLD;

FIG. 9(*a*) is a block diagram showing a circuit for generating a clock pulse $\phi_0$ forming partial generating time slots and its relevant circuit;

FIG. 9(*b*) is a timing chart indicating the relationships between the clock pulse $\phi_0$, the time slots, and a signal BTMAX:

FIG. 13(*a*) is an explanatory diagram showing the address arrangement of a tone parameter memory shown in FIG. 12;

FIG. 13(*b*) is an explanatory diagram showing one example of a control parameter memory area in FIG. 13(*a*);

FIG. 13(*c*) is an explanatory diagram showing one example of a partial data memory area in FIG. 13(*a*);

FIGS. 14(*a*) through 14(*c*) are graphical representations showing examples of envelope modes; more specifically, FIGS. 14(*a*), 14(*b*) and 14(*c*) are graphical representations showing envelope waveforms in a normal mode, in a percussive mode, and in a staccato mode, respectively;

FIG. 16 is a block diagram showing one example of a tone generator unit in FIG. 1, which is connected to the circuit in FIG. 15;

FIG. 17 is a circuit diagram showing one example of an envelope mode control circuit in FIG. 15;

FIG. 18 is an explanatory diagram indicating the transition of envelope mode data $EM_2$, $EM_1$ and $EM_0$;

FIGS. 26 through 29 are parts of a flow chart showing one example of a program in a new claim routine.

DESCRIPTION OF A PREFERRED EMBODIMENT

Figure 1:
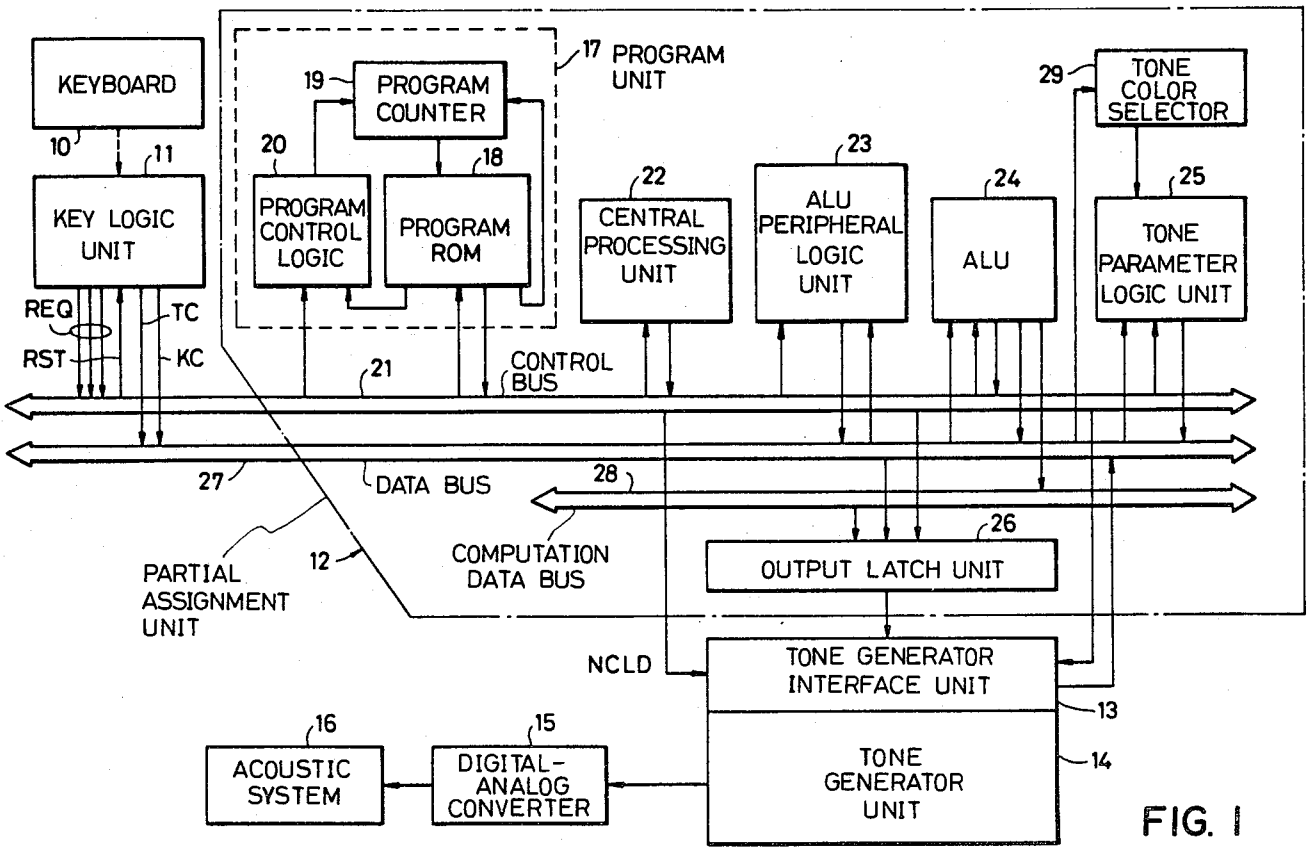
FIG. 1 is a block diagram showing the entire arrangement of one example of an electronic musical instrument according to this invention.

Referring first to FIG. 1, the electronic musical instrument according to the invention generally comprises a keyboard unit 10, a key logic unit 11, a partial assignment unit 12, a tone generator interface unit 13 and a tone generator unit 14. The key logic unit 11 detects depression and release of a key in the keyboard unit 10 and produces request data REQ in response to the depression or release of the key. A key code KC representing the depressed or released key and tough data TC representing the degree of touch on the key when the key has been depressed are also produced by the key logic unit 11 with the request data REQ. These various data are all supplied to the partial assignment unit 12. The request data REQ is data requesting the partial assignment unit 12 to perform some programmed operation.

The partial assignment unit 12 assigns production of partials constituting the musical tone for the depressed key to some of partial generation time slots of a specific number in response to the request data REQ, key code KC etc. supplied by the key logic unit 11. The tone generator interface unit 13 repeatedly supplies data of each partial to the tone generator unit 14 in synchronism with the time slot to which the partial has been assigned. The tone generator unit 14 in turn produces a waveform signal of each partial on a time shared basis in accordance with the data of the partial supplied at the time slot to which the partial has been assigned. If the waveform signal generated in the tone generator unit 14 is a digital signal, the output digital signal of the tone generator 14 is converted into an analog signal by a digital-to-analog converter 15.

In the present embodiment, the key logic unit 11, the partial assignment unit 12 and the tone generator unit 14 consist respectively of digital circuits. In particular the partial assignment unit 12 performs the partial production assignment operation in a manner of microprogramming. A program production unit 17 comprises a program read-only memory (the read only memory being hereinafter referred to as ROM) 18, a program counter 19 and a program control logic 20. The program ROM 18 prestores a program for assigning the partials. The program control logic 20 controls the counting operation of the program counter 19 in response to a signal provided on a control bus 21 and contents read from the program ROM 18. The program ROM 18 is read in accordance with the counting output of the program counter 19.

The data read from the program ROM 18 is supplied through the control bus 21 to a central processing unit (hereinafter referred to as CPU) 22. The CPU 22 decodes the program data read from the program ROM 18 and thereupon provides an instruction for implementing the program on the control bus 21. The control bus 21 is used for implementing the programmed operation. The CPU 22 receives control signals fed back from other circuits of the partial assignment unit 21 through the control bus 21 and provides, responsive to these control signals, a signal for controlling the program production unit 17 or other circuit on the control bus 21.

The request data REQ produced by the key logic unit 11 is supplied to the partial assignment unit 12 through the control bus 21. A key scanning operation performed in the key logic unit 11 is also controlled in accordance with the program in the partial assignment unit 12. When the key scanning is started, a reset signal RST is supplied to the key logic unit 11 through the control bus 21.

Instructions for the programmed operation provided from the CPU 22 on the control bus 21 are supplied to an arithmetic and logic operation unit (ALU) peripheral logic 23 (hereinafter referred to as ALU peripheral logic 23), an arithmetic and logic operation unit (ALU) 24, tone parameter logic 25 and an output latch unit 26. These circuits 23–26 implement the instructed operations by utilizing the data provided through data bus 27. The ALU peripheral logic 23 includes a plurality of hardware logics provided for partial assignment processing. The ALU 24 includes a computation circuiting and a register for temporary storage. The ALU 24 temporarily stores data provided on the data bus 27, implements the instructed computation using the temporarily stored data and provides a result of the computation on a computation data bus 28. The key code KC outputted by the key logic unit 11 and the touch data TC are supplied to the partial assignment unit 12 through the data bus 27 and utilized in the unit 12.

The tone parameter logic 25 is a circuit provided for generating various parameters necessary for producing a desired tone color. The tone color is selected by a tone selector 29.

Information is exchanged and computation is carried out between the ALU peripheral logic 23, ALU 24 and tone parameter logic 25 and data of a partial which is to be newly assigned thereby is obtained. This data is latched by the output latch unit 26. The data latched by the output latch unit 26 includes data necessary for determining frequency and envelope of the partial to be newly assigned. The output latch unit 26 has a plurality of latch circuits disposed in parallel and corresponding to respective data of the partial. The data of the partial latched temporarily by the output latch unit 26 is stored in the tone generator interface unit 13 at a time slot to which the partial is assigned. The tone generator interface unit 13 repeatedly supplies to the tone generator unit 14 the data of the partial assigned to the time slot at the specific time slot.

OUTLINE OF THE PARTIAL ASSIGNMENT

FIG. 2 is a flow chart schematically illustrating the partial assignment system of the present embodiment.

In a stage designated by block 30 a key scanning operation is performed. In a next stage designated by block 31, a newly depressed key is detected in accordance with the key scanning. Upon detection of a newly depressed key, the key scanning operation is stopped and a routine for the partial assignment designated by a large block 32 is started.

In the routine for the partial assignment processing shown by the block 32, assignment processing is conducted partial by partial with respect to all partials constituting a tone of the newly depressed key. In assigning the respective partials, it will be advantageous to processing for "harmonic limiting" to be described later if the partials are assigned in the order starting from a partial of the lowest order and shifting upwardly. It should be noted that the assignment processing is performed with respect only to partials constituting the tone of the newly depressed key.

Each time one partial has been assigned, an operation for judging whether assignment of all partials constituting the tone has been completed or not is performed in a last block 33 in the block 32. If the answer is "NO", the initial operation in the block 32 is resumed for assigning a next partial. If the answer is "YES", that means the assignment of all partials of the tone has been completed so that the operation returns to the block 30 and the scanning of the keys is resumed.

Processing operations corresponding to the block 30 representing the newly depressed key detection are carried out in the key logic unit 11 shown in FIG. 1. The processing of the block 32 is carried out in the partial assignment unit 12 (FIG. 1) in accordance with the request data REQ produced by the key logic unit 11. More specifically, the processing of the block 32 is carried out in accordance with new claim data NCL included in the request data REQ. The new claim data NCL is data representing that a key has been newly depressed.

The request data REQ requesting the partial assignment unit 12 to perform some programmed operation includes new release data NRLS and pre-new-claimedata PNCL beside the new claim data NCL. The new release data NRLS represents that a depressed key has been newly released. The pre-new-claim data PNCL is produced when a first contact of a key switch is actuated as will be described more fully later. In the block 31, the data NRLS and PNCL are produced in accordance with the key scanning. When the new release data NRLS is produced, new release routine 34 is implemented in the partial assignment unit 12. When the pre-new-claim data PNCL is produced, pre-new-claim routine 35 is implemented. The key scanning operation is not suspended when the pre-new-claim routine 35 is implemented. These routines 34 and 35 will be described more in detail later.

Principal processing operations in the partial assignment processing block 32 will now be briefly described.

In the block 36, data of a partial to be assigned is obtained. This is implemented by generating tone parameters concerning the partial from the tone parameter logic 25 (FIG. 1) in accordance with the tone color selected by the tone selector 29 and thereafter scaling pitch data and level data of the partial by these tone parameters and the touch data TC. TData necessary for forming the partial is thus obtained by processing operations in the block 36. If it is judged in harmonic limiting judgement block 37 that the frequency of the partial is to be subjected to "harmonic limiting" (in case the answer is "YES") from the pitch data of the partial, a subsequent processing is stopped and the key scanning is resumed in block 30. Since the assignment operation is performed from the lowest order of partial upwardly in the block 32, if a partial is subject to "harmonic limting", partials of higher order which were to be assigned subsequently should necessarily be subject to "harmonic limiting" so that assignment of such partials of higher orders can be omitted. This arrangement contributes to preventing occurrence of waste in utilization of time slots and also to shortening of the assignment processing time.

If the partial is not subject to "harmonic limiting" (the answer is "NO"), the processing in the block 32 is continued. In minimum level judgement block 38 the level data of the partial is examined and, if the level is osso small that there is no significance in producing the partial (i.e. the answer is ∓YES"), the assignment processing for the partial in subsequent stages is stopped and the processing is returned to the initial processing in the block 32 for proceeding with assignment of a next partial. Accordingly, partials of minimum levels are not assigned to any time slot. If the level is not minimum (i.e. the answer is "NO"), the assignment processing for the partial is continued.

When all data concerning the partial has been obtained through the above described processing and the data has been latched by the output latch unit 26 (FIG. 1), the claim signal CLM is provided in accordance with the processing in the block 39. When the claim signal CLM is produced, whether there is a time slot available for assignment of the partial or not is judged in block 40. If there is no time slot available (i.e. the answer is "NO"), the subsequent processing in the block 32 is stopped and the processing is returned to the key scanning 30. The state in which there is no time slot available means that all partial generating time slots are occuplied by partials which have been assigned thereto and, accordingly, there is no room for newly assigning partials which have not been assigned to any time slot yet. The processing in the block 32 therefore is stopped and the key scanning is resumed. If there is a time slot available for assignment (i.e. the answer is "YES"), an operation for assigning the partial to one available time slot is carried out. More specifically, a new claim load signal NCLD is produced at the time slot to which the partial is to be assigned and the data of the partial latched by the output latch unit 26 (FIG. 1) is supplied to the tone generator interface unit 13 at the timing of the specific time slot.

Details of the program which has been briefly discussed above with reference to FIG. 2 will be established in the program production unit 17 (FIG. 1).

DETAILED DESCRIPTION OF THE KEY LOGIC UNIT 11

Figure 3:
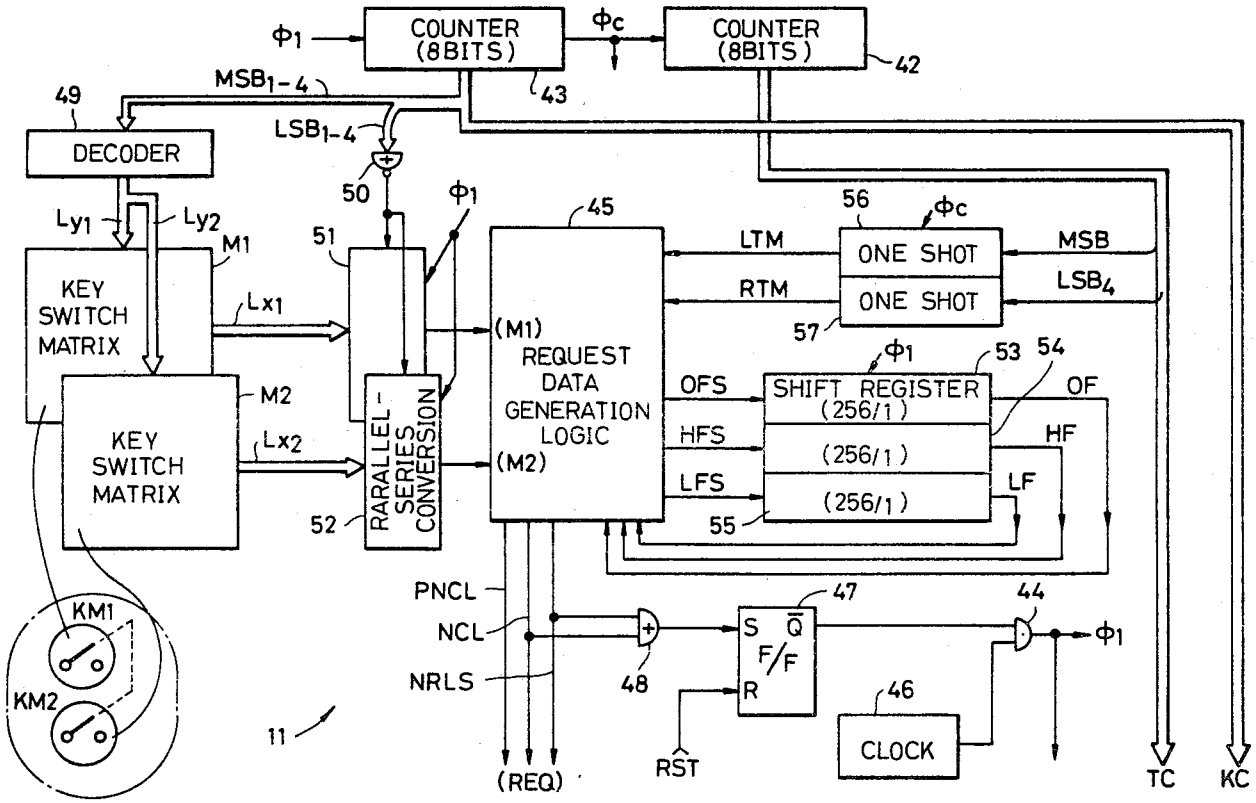
FIG. 3 is a block diagram showing a detailed example of a key logic unit shown in FIG. 1.

In the key logic unit shown in FIG. 3, key switch matrixes M1 and M2 are so designed that the key switches of various keys provided in association with the keyboard unit 10 (FIG. 1) are classified according to twelve notes and octave ranges and are then arranged in matrix form. In the key switch matric M1, the first contact means KM1 of the key switches are arranged. In the key switch matrix M2, the second contact means KM2 of the key switches are arranged. The contact means KM1 and KM2 are provided for each key in such a manner that when the key is slightly depressed, the first contact means KM1 is closed, and then when the key is fully depressed, the second contact means KM2 is closed. This is to measure the difference in closure time between the two contact means to provide a key touch signal which is utilized for the touch responsive control of a musical tone.

In this example, only one touch counter 42 is provided for computing the difference in closure time between the two contact means, to that it is utilized commonly by all of the keys, the touch counter 42 is an 8-bit binary counter, the count output of which is provided, as a touch data TC, by the key logic unit 11. The touch counter 42 counts the carry signal $\phi_c$ of a key counter 43. The 8-bit ckey counter 43 is provided for carrying out key scanning, and counts a clock pulse $\phi_1$ supplied from an AND circuit in the key logic unit 11. Accordingly, the count value of the touch counter is increased by one whenever one cycle of key scanning by the key counter 43 is completed. When the key scanning is suspended, the operation of the touch counter 42 is also suspended.

*OUTLINE OF A METHOD OF OBTAINING A COUNT VALUE CORRESPONDING TO KEY TOUCH

When the first contact means KM1 is closed, a pre-new-claim data PNCL is outputted by a request data generating logic 45, whereupon the touch data TC (count value) being supplied from the touch counter 42 (is stored in a register (not shown) in the ALU 24. This value will be referred to as "a first count value $TC_1$" hereinafter for convenience in description. When the second contact means KM2 of the same key is closed, a new claim data NCL is provided by the request data generating logic 45, whereupon the touch data TC being supplied is stored in another register in the ALU 24. This will be referred to as "a second count value $TC_2$" hereinafter, similarly, A subtraction ($TC_2-TC_1$) is effected according to the contents of the registers in the ALU 24. The result of this subtraction is a count value corresponding to the difference in closure time between the first contact means KM1 and the second contact means KM2, i.e., the key touch signal.

*CONTROL OF THE KEY SCANNING

A clock pulse generated by a clock pulse generator 46 is utilized as the key scanning clock pulse $\phi_1$. The clock pulse outputted by the clock pulse generator 46 is applied to one input terminal of the AND circuit 44, and an output $\overline{Q}$ of a flip-flop 47 is applied to the other input terminal of the AND circuit 44. The new claim data NCL or the new release data NRLS provided by the request data generating logic 45 is applied through an OR circuit 48 to the set input terminal (S) of the flip-flop 47. Accordingly, when the new claim data NCL or the new release data NRLS is provided, the flip-flop 47 is set, and its inversion output $\overline{Q}$ is set to "0". Therefore, the AND circuit 44 is disabled. As a result, the clock pulse $\phi_1$ is not applied to the key counter 43, and the key scanning is therefore suspended. Since no pre-new-claim data PNCL is applied to the OR circuit 48, the key scanning is not suspended by the data PNCL. This means that the process effected in the partial assignment unit 12 (FIG. 1) upon generation of the pre-new-claim data PNCL may be achieved without suspending the key scanning.

When the process in the block 32 (FIG. 2) for processing partials has been completed, or when the process in the new release routine 34 has been completed, a reset signal RST is outputted by the partial assignment unit 12. This reset signal RST is applied to the reset input terminal (R) of the key scanning control flip-flop 47 to reset the latter, whereupon its inversion output $\overline{Q}$ is set to "1", and the AND circuit 44 is enabled. Thus, the clock pulse $\phi_1$ from the clock pulse generator 46 is applied to the key counter 43. That is, upon application of the reset signal RST, the key scanning is started again.

*KEY SCANNING

The 8-bit key counter 43 is a modulo $2^8$ which can cover the number of all of the keys in the keyboard unit 10 (FIG. 1). The keyboard unit 10 comprises an upper keyboard, a lower keyboard, and a pedal keyboard, for instance. Each count value of the key counter 43 is assigned to each key of these plural keyboards. The key matrixes M1 and M2 are scanned by the output of the key counter 43, so that the 8-bit output count value of the key counter 43 recognizes a key being scanned. Thus, the output of the key counter 43 is provided, as a key code KC representative of the key being scanned, by the key logic unit 11.

The key switch matrix M1 is formed with sixteen octave scanning lines (input lines) $Ly_1$ arranged vertically and twelve note scanning lines (output lines) $Lx_1$ arranged horizontally. Similarly, the key switch matrix M2 is formed with sixteen octave scanning lines $Ly_2$ and twelve note scanning lines $Lx_2$. The key switches of twelve notes (C through B) of one and the same octave range are connected to the octave scanning lines $Ly_1$ and $Ly_2$, respectively. The number of octaves is sixteen, because three keyboards are provided. The key switches of the same named notes are connected to the note scanning lines $Lx_1$ and $Lx_2$, over the sixteen octaves.

The signal of the four most significant bits $MSB_{1\text{-}4}$ among the 8-bit output of the key counter 43 is inputted to a decoder 49, where it is decoded to one of the octave scanning lines $Ly_1$ and $Ly_2$. The four least significant bits output $LSB_{1\text{-}4}$ corresponds to a note and is applied to a 4-input NOR circuit 50. Whenever all of the four bits of the count value $LSB_{1\text{-}4}$ are set to "0", the output of the NOR circuit 50 is raised to "1". This output "1" is utilized as inputting control signal for parallel-series converter circuits 51 and 52. Each of the parallel-series converter circuits 51 and 52 is made up of a 12-bit parallel input and series shift type shift register employing as its shift pulse the same clock pulse $\phi_1$ as that employed in the key counter 43. The twelve note scanning lines of the key switch matrix M1 for the first contact means KM1 are connected to the first parallel-series converter circuit 51. Similarly, the twelve note scanning lines of the key switch matrix M2 for the second contact means KM2 are connected to the second parallel-series converter circuit 52.

When all of the four less significant bits $LSB_{1\text{-}4}$ of the key counter 43 are "0", a signal "1" is outputted by the NOR circuit 50. By this output "1", the on-off detection data of twelve notes (C through B) on the note scanning lines $Lx_1$ and $Lx_2$ are inputted, in a parallel mode, into the parallel-series converter circuits 51 and 52, and then the data thus inputted are shifted one bit by one bit in response to the clock pulse $\phi_1$ and are supplied, in a series mode, to the request data generating logic 45. When the clock pulse $\phi_1$ is provided twelve times, i.e., when the four less significant bits $LSB_{1\text{-}4}$ of the key counter 43 are changed from "0 0 0 1" to "1 1 0 0", the series delivery of all of the on-off detection data of the twelve notes is completed.

When the four less significant bits $LSB_{1\text{-}4}$ are changed to "0 0 0 0" again, the four more significant bits $MSB_{1\text{-}4}$ are increased by one (1), and the output of the decoder 49 is changed. As a result, the signals "1" on the octave scanning lines $Ly_1$ and $Ly_2$ are switched for the next octave, and the on-off detection data of twelve new notes obtained by the octave switching operation are provided on the note scanning lines $Lx_1$ and $Lx_2$. The new data are inputted, in a parallel mode, into the parallel-series converter circuits 51 and 52 in response to the signal "1" supplied from the NOR circuit 50. Thereafter, the data are shifted in a series mode, similarly as in the above-described case.

As was described above, whenever one line is switched in the octave scanning lines $Ly_1$ and $Ly_2$, all of the twelve note scanning lines $Lx_1$ and $Lx_2$ are scanned. The combination of the count value of the four more significant bits $MSB_{1\text{-}4}$ of the key counter 43 specifying the octave scanning lines $Ly_1$ and $Ly_2$ and the count value of the four less significant bits $LSB_{1\text{-}4}$ synchronous with the scanning of the note scanning lines $Lx_1$ and $Lx_2$ determines a single key being scanned. The count value of the thus combined eight bits is the key code KC. In the above description, the four more significant bits $MSB_{1\text{-}4}$ is representative of a keyboard and its octave range, whereas the four less significant bits $LSB_{1\text{-}4}$, a note among the twelve notes.

Since the key counter 43 is based on the modulo $2^8$, one cycle of key scanning is completed whenever 256 clock pulses $\phi_1$ are applied thereto. The clock pulse $\phi_c$ supplied to the count input terminal of the touch counter 42 from the most significant bit of the key counter 43 has a period synchronous with one scanning cycle. The count value of the touch counter 42 is increased by one per every scanning cycle. The speed of this clock pulse $\phi_c$ is much faster than the speed required for the key depression shifting from the first contact means KM1 to the second contact means KM2.

*GENERATION OF THE REQUEST DATA REQ

The request data generating logic 45 decides whether a key is newly depressed or released according to the comparison between the scanning result one scanning cycle before and the current scanning result, thereby to provide the request data REQ (PNCL, NCL, and NRLS). Aside the simple comparison between the preceding scanning result and the present scanning result, under certain conditions, the logic 45 outputs a on flag set signal OFS, a half flag set signal HFS, or a long flag set signal. These signals are delayed by one scanning cycle in shift registers 53, 54 and 55 each having 256 stages which are shifted in response to the clock pulse $\phi_1$. An on flag signal OF (obtained by delaying the signal OFS), a half flag signal HF (obtained by delaying the signal HFS) and a long flag signal LF (obtained by delaying the signal LFS) are returned to the request data generating logic 45 so as to be compared with the present scanning result. A long time signal LTM and a release time signal RTM are applied to the request data generating logic 45. The long time signal LTM is obtained by shaping the signal of the most significant bit MSB of the touch counter 42 into a pulse width corresponding to one period of the clock pulse $\phi_1$ in one shot multivibrator circuit 50. In the case where the difference in closure time between the first contact means KM1 and the second contact means KM2 is abnormally large, the long time signal LTM is used to disregard the depression of that key. The repetitive generation period of the long time signal LTM is 256 times as long as the period of the clock pulse $\phi_c$, and its pulse width is one scanning cycle time. The release time signal RTM is obtained by shaping the fourth bit $LSB_4$ from the least significant bit (fourth least significant bit) of the touch counter 42 into a pulse width corresponding to one period of the clock pulse $\phi_c$ in one shot circuit 57. The release time signal RTM is used to prevent the reaction which may otherwise caused in response to the chattering of the contacts means at the time of key release. The repetitive generation period of the release time signal RTM is sixteen times as long as the period of the clock pulse $\phi_c$, and its pulse width is one scanning cycle time.

The logical equations (1) through (6) of circuits in the request data generating logic 45 are as described below. In these equations M1 is the on-off detection data of the first contact means KM1 in a scanning time slot, and M2 is the on-off detection data of the second contact means KM2 in the same scanning time slot, these data being supplied from the parallel-series converter circuits 51 and 52.

The conditions for generating the on flag set signal OFS, the half flag set signal HFS and the long flag set signal LFS are:

$$OFS = HF \cdot M2 + LF \cdot LTM + OF \cdot \overline{HF \cdot \overline{M1} \cdot \overline{M2} \cdot RTM} \quad (1)$$

$$OFS = OF \cdot M1 + OF \cdot M1 \cdot M2 \cdot RTM + LF \cdot LTM + \overline{HF \cdot \overline{OF} \cdot M2 + OF \cdot \overline{\overline{M2} \cdot \overline{M1}}} \quad (2)$$

$$LFS = \overline{OF} \cdot HF \cdot \overline{M2} \cdot LTM + LF \cdot \overline{\overline{OF} \cdot HF \cdot M2 + OF \cdot HF \cdot \overline{M1} \cdot \overline{M2} \cdot RTM} \quad (3)$$

The condition for a chance by which the on flag set signal OFS is generated is (HF·M2); that is, it is necessary for the second contact means KM2 to turn on during the generation of the half flag signal HF. By the on flag signal OF appearing one scanning cycle after that, the on flag set signal OFS is generated again and self-held. When both of the first and second contact means KM1 and KM2 are set off, (M1·M2), then both of the on flag set signal OFS and on flag signal OF are eliminated.

The condition for a chance by which the half flag set signal HFS is generated is (OF·M1); that is, it is necessary that the first contact means KM1 is turned on before the on flag signal OF is generated. The half flag signal HF is also self-held.

The condition for a chance by which the long flag set signal LFS is generated is that although the half flag signal HF has been produced, the on flag signal OF is not produced, and the long time signal LTM is produced while the second contact means KM2 being maintained in off state. This is also self-held.

The conditions of generating the pre-new-claim data PNCL, the new claim data NCL and the new release data NRLS are:

$$PNCL = \overline{OF} \cdot M1 \quad (4)$$

$$NCL = \overline{OF} \cdot HF \cdot M2 \quad (5)$$

$$NRSL = OF \cdot HF \cdot \overline{M1} \cdot \overline{M2} \cdot RTM \quad (6)$$

The pre-new-claim data PNCL is produced when the first contact means KM1 is turned on while none of the on flag signal OF is produced. When the equation (4) is satisfied, the above-described equation (2) is also satisfied, and the half flag set signal HFS is produced. Therefore, if the pre-new-claim signal PNCL is produced once, then in the scanning time a slot of the relevant key in the next scanning cycle the half flag signal HF is provided.

The new claim data NCL is produced when the second contact means KM2 is turned on under the condition that the on flag signal OF is not produced but the half flag signal HF is produced. When the equation (5) is satisfied, then the equation (1) described above is also satisfied, and the on flag set signal OFS is produced. Accordingly, in the same scanning time slot of the next scanning cycle, the on flag signal OF is produced, and the equation (5) is not established. Thus, the new claim data NCL is provided only once when the second contact means KM2 is closed immediately after the first contact means KM1. In the case where the difference is closure time between the first contact means KM1 and the second contact means KM2 is excessively large, the above-described equation (3) is established, the long flag signal LF is produced, the equations (1) and (2) are established upon arrival of the next long time signal LTM, and both of the signals OF and HF are produced before the new claim data NCL is provided. Accordingly, in this case, no new claim data NCL is produced. This is the case where the finger touches a key slightly to depress it to the position of the first contact means KM1, but the key is released without being further depressed.

The new release data NRLS is produced with the timing of the release time signal RTM when both of the signals OF and HF are produced and both of the first and second contact means KM1 and KM2 are opened. Even if chattering is caused during the key release, the new release data NRLS is not produced without arrival of the release time signal RTM, and therefore no reaction is made on the chattering. When the equation (6) is established, then the term for self-holding in the equation (1) is disestablished. Therefore, the on flag set signal OFS is not produced, and in the same scanning time slot of the next scanning cycle the on flag signal OF is not produced. Accordingly, the conditions of the equation (6) are not satisfied, and the new release data NRLS is produced only one at the time of key release.

DESCRIPTION OF THE ALU PERIPHERAL LOGIC 23

The ALU peripheral logic 23 includes circuits having various functions, which are shown in FIGS. 4 through 9(*a*)

*CIRCUIT CONCERNING THE PROCESS OF THE PRE-NEW-CLAIM DATA PNCL

Shown in FIG. 4 is a circuit used to process the pre-new-claim data PNCL and compute the key touch signal. The count value of a PNCL counter 58 is increased by an increase pulse $INC_1$ supplied from the CPU 22 (FIG. 1) in the pre-new-claim routine. The output of the PNCL counter 58 is applied to one input terminal (A) of a selector 59. The pre-new claim data PNCL is applied from the key logic unit 11 to the selection control input terminal of the selector 59. When the data PNCL is at "1", the input (A), i.e., the count value of the PNCL counter 58 is selected to be outputted. When no data PNCL is produced, data applied to the input terminal (B) is selected. The data applied to the input terminal (B) is the count output ADRS of an address counter 60 (FIG. 12) in the tone parameter logic 23 (FIG. 1). The count PNCLC of the PNCL counter 58 is applied also to the address counter 60.

The selection output of the selector 59 is applied to the address specifying input terminals of random access memories 61 and 62 (hereinafter referred to merely as "RAM's 61 and 62" when applicable). The pre-new-claim data PNCL is applied through an inverter 63 to the read or write cacontrol input terminals R/W of the RAM's 61 and 62. The control input R/W specifies a read mode when at "1", and a write mode when at "0". Accordingly, when the pre-new-claim data PNCL is provided, the RAM's 61 and 62 are placed in the write mode. The key code KC is applied from the key logic unit 11 to the data input terminal of the RAM 61, while the touch data TC is applied from the key logic unit 11 to the data input terminal of the RAM 62. Therefore, the key code KC and the touch data TC produced at the same time as the pre-new-claim data PNCL are written in the RAM's 61 and 62, respectively. The writing addresses in this case are designated by the count value of the PNCL counter 58. An enable signal $ENB_1$ applied to both of the RAM's 61 and 62 is provided by the CPU in accordance with a program. Only when this enable signal ENB is applied, the aforementioned writing or reading operation is effected. The outputs of the RAM's 61 and 62 are applied to the ALU 24 (FIG. 1).

That is, the RAM's 61 and 62 are to store a key code KC for determining a key which permits the production of a pre-new-claim data PNCL, and a touch data TC at that time (i.e., when the first contact means KM1 of the key is closed). The PNCL counter 58 is to specify an address where the data should be stored. The key codes KC and touch data TC of keys successively depressed are stored in different addresses, because the count contents of the counter 58 is changed in response to the application of the increase pulse $INC_1$ as described later.

Figure 12:
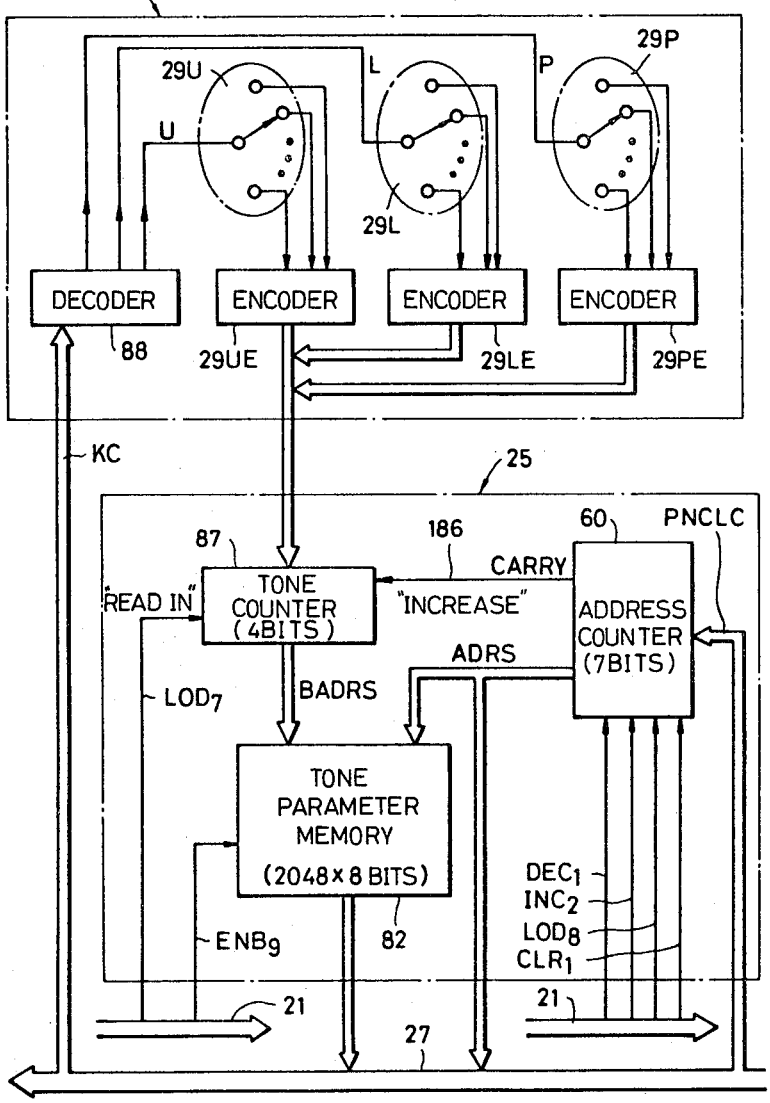
FIG. 12 is a block diagram showing examples of a tone parameter logic and a tone selector in FIG. 1.

When no pre-new-claim data PNCL is provided, the RAM's 61 and 62 are placed in the read mode by the output "1" of the inverter 63, and therefore the input (B) of the selector 59 is selected, and the read address is specified by the count signal ADRS from the address counter 60 (FIG. 12). The timing of actual reading is the time instant when the enable signal $ENB_1$ is apsupplied from the CPU 22 (FIG. 1) according to the program. This reading operation is carried out in the computation of the key touch signal as described later.

*CIRCUIT CONCERNING THE GENERATION OF TOUCH FACTORS AND NOTE SCALE FACTORS

The term "touch factor" is a coefficient factor for controlling the relative amplitude of a partial according to key touch. The term "note scale factor" is a coefficient factor for controlling the relative amplitude of a partial according the tone pitch of a key. The touch factor and the note scale factor are provided for every portions (an attack portion, a decay portion, etc) of the amplitude envelope of a partial.

Referring to FIG. 5, amplitude controlling coefficient factors having various values are stored in a touch factor and note scale factor memory 77 in advance. The coefficient factor which is read out of the memory 77 for a "touch factor" process is utilized as a touch factor TCF, and the coefficient factor which is read out of the memory 77 for a "note scale factor" process is utilized as a note scale factor NSF. The memory 77 is a read only memory (ROM) in which coefficient factors, 8 bits per word, are stored as many as 2,048 words. In this case, an address input to the memory 77 is 11 bits: a signal of 11 bits, in total, from a touch latch 78 and a touch sensitivity latch 79, and a signal of 11 bits, in total, from a note latch 80 and a note scale latch 81 are applied as address signals to the memory 77.

The touch latch 78 is to latch a key touch signal ($TC_2-TC_1$) computed in the CPU 24 (FIG. 1). The data input terminal of the touch latch 78 is connected to the data bus 27. As will become more apparent later, when the key touch signal computation is completed, the computation result ($TC_2-TC_1$) is applied to the data bus 27 from the ALU 24, and simultaneously a load signal $LOD_1$ is applied through the control bus 21 to the latch 78. In response to this load signal $LOD_1$, the key touch signal ($TC_2-TC_1$) is stored through the data bus 27 in the latch 7.

The touch sensitivity latch 79 is to latch touch sensitivity data which is read out of a tone parameter memory 82 according to the program. The touch sensitivity data is applied also through the data bus 27 to the data input terminal of the latch 79. At the timing when the touch sensitivity data delivered to the data bus 27 from the tone parameter memory 82 should be inputted, a load signal $LOD_2$ is applied to the latch 79 in accordance with the program. The touch sensitivity data is latched by the latch 79 with the aid of the load signal $LOD_2$.

The touch sensitivity data (which will be described in detail in conjunction with a description of the tone parameter memory 82 later) is to adjust the touch control sensitivity for every portion (such as attack and decay portions) of a partial amplitude envelope, and it corresponds to a tone color selected by the tone selector 29 (FIG. 1). The touch sensitivity data latched by the touch sensitivity latch 79 is subjected to scaling suitably with the aid of the key touch signal latched by the touch latch 78. As a result, the touch factor TCF is obtained. This scaling is carried out by the use of the memory 77.

That is, when enable signals $ENB_2$ and $ENB_3$ are applied through the control bus 21 to the touch latch 78 and the touch sensitivity latch 79, then the latch contents of the latches 78 and 79 are read out. For instance, a 7-bit key touch signal read out of the touch latch 78 and a 4-bit touch sensitivity data read out of the touch sensitivity latch 79 are combined into an 11-bit address signal which is inputted into the touch factor and note scale factor memory 77. Simultaneously, an enable signal $ENB_4$ is applied to the memory 77, as a result of which the memory 77 becomes ready for reading, and a coefficient factor (or a touch factor TCF) corresponding to the address input signal from the latches 78 and 79 is read out.

The note latch 80 is to latch data corresponding to the pitch of a partial which is about to be assigned. This partial pitch data is supplied through the data bus 27 by the ALU 24 (FIG. 1). Circuits shown in FIGS. 6 and 7 are used for computing the partial pitch data.

Figure 6:
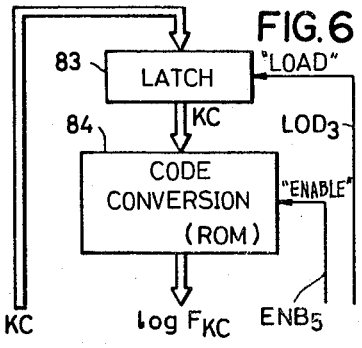

Referring to FIG. 6, when a key code KC is applied to a latch circuit 83 from the key logic unit 11 (FIG. 3) and a load signal $LOD_3$ is supplied to the latch circuit 83 from the CPU 22 (FIG. 1) in accordance with the program, then the key code is latched. During the partial assignment, the key scanning is suspended, and therefore the key code of a key to be assigned is latched by the latch circuit 83. The key code KC latched by the latch circuit 83 is applied to a code converter 84. The code converter 84 comprises a read only memory, and outputs a value log $F_{KC}$ which is a logarithmic expression of the tone pitch (musical tone frequency) $F_{KC}$ of a key indicated by a key code. Upon application of an enable signal $ENB_5$ from the CPU 22 in accordance with the program, the code converter 84 is enabled, to convert the input KC into the tone pitch logarithmic expression log $F_{KC}$.

Figure 7:
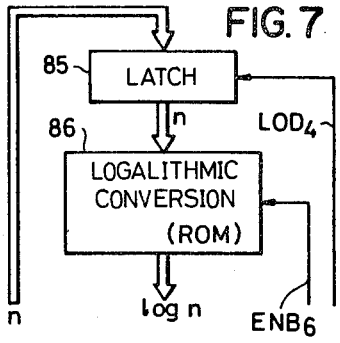

In FIG. 7, when a numerical data n representative of the order of a partial is applied from the tone parameter memory 82 (FIG. 12) to a latch circuit 85 and a load signal $LOD_4$ is applied from the CPU 22, to the latch circuit 85, then the partial order data n is latched by the latch circuit 85. The order of a partial is not only an integer but also a fractional. For instance, the order data is of 8 bits, and includes a fractional part and an integer part. The order data latched by the latch circuit 85 is applied to a logarithmic converter 86 comprising a read only memory, where it is converted into a logarithmic expression log n. The logarithmic converter 86 is enabled by an enable signal $ENB_6$.

The reason for converting the key tone pitch $F_{KC}$ and the order n into logarithmic expressions is that multiplication for obtaining the pitch ($n \cdot F_{KC}$) of a partial can be carried out by addition.

The key tone pitch data log $F_{KC}$ and the order data log n outputted by the circuits shown in FIGS. 6 and 7 are stored in a register of the ALU 24 (FIG. 1) once, where a computation ($\log F_{KC} + \log n = \log (n \cdot F_{KC})$) is carried out. The computation result log ($n \cdot F_{KC}$) corresponds to the pitch of one partial (order n) to be assigned. This partial pitch data log ($n \cdot F_{KC}$) is utilized for the decision of "harmonic limiting", and is applied through the data bus 27 to the note latch 80 (FIG. 5). The partial pitch data log ($n \cdot F_{KC}$) is latched by the note latch 80 with the aid of a load signal $LOD_5$.

The note scale latch 81 operates to latch a note scale data which is read out of the tone parameter memory 82 in accordance with the program. More specifically, when the note scale data is supplied from the tone parameter memory 82 through the data bus 27 to the note scale latch, the load signal $LOD_6$ is applied to the latch 81, whereby the note scale data is latched by the latch 81.

The "note scale data" is a fundamental data which subjects the characteristic of each portion (such as an attack or decay portion) of the amplitude envelope of a partial to scaling according to the pitch of the partial, and corresponds to a tone color selected by the tone selector 29 (FIG. 1). The aforementioned partial pitch data log ($n \cdot F_{KC}$) is added to the note scale data, to provide a note scale factor NSF.

That is, when enable signals $ENB_7$ and $ENB_8$ are applied to the note latch 80 and the note scale latch 81, the latch contents of the latches 80 and 81 are read out, respectively. For instance, a 7-bit partial pitch data log ($n \cdot F_{KC}$) read out of the note latch 80 and a 4-bit scale data read out of the note scale latch 81 are combined into an 11-bit address signal, which is applied to the touch factor and note scale factor memory 77. Simultaneously, the enable signal $ENB_4$ is applied to the memory 77, and a coefficient factor (i.e. a note scale factor NSF) corresponding to the address input from the latches 80 and 81 is read out.

The touch factor TCF and note scale factor NSF concerning one partial being processed are applied from the touch factor and note scale factor memory 77 through the data bus 27 to the ALU 24 (FIG. 1), where they are temporarily stored and are then subjected to computation with other envelope control factors. These envelope control factors are read out of the tone parameter memory 82 as described later with reference to FIG. 12.

Whenever the assignment of a partial is processed, the touch factor TCF and the note scale factor NSF are provided in correspondence to that partial. The latch contents of the touch latch 78 (FIG. 5) and those of the latch circuit 83 (FIG. 6) for key codes KC rare maintained unchanged as long as the key is not changed even if the order n of the partial is changed. The contents of the note latch 80 (FIG. 5) and those of the latch circuit 85 (FIG. 7) for the order n are changed whenever a partial is processed.

Figure 8:
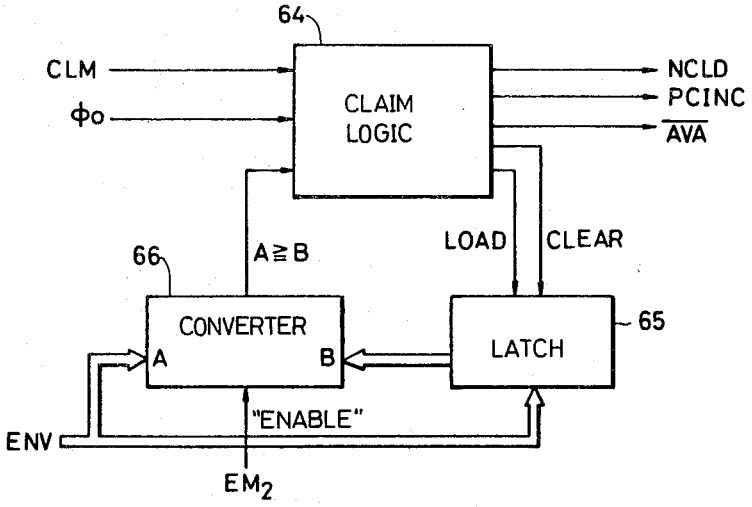
Figure 10:
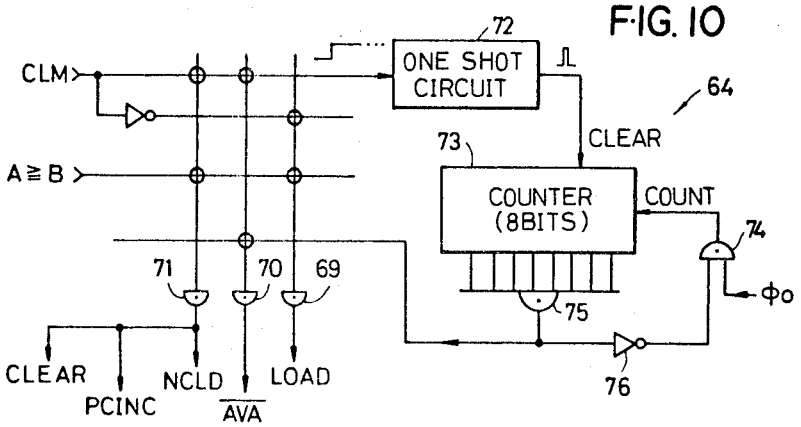
FIG. 10 is a detailed circuit diagram of a claim logic shown in FIG. 8.

*Circuit Concerning the Decision of an Available Time Slot the Generation of a New Claim Load Signal NCLD, and the Operation of Truncation Referring to FIG. 8, a claim logic 64 is a circuit which decides an available partial generation time slot to produce a new claim load signal NCLD in one of the available time slots. The claim logic 64 is illustrated in FIG. 10 in more detail. A latch circuit 65 and a comparator 66 operate to detect a time slot to which a partial mostly damped (decayed) is assigned. In the comparator 66, the amplitude envelope levels of partials assigned to time slots are successively subjected to comparison. The minimum level is stored in the latch circuit 65. A time slot where the amplitude envelope is minimum is the time slot to which the most damped partial is assigned. Therefore, the old partial assigned to the maximum damp time slot (i.e. time shot handling the most damped partial) is truncated to assign a new partial there. In this connection, a time slot to which no partial is assigned is employed as the maximum damp time slot, because its amplitude envelope level is "0". Accordingly, in practice, the assignment to an empty time slot is equal to the truncation; however, the truncation is such that there is no empty time slot at all, and the minimum level partial being produced is truncated from its time slot whereby a new partial is assigned thereto.

In order to detect the minimum level time slot, the amplitude envelope signal ENV in each time slot is applied to the input terminal (A) of the comparator 66 from the tone generator unit 14 (FIG. 1). In this example, since the amplitude envelope signal ENV is represented by the amount of damping, the lower the envelope amplitude level, the higher the value of the signal ENV. For instance, when all of the bits of the signal ENV are "1", then the envelope level is zero; and when all of the bits of the signal ENV are "0", then the envelope level is maximum. The minimum level data stored in the latch circuit 65 (being maximum as a signal value) is applied to the input terminal (B) of the comparator 66. When the envelope level at the input terminal (A) is smaller than that at the input terminal (B), i.e., when $A \geqq B$ where A and B are the values of the two inputs, the comparator 66 provides an output "1". This output "1" is applied through a claim logic 64 to the latch control input terminal of the latch circuit 65, whereby the input (A) resulting in $A \geqq B$, i.e., the envelope signal ENV in that time slot is latched by the latch circuit 65. Thus, the minimum envelope level (or the maximum value) stored in the latch circuit 65 is rewritten.

A signal $EM_2$ representative of the fact that a key concerning a partial assigned to a relevant time slot has been released is supplied from the tone generator interface unit 13 (FIG. 1) to the comparator 66. Only in the time slot where the signal $EM_2$ representative of key release, the comparator 66 can carry out comparison.

A claim signal CLM is transmitted from the CPU 22 in accordance with the program at the time when the decision of an available time slot should be carried out, and it is applied to the claim logic 64. A clock pulse $\phi_0$ is applied from a clock pulse generator 67 shown in FIG. 9(*a*) to the claim logic 64. This clock pulse $\phi_0$ is utilized to form a partial generating time slot. One period of the clock pulse $\phi_0$ is the time width of one partial generating time slot.

In this example, 256 partial generating time slots are provided, and accordingly, it is possible to generate 256 partials in maximum. The same time slot (constituting the same time division chnnel) appears every 256 periods of the clock pulse $\phi_0$.

Figure 9:
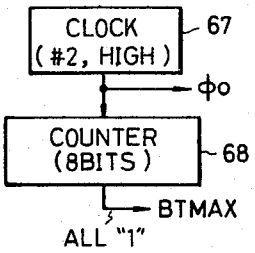
Figure 9:
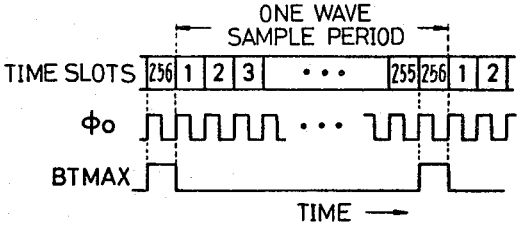

Referring to FIG. 9(*a*), the output clock pulse $\phi_0$ of the clock pulse generator 67 is applied to an 8-bit binary counter 68 where it is counted. Whenever all of the bits of the count value of the counter 68 become "1" (i.e. every 256 periods ($=2^8$) of the clock pulse $\phi_0$) a signal BTMAX is produced. This signal BTMAX is used in the tone generator unit 14 (FIG. 1) for establishing one sample point value of a musical tone waveform as described later.

Indicated in FIG. 9(*b*) is the relation in generation between the clock pulse $\phi_0$, the partial generating time slots (1 through 256) and the signal BTMAX.

The rate of the clock pulse $\phi_0$ is higher than that of the key scanning clock pulse $\phi_0$.

Figure 11:
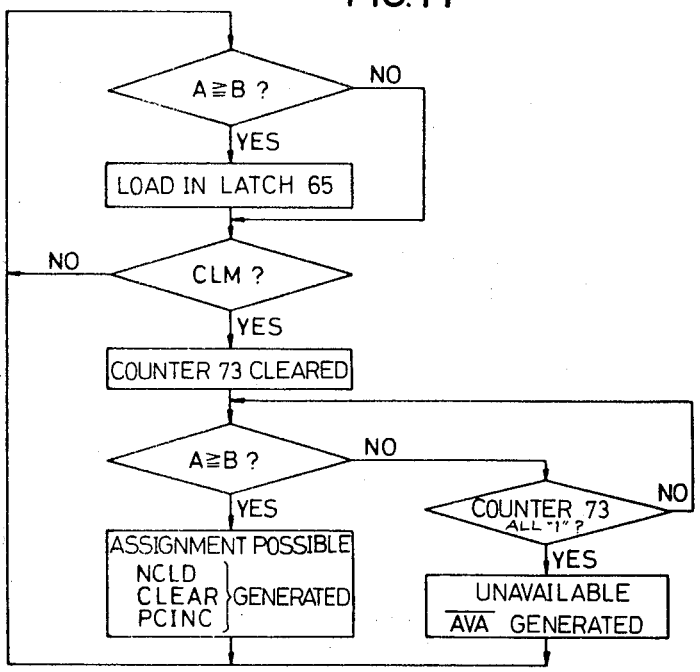
FIG. 11 is a flow chart for a description of the operation of the claim logic shown in FIG. 10.

Now, the claim logic 64 will be described in more detail with reference to FIGS. 10 and 11. In the case where no claim signal CLM is produced, upon satisfaction of the condition $A \geqq B$ of the comparator 66 (FIG. 8) the comparison output ($A \geqq B$) is set to "1" and an AND circuit 69 is enabled. The output of the AND circuit 69 is applied, as a load signal, to the latch circuit 65 (FIG. 8), so that the envelope signal applied to the latch circuit 65 is inputted thereinto. In this manner, the storage in the latch circuit 65 is rewritten, and a value corresponding to an envelope signal lower in level is stored in the latch circuit 65. When the above-described process is carried out for all of the 256 time slots, then a value corresponding to the minimum level envelope (that is, the maximum value) is stored in the latch circuit 65.

When all the data have been latched by the output latch circuit 26 (FIG. 1), the claim signal CLM is produced as described later. The claim signal CLM is applied to first inputs of two-input type AND circuits 70 and 71 and to a one shot circuit 72. At the rise of the claim signal CLM the one shot circuit 72 produces a single pulse (synchronous with one pulse time of the clock pulse $\phi_0$), which is applied to the clear input terminal of a counter 73. As a result, all the bits of the contents of the counter 73 are set to "0". The clock pulse $\phi_0$ is applied through an AND circuit 74 to the count input terminal of the counter 73. When all of the eight bits of the output of the counter 73 are set to "1", an eight-input type AND circuit 75 is enabled, and the output of the AND circuit 75 is applied through an inverter 76 to the AND circuit 74 to disable the latter 74. In the other case, the AND circuit 74 is maintained enabled. Therefore, immediately after the counter 73 is cleared, the counter 73 counts the clock pulse $\phi_0$. This counting operation is continued until 256 clock pulses $\phi_0$ are applied thereto after the rise of the claim signal CLM, i.e., until all of the eight bits of the output of the counter 73 are set to "1".

The comparison output ($A \geqq B$) of the comparator 66 is applied to a second input terminal of the AND circuit 71, to determine whether or not the condition ($A \geqq B$) is satisfied during the counting operation of the counter 73. If the condition is satisfied, the output ($A \geqq B$) of the comparator 66 is set to "1", and the AND circuit 71 provides an output "1". This output "1" of the AND circuit 71 is applied, as the new claim load signal NCLD, to the tone generator interface unit 13 (FIG. 1), as a clear signal, to the latch circuit 65 (FIG. 8), and as a program counter increase pulse PCINC, to the program unit 17 (FIG. 1).

The satisfaction of the comparison condition ($A=B$) of the comparator 66 means that an envelope signal ENV which is equal in level to the minimum envelope level has been applied to the input terminal (A) of the comparator 66. Accordingly, in this case, in the time slot for this minimum envelope level, the new claim load signal NCLD is produced, and the old assignment in the time slot is truncated to carry out a new assignment. In addition, the memory of the minimum level (the maximum value) in the latch circuit 65 is cleared with the aid of the signal CLEAR.

The satisfaction of the comparison condition ($A>B$) of the comparator 66 means that an envelope signal which is lower in level than the minimum envelope level stored in the latch circuit 65 is applied to the input (A) of the comparator 66. In this case, similarly as in the above-described case, the new claim load signal NCLD and the signal CLEAR are produced.

The count value of the program counter 19 (FIG. 1) is increased by one (1) by the program counter increase pulse PCINC, as a result of which the program is advanced to the next step, whereby the claim signal CLM is eliminated. Thus, the new claim load signal NCLD is produced only once in a time slot for assignment.

In the case where partials are assigned to all of the 256 partial generating time slots and keys concerning these partials are being depressed, the comparison condition ($A=B$) of the comparator 66 is not satisfied at all for one cycle period of all the time slots (i.e., the time of 256 clock pulses ($\phi_0$), due to the following reason: The comparator 66 is operable only when the signal $EM_2$ representative of key release is applied thereto, and no signal $EM_2$ is produced when all the keys of assignment tones are being depressed. Accordingly, in this case, the counting operation of the counter 73 is advanced with the condition of the AND circuit 71 not satisfied, and finally the condition of the AND circuit 75 is satisfied at the 256th time slot, as a result of which the output "1" of the AND circuit 75 is applied to the AND circuit 70. This means that no time slot is available at all. The output "1" of the AND circuit is supplied as an unavailable signal $\overline{AVA}$ to the CPU 22 (FIG. 1).

In response to the unavailable signal $\overline{AVA}$, the program is returned to its start point, and the key scanning is started again. Accordingly, the claim signal CLM is also eliminated. When the unavailable signal $\overline{AVA}$ is produced, all of the partial generating time slots have been used; that is, there are no available time slots, and therefore the new assignment of partials is not carried out.

DESCRIPTION OF THE TONE PARAMETER LOGIC 25

The tone parameter logic 25, as shown in FIG. 12, comprises a tone parameter memory 82, an address counter 60, and a tone counter 87. The tone selector 29 comprises; a tone selector 29U and an encoder 29UE for the upper keyboard; a tone selector 29L and an encoder 29LE for the lower keyboard; a tone selector 29P and tan encoder 29PE for the pedal keyboard; and a decoder 88. Each of the tone selectors 29U through 29P can select sixteen different tone colors, and a 4-bit data representative of a tone color selected is obtained from a corresponding one of the encoders 29UE through 29PE. The outputs of the encoders 29UE through 29PE, being connected commonly for every bit, are applied to the tone counter 87. The decoder 88 operates to decode the code part representative of the kind of keyboard of the key code KC which is supplied from the key logic unit 11 (FIG. 3), and the output of the decoder 88 is applied to the tone selector (29U, 29L or 29P) of the corresponding keyboard. Only one of the tone selectors 29U to 29P, to which the output "1" of the decoder 88 has been applied, becomes operable. The key code KC represents the key of a partial being assigned. Therefore only the tone selector (one of 29U through 29P) of the keyboard, to which one depressed key being processed belongs, becomes operable, and 4-bit data recognizing a tone color which has been selected by the tone selector of the keyboard is introduced to the tone counter 87.

Upon application of a load signal $LOD_7$ from the CPU 22 (FIG. 1) in accordance with the program, the tone counter 87 loads a tone color selection data applied thereto from the encoder 29UE, 29LE or 29PE. The output of the tone counter 28 is applied, as a block address specifying signal BADRS, to the tone parameter memory 82. In an ordinary case, the tone counter 87 merely stores tone color data selected by the tone selector 29. Only when a carry signal CARRY is applied to the tone counter 87, the count value of the latter 87 is increased; however, such a count value increment is not caused in an ordinary using manner. The case of increasing the count value of the tone counter 87 by the carry signal CARRY will be described later.

Parameters required for realizing tone colors have been stored in the tone parameter memory 82 separately according to the tone colors. Parameter data, or 2048 words (8 bits per word) are stored in the tone parameter memory 82; that is, the parameter data are stored in 2048 addresses in the memory 82. The addresses of the tone parameter 82 is divided into 16 blocks in correspondence to 16 different tone colors; that is, 128 addresses are provided for each tone color.

The address specifying signal of the tone parameter memory 82 is eleven (11) bits in total, and four more significant bits out of the eleven bits is the block address signal BADRS supplied from the tone counter 87, and the remaining 7 bits is the address signal ADRS supplied by the address counter 60. By the combination of the block address signal BARDS and the address signal ADRS, the tone parameter data stored in 128 addresses of one tone color block are read out. The tone parameter memory 82 becomes ready for being read out when an enable signal $ENL_9$ is applied thereto.

The address counter 60 is a 7-bit binary counter which receives a clear signal $CLR_1$, a load signal $LOD_8$, an increase pulse $INC_2$ and a decrease pulse $DEC_1$ from the CPU 22 (FIG. 1) in accordance with the program. When the increase pulses $INC_2$ are applied to increase the count value of the address counter 60, the count output of the address counter 60 is used as the address signal ADRS of the tone parameter memory 82. The output ADRS of the address counter 60 is used also for the reading operations in the RAM's 61 and 62 (FIG. 4). That is, the count value PNCLC of the PNCL counter 58 (FIG. 4) is applied through the data bus 27 to the data input terminal of the address counter 60, and it is inputted into the counter 60 with the timing of generation of the load signal $LOD_8$. The count value PNCLC of the counter 60 is decreased with the application of the decrease pulse $DEC_1$, and the resultant count value ADRS is applied through the data bus 27 to the input terminal (B) of the selector 59 (FIG. 4). As a result, the read addresses of the RAM's 61 and 62 are specified by the signal ADRS. The use of the address counter 60 in this decrease mode is to detect, at the time of production of the new claim data NCL, the address in the RAM 61 in which the key code KC same as the data NCL is stored, as will become more apparent later.

*TONE PARAMETER MEMORY 82

FIGS. 13(*a*) through 13(*c*) show the address arrangement of the tone parameter memory 82. As shown in FIG. 13(*a*) 2048 addresses from address 0 to address 2047 are divided into 16 blocks; a first tone color block through a sixteenth tone color block. Only one block (the 9th tone color block) is shown; however, the remaining blocks are equal in fundamental arrangement to that shown. (It goes without saying that the contents of stored data therein are different from one another). As was described before, the tone color block is selected by the tone selector 29. The 9th tone color block includes 128 addresses from address 1024 to address 1151.

For convenience in understanding, it is advisable to divide the 128 addresses in one block into 16 memory areas, each consisting of 8 addresses. The first eight addresses, i.e., the addresses 1024 to 1031 in the 9th tone color block, are referred to as "a control parameter memory area". Stored in this control parameter memory area are parameter data common with all the partials. The remaining fifteen memory area are referred to as "partial data memory areas #1 through #15" as shown in FIG. 13(*a*). Data concerning partials forming a tone are individually or separately stored in the partial data memory areas #1 through #15. In this case, the number of memory areas is fifteen, and therefore fifteen different partials in total can be used for forming one tone. However, it should be noted that this number can be increased as described later. The partial data memory areas #1 through #15 correspond to partials whose degrees become higher in the order of the increasing address number. For instance, the order (n) of a partial corresponding to the area #1 is lower than that of any one of partials corresponding to the areas #2 through #15. This is to facilitate the process in case of "harmonic limiting" by first read and processes data concerning a partial having the lowest degree. In other words, if it is determined that during the process of a partial, the partial should be subjected to "harmonic limiting", then partials whose orders are higher than that of the aforementioned partial should be also subjected to "harmonic limiting". According, it is unnecessary to perform an additional process for them.

The memory arrangements of eight addresses in the partial data memory areas #1 through #15 are the same, and therefore only the first area #1 is shown in FIG. 13(*c*) as a typical one.

As shown in FIG. 13(*b*), the number (H) of all partials forming a tone color is stored in the first address 1024 of the control parameter memory area. In this example, as the number of partial data memory areas (#1 through #15) is fifteen, fifteen (H=15) partials can be used to form one tone color. The total partial number (H) is optional according to tone colors. For instance, when one tone color is synthesized by using five (5) partials, then (H=5) is stored therein.

A damp rate data DR, an inharmonic degree data INHM and an envelope mode data EM are stored, in parallel, in the second address 1025 of the control parameter memory area. An 8-bit data can be stored in one address, and therefore the 2-bit data DR, the 3-bit data EM and the 3-bit data INHM can be stored, in parallel, in one address. In this example, the remaining six addresses 1026 through 1031 of the control parameter memory area are empty. However, suitable parameters may be stored in these empty addresses, as required.

The inharmonic degree data INHM is used in making the spectrum distribution of a musical tone inharmonic, and it has a value according to the degree of inharmonicity.

The envelope mode data EM is to specify an envelope mode. More specifically, it specifies one of the normal mode, percussive mode and staccato mode which are indicated in FIGS. 14(*a*) through 14(*c*), respectively. The envelope in the normal mode shown in FIG. 14(*a*) is specified when the envelope mode data EM is "0 0 0"; the envelope in the percussive mode shown in FIG. 14(*b*), when "010"; and the envelope in the staccato mode shown in FIG. 14(*c*), when "001".

The normal mode envelope rises to the peak level (LP) during the attack time (TA) after the key depression, and then falls into the first decay level (LD·LP) during the first decay time (TD1), the first decay level being maintained until the key is released. Upon key release, the normal mode envelope is decayed from the first decay level (LD·LP) to the last level (or zero level) for the second decay time TD2.

The percussive mode envelope reaches the first decay level (LD·LP) at the end of the first decay time (TD1), and falls gradually from the first decay level to the last level during the second decay time (TD2) without maintaining the first decay level. However, if the key is released during the damping, the percussive mode envelope is decayed at a factor specified by the damping factor data DR.

The staccato mode envelope rises to the peak level (LP) upon key depression, and maintains this peak level thereafter; however, the staccato mode envelope falls to the last level (zero level) upon key release.

In the first address (1032) of a partial data memory area (#1), a value representative of the order (n) of a partial stored in the area is stored, as shown in FIG. 13(*c*). As was described before, the order (n) includes not only an integer part but also a fractional part. Therefore, an overtone (partial) of non-integer multiple, n=1.1 or 1.2 for instance, can be formed. Stored in the second through eight addresses are various parameter data concerning the envelopes of partials having the corresponding order (n). A 4-bit touch sensitivity data LPTSENS for scaling the peak level (LP) of an envelope in response to key touch, and a 4-bit note scale data LPNS for scaling the peak level (LP) of an envelope according to the pitch of a partial are stored, in parallel, in the second address (1033). Data LP for setting the peak level of a partial is stored in the third address (1034). A 4-bit touch sensitivity data TDTSENS for scaling the first decay time (TD1) and the second decay time (TD2) according to key touch, and a 4-bit note scale data TMNS for scaling envelope time factors (TA, TD1 and TD2) according to the pitch of a partial are stored in the fourth address (1035).

A data TD1 for setting the first decay time (TD1) of the envelope of a relevant partial is stored in the fifth address (1036). A data TD2 for setting the second decay time (TD2) of the envelope is stored in the sixth address (1037). A 5-bit data LD for setting the first decay level (LD·LP) of an envelope, and a 3-bit touch sensitivity data TATSENS for scaling the attack time (TA) according to key touch are stored in the seventh address (1038). A data TA for setting the attack time (TA) of the envelope of a relevant partial is stored in the eighth address (1039).

The touch sensitivity data LPTSENS, TDTSENS and TATSENS read output of the tone parameter memory 82 are latched by the touch sensitivity latch 79 (FIG. 5), and the note scale data LPNS and TMNS are latched by the note scale latch 81 (FIG. 5). The peak level data LP, attack time data TA and decay time data TD1 and TD2 read out of the tone parameter memory 82 are temporarily stored in a register in the ALU 24 (FIG. 1). In the ALU 24, these data LP, TA, TD1 and TD2 are scaled by the touch factor TCF and note scale factor NSF read out of the touch factor and note scale factor memory 77 as described above according to the above-described touch sensitivity data and note scale data. If the touch factor and the note scale factor read out of the memory 77 in a correlation with the data LPTSENS through TMNS are represented by TCF (LPTSENS) through NSF(TMNS), and the envelope data subjected to scaling in the ALU 24 are represented by LP* through TD2*, then the following equations can be established:

$$LP^* = LP \cdot TCF(LPTSENS) \cdot NSF(LPNS) \quad (7)$$

$$TA^* = TA \cdot TCF(TATSENS) \cdot NSF(TMNS) \quad (8)$$

$$TD1^* = TD1 \cdot TCF(TDTSENS) \cdot NSF(TMNS) \quad (9)$$

-continued $$TD2^* = TD2 \cdot TCF(TDTSENS) \cdot NSF(TMNS) \quad (10)$$

These equations are of multiplication; however, if logarithmic calculations are employed, then the calculations in the ALU 24 can be achieved by additions.

OUTPUT LATCH UNIT 26

The data DR, EM, INHM, n and LD read out of the tone parameter memory 82 are latched by the output latch unit 26 (FIG. 1). Furthermore, the data LP* through TD2* obtained by the above calculations are also latched by the output latch unit 26. The key code KC supplied to the data bus 27 from the key logic unit 11 is also latched by the output latch unit 26. The timing of latching these data is controlled by the program.

As was described before, when all of the necessary data have been latched by the output latch unit 26, the claim signal CLD is produced in accordance with the program, and is applied to the claim logic 64 in FIG. 8. According to the process in the claim logic 64, the new claim load signal NCLD is provided as was described before. The new claim load signal NCLD is applied to the tone generator interface unit 13.

DESCRIPTION OF THE TONE GENERATOR INTERFACE UNIT 13

Figure 15:
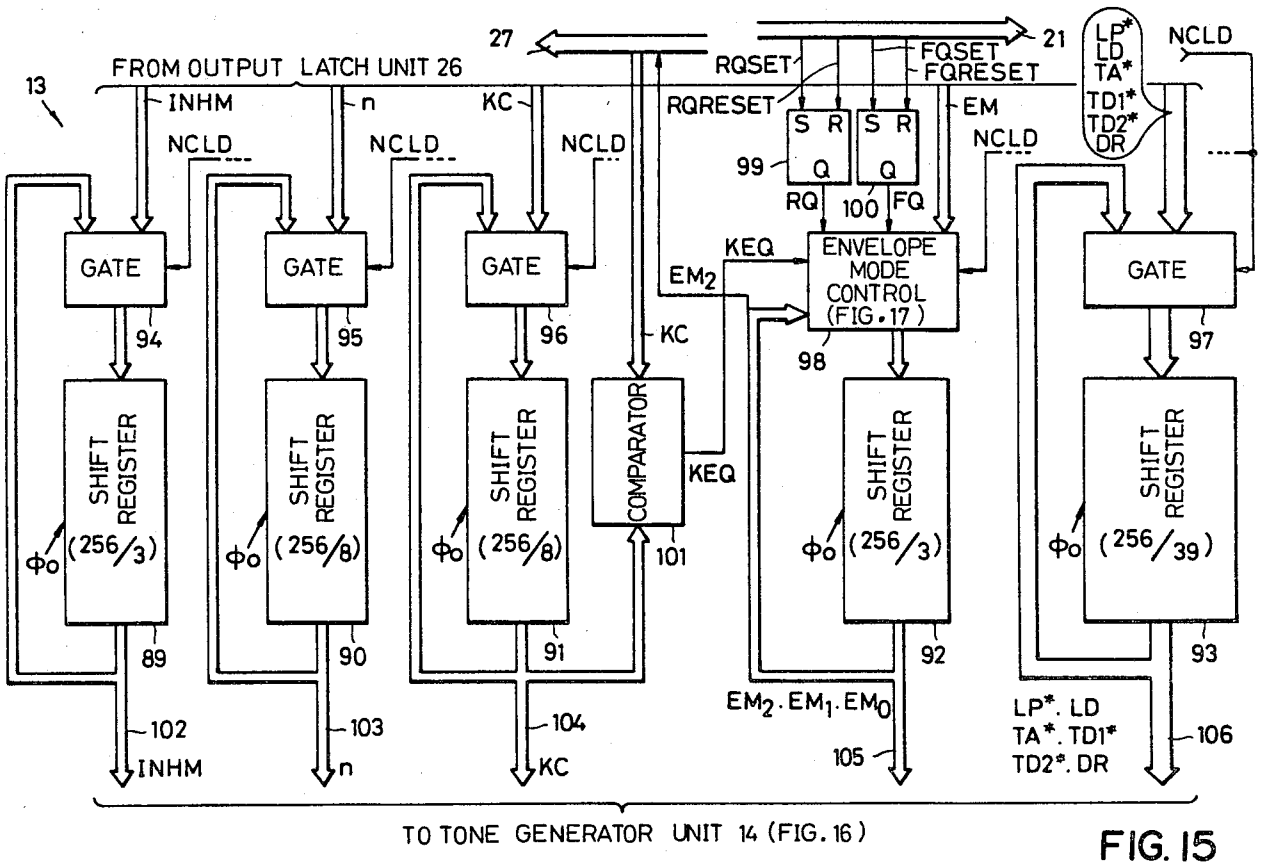
FIG. 15 is a block diagram showing one example of a tone generator interface unit in FIG. 1.

The tone generator interface unit 13, as shown in FIG. 15, comprises shift registers 89 through 93. These registers operate to store, in time division manner, the data INHM, n, KC, EM, LP*, LD, TA*, TD1*, TD2* and DR required for generating partials assigned to respective time slots, in correspondence to the assignment time slots, and are series-shift-type registers each having 256-stage memory positions corresponding to the total number (256) of partial generating time slots. The clock pulse $\phi_0$ from the clock pulse generator 67 (FIG. 9) is applied to these registers. Select gates 94, 95, 96 and 97 are connected to the input sides of the shift registers 89, 90, 91 and 93, respectively.

The select gates 94, 95, 96 and 97 select the data INHM, n, KC, LP*, LD, TA*, TD1*, TD2* and DR supplied thereto from the output latch unit 26 (FIG. 1) when the new claim load signal NCLD is applied thereto from the claim logic 64 (FIGS. 8 and 10), and input them into the first stages of the shift registers 89, 90, 91 and 93. In a time slot where no new claim load signal NCLD is applied, the select gates 94 through 97 select data outputted from the last stages (the 256th stages) of the shift registers 89, 90, 91 and 93, and feed back them to the first stages thereof. Thus, in a time slot where the new claim load signal NCLD is provided, the memory data in the shift registers 89 through 93 are rewritten, and the assignment of a new partial is completed.

The envelope mode data EM from the output latch unit 26 (FIG. 1) is not stored as it is in the envelope mode storing shift register 92, that is, the envelope mode data EM, after being suitably corrected in an envelope mode control circuit 89, is stored in the shift register 92.

In the envelope mode control circuit 98, the envelope mode data EM from the output latch unit 26 is suitably corrected according to:

(1) key depression or key release, and (2) whether or not "key on again" is effected. The term "key on again" is intended to mean the case where a key whose partials have been assigned to partial generating time slots is released and is then depressed again before such assignments vanish. For the decision of the above-described conditions (1) and (2), there are provided set-reset type flip-flops 99 and 100. The flip-flops 99 and 100 are set or reset in response to a set signal or reset signal supplied thereto through the control bus 21 in accordance with the program.

The releasing flip-flop 99 is set when a key is released, and its set output RQ is applied to the envelope mode control circuit 98. In the envelope mode control circuit 98, data respresentative of key release is added to the envelope mode data EM according to the release set signal RQ and a key coincidence signal KEQ supplied by a comparator 101.

In the comparator 101, the output of the shift register 91 adapted to store a key code (or a key name) concerning partials assigned to respective time slots is compared with a key code supplied through the data bus 27 from the key logic unit 11 (FIGS. 1 and 3), and when both coincide with each other, the key coincidence signal KEQ is outputted. The key code XC from the key logic unit 11 is not changed in the case where the key scanning is suspended as described before but the output key code KC of the shift register 91 is changed in time division manner for every time slot. Accordingly, the key coincidence signal KEQ is produced in the time slot where the same key code KB as the key code KC supplied from the key logic unit 11 is stored. In general, there are a plurality of partials in correspondence to a key code. Therefore, in one cycle (256 time slots) of partial generating time slots, the key coincidence signal KEQ is produced in a plurality of time slots to which these plural partials have been assigned.

The absolute ending flip-flop 100 is used for the decision of the above-described "key on again", and it is set when a new key is depressed, i.e., the new claim data NCL is provided. The set output FQ is applied to the envelope mode control circuit 98. In this envelope mode control circuit 98, the "key on again" is decided according to the absolute ending set signal FQ and the key coincidence signal KEQ, and in case of "key on again" the envelope of a partial assigned to the time slot where the key coincidence signal KEQ is produced is absolutely (forcibly) terminated. More specifically, the envelope mode data EM is converted into a value indicating "absolute ending mode". When the AND condition of the absolute ending set signal FQ and the key conicidence signal KEQ is satisfied then it is "key on again", because the same key as a newly depressed key has been assigned already. In this case, an old partial concerning the same key is assigned to the time slot where the key coincidence signal has been produced. Therefore, the envelope mode of this old partial is changed to the "absolute ending mode", to forcibly and quickly terminate the envelope. Of course, according to the new key depression, the new assignment of partials of the same key is carried out. As is apparent from the above description, in the case of "key on again", the double generation of the partials of the same key will never be caused.

The envelope mode control circuit 98 selects the envelope mode data EM supplied thereto from the output latch unit 26 when the new claim signal NCLD is produced, and inputs it into the shift register 92.

The envelope mode data (the bits being indicated by $EM_0$, $EM_1$, $EM_2$) outputted by the 256th stage is returned to the envelope mode control circuit 98. The above-described complement and change are effected for the data $EM_0$, $EM_1$, $EM_2$ thus returned. The envelope mode control circuit 98 is illustrated in FIG. 17 in more detail.

The inharmonic degree data INHM, order data n and key code KC concerning partials assigned to respective time slots are outputted successively in correspondence to the time slots, and are supplied to a frequency data generating circuit 107 (FIG. 16) in the tone generator unit 14 through lines 102, 103 and 104 having bit numbers corresponding to the respective data. The envelope mode data $EM_0$, $EM_1$, $EM_2$ outputted by the shift register 92 for every time slot is supplied to an envelope calculator 108 (FIG. 16) in the tone generator unit 14 through a 3-bit line 105. The envelope portion controlling data LP*, LD, TA*, TD1*, TD2* and DR outputted by the shift register 93 for every time slot are supplied to the tone generator unit 14 (FIG. 16) through a multi-bit parallel line 106. Among these data, the data LD, TA*, TD1*, TD2 and DR are applied to the envelope calculator 108, and the peak level data LP* is applied to a peak level read only memory (peak level ROM) 109.

*ENVELOPE MODE CONTROL CIRCUIT 98

In FIG. 17, the bits of the envelope mode data EM supplied from the output latch unit 26 (FIG. 1) are applied to AND circuits 110, 111 and 112, respectively. The relations between the values of the envelope mode data EM and the envelope modes are as indicated in FIGS. 14(*a*) through 14(*c*). The least significant bit $EM_0OL$, the next bit $EM_1OL$, and the most significant bit $EM_2OL$ of the data EM are applied to the AND circuits 110, 111 and 112, respectively. The new claim load signal NCLD is applied to the other input terminals of the AND circuits 110, 111 and 112. Accordingly, when the new claim load signal NCLD is produced, the AND circuits 110, 111 and 112 are enabled, as a result of which the envelope mode data EM from the output latch unit 26 is selected by the AND circuits 110 through 112 and is applied to the shift register 92 (FIG. 15) through OR circuits 113, 114 and 115.

Figure 21:
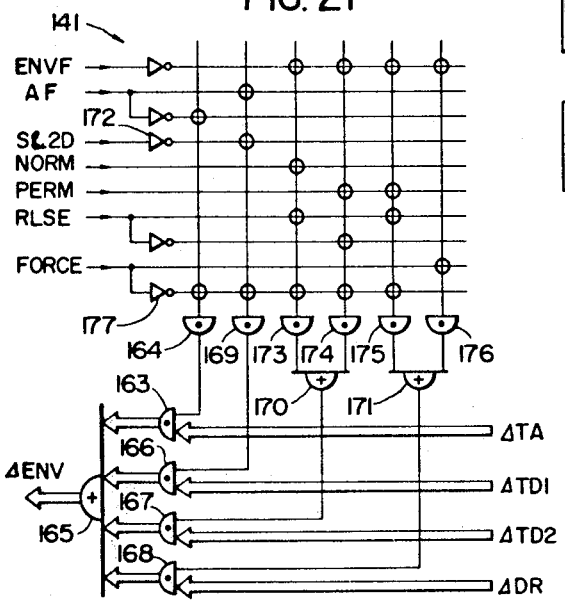
FIG. 21 is a circuit diagram showing in detail a data selector shown in FIG. 20.
Figure 20:
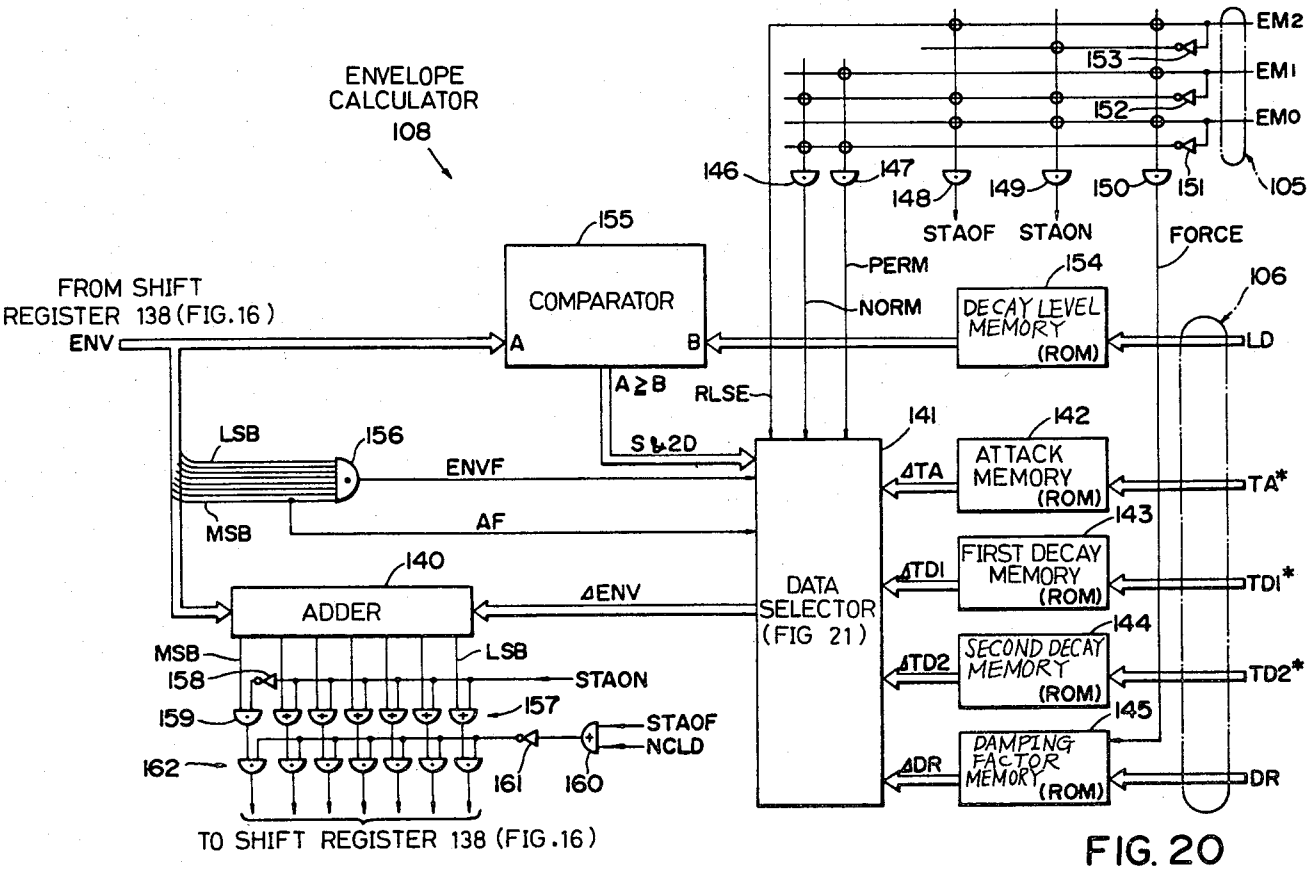
FIG. 20 is a block diagram showing the detail of an envelope calculatory shown in FIG. 16.

The ways of illustrating logical circuit elements employed in FIGS. 17, 20 and 21 will be briefly described. One input line is extended from the input side of a logical circuit element such as an AND circuit or an OR circuit, and signal lines are drawn in such a manner as to cross the input line. Then, the intersection of the input line and a signal line through which a signal is applied to the logical circuit element is encircled. For instance, only the new claim signal NCLD and signal $EM_0OL$ are applied to the AND circuit 110 in FIG. 17.

The envelope mode data EM ($EM_0OL$, $EM_1OL$, $EM_2OL$) inputted into the shift register 92 (FIG. 15) in the time slot where the new claim load signal NCLD is produced is outputted from the last stage (the 256th stage) of the shift register 92 in the next same channel time slot (i.e., after 256 periods of the clock pulse $\phi_0$), and is returned to the envelope mode control circuit 98. The envelope mode data thus returned is indicated by reference characters $EM_0$, $EM_1$ and $EM_2$. These data $EM_0$, $EM_1$ and $EM_2$ are applied through OR circuits 116, 117 and 118 to AND circuits 119, 120 and 121, respectively. A signal $\overline{NCLD}$ obtained by applying the new claim load signal NCLD to an inverter 122 is applied to the other input terminals of the AND circuits 119, 120 and 121. Since the new claim load signal NCLD is produced only once, the signal $\overline{NCLD}$ is at "0" in the next same time slot, and its inverted signal NCLD is at "1". Accordingly, "the envelope mode data $EM_0$, $EM_1$ and $EM_2$ returned" are selected by the AND circuits 119, 120 and 121, and there inputted through OR circuits 113, 114 and 115 into the first stage of the shift register 92. Thus, the envelope mode data $EM_0$, $EM_1$ and $EM_2$ are maintained stored in the shift register 92.

An AND circuit 123 is provided to add data representative of key release to the envelope mode data. The release set signal RQ (which is set to "0" upon detection of key release) from the above-described release flip-flop 99 (FIG. 15) and the key coincidence signal KEQ from the comparator (FIG. 15) are applied to the AND circuit 123. The output of the AND circuit 123 is applied through the OR circuit 118 to the AND circuit 121, and is applied through the OR circuit 115 to a bit corresponding to the data $EM_2$ in the shift register 92. Thus, upon key release, the bit $EM_2$ of the envelope mode data is set to "1".

An AND circuit 124 is provided to determine the above-described "key on again" thereby to convert the envelope mode into the "absolute ending mode". The absolute ending set signal FQ from the above-described flip-flop 100 (FIG. 15) and the key coincidence signal KEQ are applied to the AND circuit 124. The output of the AND circuit 124 is applied to the OR circuits 116 and 117. In order to obtain the "absolute ending mode", the output of the AND circuit 124 is set to "1", and the two less significant bits $EM_1$ and $EM_2$ of the envelope mode data are forcibly changed to "1 1". Since the key whose envelope mode is changed to the "absolute ending mode" has been released by all means, the data $EM_2$ representative of key release is "1". Therefore, in the case of "absolute ending mode", the envelope mode data $EM_2$, $EM_1$, $EM_0$ is "1 1 1". This is due to the following reason: Since the term "key on again" means that a key is released once and then depressed again, a key assigned before has been released necessarily.

If summarized, the relations between the values of the envelope mode data $EM_2$, $EM_1$ and $EM_0$ outputted by the shift register 92 (FIG. 15) and the envelope modes are as indicated in Table 1 below:

TABLE 1

| Envelope Mode | $EM_2$ | $EM_1$ | $EM_0$ |
|---|---|---|---|
| Normal | — | 0 | 0 |
| Percussive | — | 1 | 0 |
| Staccato | — | 0 | 1 |
| Absolute ending | (1) | 1 | 1 |
| Key depression | 0 | — | — |
| Key release | 1 | — | — |

Variations of the data $EM_2$, $EM_1$ and $EM_0$ are illustrated in FIG. 18. That is, the data $EM_2$ is "0" during the key depression, but it is changed to "1" upon release of the key. In the absolute ending mode, the data $EM_1$, $EM_2$ is set to "1 1".

The data $EM_2$ representative of key release is applied to the comparator 66 in FIG. 8 so that it is utilized to enable the comparator 66 only in the time slot to which a partial concerning a key released is assigned.

DESCRIPTION OF THE TONE GENERATOR UNIT 14

The tone generator unit 14, as shown in FIG. 16, comprises: a circuit for generating the waveform signals of partials assigned to the partial generating time slots in accordance with the pitches of the partials; and a circuit for generating the amplitude envelope signals of the partials assigned to the time slots. The former circuit spread from frequency data generating circuit 107 to an envelope scaler 125, and the latter circuit spreads from an envelope calculator 108 to an envelope scaler 125.

Figure 19:
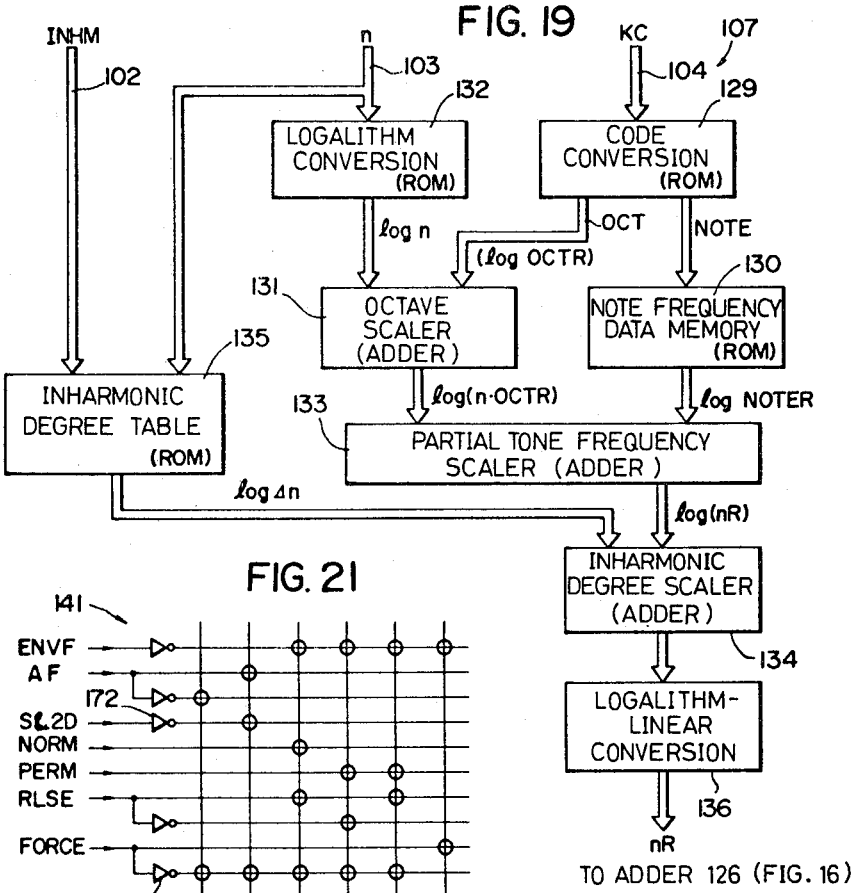
FIG. 19 is a block diagram showing in detail a frequency data generating circuit shown in FIG. 16.

The frequency data generating circuit 107 generates a numerical value nR (representing a phase in one sample interval) corresponding to the frequency of a partial to be generated, according to the inharmonic order data INHM, order data n, and key code KC which are applied through lines 102, 103 and 104 from the shift registers 89, 90 and 91 in the interface unit 13, respectively. The circuit 107 is shown in FIG. 19 in more detail. The value nR (hereinafter referred to as "frequency data" when applicable) is applied to an accumulator consisting of a 256-stage shift register 127 and an adder 126, and is accumulated for every sample time of a musical tone waveform. In the shift register 127, shifting is effected with the aid of the clock pulse $\phi_0$. The time slot of the previous addition result which is returned to one input terminal of the adder 126 from the last stage (the 256th stage) of the shift register 127 coincides with the time slot of the frequency data nR supplied to the other input terminal of the adder 126 from the frequency data generating circuit 107. Therefore, the accumulation can be effected in time division manner for every time slot. The "one sample time of a musical tone waveform" is the repetition interval of the same time slot, i.e., 256 periods of the clock pulse $\phi_0$.

If the number of time of addition is represented by q (q=1, 2, 3 . . . ), then an addition result outputted by the shift register 127 can be represented by nqR. This value nqR is cleared to zero (0) whenever it reaches the modulo number of the accumulator consisting of the adder 126 and the shift register 127, and then increase. This repetitive period is determined from the value of the frequency data nR.

The output value nqR of the shift register 127 is applied, as an address input, to a sine wave table 128. The sine wave table 128 reads out a sinusoidal waveform sample point amplitude value (sin nqR) having a phase specified by the value nqR. In this example, a sinusoidal waveform sample point amplitude value in logarithmic expression log (sin nqR) is read out of the sine wave table 128. This method is advantageous because the envelope scaler 125 can be made up of a simple adder instead of a multiplier. The output log (sin nqR) of the sine wave table 128 is applied to the envelope scaler 125. In this connection, it is unnecessary for the sine wave table 128 to store the entire sinusoidal waveform of one period; that is, all that is required for the sine wave table 128 is to store a part of the waveform corresponding to a $\frac{1}{4}$ period. If the reading control is effected in such a manner that the reading direction is opposed for every $\frac{1}{4}$ period and the positive and negative signs are switched for every $\frac{1}{4}$ period, then the waveform of one period can be generated by utilizing the waveform of $\frac{1}{4}$ period stored. The amplitude value log (sin nqR) read out of the sine wave table 128 is not a simple logarithmic expression; but is in the attenuation amount, i.e., a negative logarithmic expression (−log). There is no particular reason for this; however, it is to satisfy the requirement in design, because an attenuation amount expression, or a negative logarithmic expression, is employed to express the amount of attenuation in digital form in the entire system in this example.

*DETAILED DESCRIPTION OF THE FREQUENCY DATA GENERATING CIRCUIT 107

Referring to FIG. 19, a key code KC supplied through a line 104 is applied to a code converter 129, where it is divided into a 4-bit note code NOTE representative of a note (in one octave) and a 3-bit octave code OCT representative of an octave to which the note belongs. The code converter 129 comprises a read only memory (ROM).

The note code NOTER 6 applied to the address specifying input terminal of a note frequency data memory 130, in which value NOTER proportional to twelve notes C through B in one particular octave (the lowest octave in this example) are stored in logarithmic form (log NOTER), and a value log NOTER corresponding to an input note code NOTE is read out.

The octave code OCT is applied to an octave scaler (adder) 131 without being converted into a logarithmic expression. The octave codes OCT are encoded into numerical values 0, 1, 2, 3 . . . in decimal notation beginning with the lowest octave (0 octave) as indicated in Table 2.

TABLE 2

| Octave Number | Octave code (decimal) (OCT) | RFrequency ratio (OCTR) | Logarithmic expression (log OCTR) |
|---|---|---|---|
| 0 (lowest) | 000 (0) | 1 | $\log_2 1 = 0$ |
| 1 | 001 (1) | 2 | $\log_2 2 = 1$ |
| 2 | 010 (2) | 4 | $\log_2 4 = 2$ |
| 3 | 011 (3) | 8 | $\log_2 8 = 3$ |
| 4 | 100 (4) | 16 | $\log_2 16 = 4$ |

The frequency ratios of the octave are 1, 2, 4, 8, 16 . . . The logarithmic expressions with 2-base of these frequency ratios are 0, 1, 2, 3, 4, . . . which are equal to the aforementioned encoded values. Therefore, the octave codes OCT can be used as data expressing the frequency ratios in logarithmic form.

Degree data n supplied through the line 103 is applied to a logarithmic converter 132, where it is converted into a logarithmic expression log n, which is applied to an octave scaler 131. The octave scaler 131 operates to subject an octave frequency ratio OCTR to scaling with an order n. Two inputs to the octave scaler 131 are logarithmic expressions, and therefore an adder can be employed as the octave scaler 131.

The output log(n OCTR) of the octave scaler 131 is applied to a partial frequency scaler 133, to the other input terminal of which the logarithmic expression log NOTER of a tone frequency data is applied. The scaler 133 operates to obtain data nR proportional to the frequency of a partial. Since the two inputs to the scaler 133 are logarithmic expressions, the scaling can be performed by an adder. The output of the partial frequency scaler 133 is log(n·OCTR·NOTER), which will be expressed as "log(nR)". If the note frequency data NOTER is scaled with the octave frequency ratio OCTR, then the result is a value proportional to the fundamental frequency. This will be indicated by R(=OCTR·NOTER). If the fundamental frequency R is scaled with the order n, then a value nR proportional to the frequency of a partial can be obtained. In the octave scaler 131 and the partial frequency scaler 133, the above-described scaling is carried out in logarithmic form, and a logarithmic expression log nR having a value proportional to the frequency of a partial is obtained. This value log nR is applied to an inharmonic degree scaler 134.

The inharmonic degree data supplied through the line 102 and the order data n supplied through the line 103 are applied to an inharmonic degree table 135. The inharmonic degree table 135 is made up of a read only memory, in which an inharmonic degree factor Δn corresponding to the inharmonic degree data INHM is read out in logarithmic form (log Δn) for every order n. This inharmonic degree factor Δn is to set up a deviation from a regular partial frequency (which is established by nR, and is not always an integer multiple of the fundamental frequency as described before). A plurality of sets of inharmonic degree factors Δn are stored in the inharmonic degree table 135. One set of inharmonic degree factors Δn includes 256 ($=2^8$) in harmonic degree factors Δn corresponding to the number which the order n can assume. The sets of inharmonic degree factors correspond to the values of the 3-bit inharmonic degree data INHM. The total number of sets is eight ($8=2^3$). Accordingly, one set is selected for the value of an inharmonic degree data INHM, and among the 256 inharmonic degree factors included in the selected set, one corresponding to the order data n is read out of the table 135.

In the case where the inharmonic relation is not required (the data INHM is 0), the inharmonic degree factor Δn is "1" at all times i.e., the logarithmic expression log Δn is "0" at all times. In general, with respect to the partial having the fundamental wave component (n=1) the frequency is not shifted, and therefore log Δn is "0" with n=1. A manner of setting the concrete memory contents of the table 135, or the inharmonic spectrum distribution, will not be described in detail, because it is a matter of design. The inharmonic degree factor log Δn read out of the inharmonic degree table 135 is applied to the inharmonic degree scaler 134.

The inharmonic degree scaler 134 operates to scale the regular partial frequency ratio nR with the inharmonic degree factor Δn thereby to change its value nR. Both inputs to the scaler 134 are logarithmic expressions, and therefore an adder can be used as the scaler 134. The output of the inharmonic degree scaler 134 is applied to a logarithmic-linear converter 136, where it is converted into a linear expression. The output of the logarithmic-linear converter 136 is applied, as the partial frequency data nR to the adder 126 in FIG. 16. As was described before, when the spectrum distribution is not placed in the inharmonic relation, the output (log nR) of the partial frequency scaler 133 is provided, as it is, through the logarithmic-linear converter 134 without being changed. In this case, the output of the converter 136 is "nq". Being changed by the inharmonic degree factor Δn, the output of the logarithmic-linear converter 134 becomes "Δn·nq". However, for convenience in description, all of the partial frequency data supplied to the adder 126 (FIG. 16) are from the frequency data generating circuit 107.

*GENERATION OF THE ENVELOPE

The envelope waveforms as shown in FIG. 14 are obtained by the utilization of the envelope calculator 108 and the attack waveform memory 137 (FIG. 16).

In FIG. 16, the 256-stage shift register 138 operates to store the calculation result of the envelope calculator 108 for every time slot. The output ENV (that is, the previous calculation result) of the last stage (the 256th stage) of the shift register 138 is returned to the envelope calculator 108, so that it is used for envelope calculation. The output of the shift register 138, i.e., the calculation result (which is referred to as an envelope data ENV) of the envelope calculator 108, is applied to the attack waveform memory 137, so that it is used as an address signal to read the waveform of an attack portion. For the envelope waveform portions other than the attack portion, the envelope data is used as it is.

The envelope data ENV has seven bits. Out of the seven bits, the six less significant bits are applied to the attack waveform memory 137 and the A input terminal of the selection gate 139. The read output of the attack waveform memory 137 is applied to the B input terminal of the selection gate 139. The most significant bit (MSB) of the envelope data is applied to the control input terminal of the selection gate 139. When this MSB is "0", the selection gate 139 selects the read waveform of the attack waveform memory 137 applied to the B input terminal of the selection gate 139 and outputs it. When the MSB is "1", the selection gate 139 selects the six less significant bits data of the envelope data ENV and outputs it.

FIG. 20 illustrates the envelope calculator 108 in detail. The previous (256 time slots before) calculation result returned from the shift register 138 (FIG. 16), i.e., the envelope data ENV, and an envelope variation data ΔENV supplied from a data selector 141 are subjected to addition in an adder 140, and the addition result is applied to the shift register 138 (FIG. 16). The data TA*, TD1*, TD2* and DR concerning the time elements of the portions of an envelope, which are supplied in time division manner in response to the time slots from the interface unit 13 (FIG. 15) through the line 106 are applied to an attack memory 142, a first decay memory 143, a second decay memory 144 and a damping factor memory 145, respectively. The memories 142 through 145 are read only memories in which values corresponding to the inclinations of the rises or falls of envelopes are stored in advance, and the memories 142 through 145 read out inclination values (variation data ΔTA, ΔTD1, ΔTD2 and ΔDR) corresponding to the values of the input data TA*, TD1*, TD2* and DR, respectively. These variation data ΔTA, ΔTD1, ΔTD2 and ΔDR are applied to a data selector 141. In the computation of the envelope of the attack portion, the variation data ΔTA is selected by the data selector 141, and it is applied, as an envelope variation data ΔENV, to the adder 140. In the computation of the envelope of the first decay portion, the first decay variation data ΔTD1 is selected; in the computation of the envelope of the second decay portion, the second decay variation data ΔTD2 is selected; and in the case where it is required to quickly damp the envelope, the output ΔDR of the damping factor memory 145 is selected. The data thus selected is applied, as an envelope variation data ΔENV, to the adder 140.

In the data selector 141, the timing of switching the selection of the data ΔTA, ΔTD1, ΔTD2 and DR is controlled in accordance with an envelope mode and the current envelope data ENV.

The envelope mode data $EM_0$, $EM_1$ and $EM_2$ supplied through the line 105 from the interface unit 13 (FIG. 15) in time division manner in response to the time slots are decoded by AND circuits 146 through 150 in accordance with the relations indicated in Table 1 above. Signals obtained by applying the data $EM_0$ and $EM_1$ respectively to inverters 151 and 152 are applied to the AND circuit 146. When the data $EM_0$, $EM_1$ is "0 0", then the output NORM is set to "1". In other words, in the case when the normal mode is selected, the normal mode signal NORM is outputted by the AND circuit 146. The AND circuit 147 is to decode the data of the percussive mode ($EM_0=0$, and $EM_1=1$). The inversion signal of the data $EM_0$ and the data $EM_1$ are applied to the AND circuit 147. In the case where the percussive mode is selected, the percussive mode signal PERM is provided.

The AND circuits 148 and 149 are to decode the data ($EM_0=1$, and $EM_1=0$) of the staccato mode. In addition to the data $EM_0$ and $EM_1$, the data $EM_2$ is applied to the AND circuit 148, and a signal obtained by applying the data $EM_2$ to an inverter 16153 is applied to the AND circuit 149. Accordingly, when the staccato mode is selected and a key is released, the output of the AND circuit 148 is set to "1" and a staccato off signal STAOF is obtained. When the staccato mode is selected and a key is depressed, the output of the AND circuit 149 is set to "1" and a staccato on signal STAON is obtained.

The AND circuit 150 is to decode the data ($EM_0=1$, $EM_1=1$, and $EM_2=1$) of the absolute ending mode. The data $EM_0$, $EM_1$ and $EM_2$ are applied to the AND circuit 150. Therefore, in the case of the "absolute ending mode", the output of the AND circuit 150 is set to "1", and an absolute ending mode signal FORCE is obtained.

The normal mode signal NORM, the percussive mode signal PERM and the absolute ending mode signal FORCE are supplied to the data selector 141. The data $EM_2$ is applied, as a release signal RLSE representative of key release, to the data selector 141.

The first decay level data LD supplied through the line 106 from the interface unit 13 (FIG. 15) is inputted to a decay level memory 154. This decay level memory 154 is a read only memory in which a number of envelope amplitude data in negative logarithmic expression (attenuation amount) are stored in advance, and in which an envelope amplitude data stored in an address position specified by the first decay level data LD inputted thereto is read out. The data thus read out of the decay level memory 154 is supplied to the B input terminal of a comparator 155, to the A input terminal of which the envelope data ENV returned from the above-described shift register 138 (FIG. 16) is applied.

The comparator 155 operates to detect the fact that the value of the envelope data ENV becomes less than a value specified by the first decay level data LD. When $A \geqq B$, the output 5&2D of the comparator 155 is set to "1". When the data ENV coincides with the value specified by the first decay level data LD, $A=B$ is established. When an amplitude level indicated by the data ENV becomes less than an amplitude level corresponding to the data LD, $A>B$ is established. In other words, as described before, the amplitude value is expressed by the amount of attenuation in this example, and therefore when the value of the data ENV is large, its amplitude level is small. For instance, when all the bits of the seven-bit envelope data ENV are "1", it represents the minimum level (0 level); and when all are "0", the maximum level. The output S&2D of the comparator 155 is supplied to the data selector 141.

All of the bits of the envelope data ENV are applied to a 7-input type AND circuit 156. When all of the bits of the data ENV are "1", then the output of the AND circuit 156 is set to "1". This means that the amplitude of the envelope waveform is at the 0 level (i.e., the tone production has been completed). The output "1" of the AND circuit 156 is applied, as an envelope finish signal ENVF, to the data selector 141. The most significant bit MSB of the envelope data ENV is applied, as an attack finish signal AF, to the data selector 141. As was described before, when the most significant bit of the envelope data ENV is "0", the output attack waveform of the attack waveform memory is selected by the selection gate 139 (FIG. 16), and the selection of the attack waveform is suspended when the most significant bit is changed to "1". Thus, the most significant bit "1" means the finish (completion) of the attack waveform, and it can therefore be used as the attack finish signal AF.

The data selector 141 is used in the normal mode or in the percussive mode, and it is not used in the staccato mode.

Staccato Mode

The staccato-on signal STAON supplied by the AND circuit 149 in FIG. 20 is applied to a group of six OR circuits 157 provided at the output side of the adder 140 and is further applied to an AND circuit 159 through an inverter 158. The six less significant bits outputted by the adder 140 are applied to the OR circuit group 157, and the most significant bit (MSB) is applied to the AND circuit 159. Accordingly, when a key is depressed in the staccato mode, the six less significant bits of the data which is introduced to the shift register 138 (FIG. 16) from the adder 140 in the corresponding time slots, namely, the six less significant bits of the envelope are forcibly set to "1", and the most significant bit is forcibly set to "0". Therefore, the envelope data outputted by the shift register 138 in the time slots is "0 1 1 1 1 1 1" at all times, and the attack waveform memory 137 (FIG. 16) reads out the maximum level amplitude data (corresponding to the peak level LP in FIG. 14(*c*)) corresponding to an address "1 1 1 1 1 1". The selection gate 139 (FIG. 16) selects the maximum level data outputted by the attack waveform memory 137 according to the selection control input "0" (MSB), and outputs it.

The staccato-off signal STAOF outputted by the AND circuit 148 in FIG. 20 is applied through an OR circuit 160 (FIG. 20) to an inverter 161, where it is inverted. As a result of which a signal "0" is applied to a group of AND circuits 162. The group of AND circuits 162 is provided in the next stage of the above-described OR circuit group 157 and AND circuit 159, and interrupts the path from the adder 140 to the shift register 138 (FIG. 16) with the aid of the signal "0" from the inverter 161, thereby to supply data "0 0 0 0 0 0 0" to the shift register 138. Accordingly, the envelope data ENV outputted by the shift register in the corresponding time slot is "0 0 0 0 0 0 0", and the attack waveform memory 137 reads out the amplitude value of the minimum level (0 level) corresponding to the address "0 0 0 0 0 0". The selection gate 139 selects the 0 level amplitude value supplied from the attack waveform memory 137 in response to the most significant bit "0".

In the above-described manner, in the case of the stacato mode, an envelope waveform as shown in FIG. 14(*c*) is obtained according to the depression and release of a key.

Normal Mode and Percussive Mode

Figure 22:
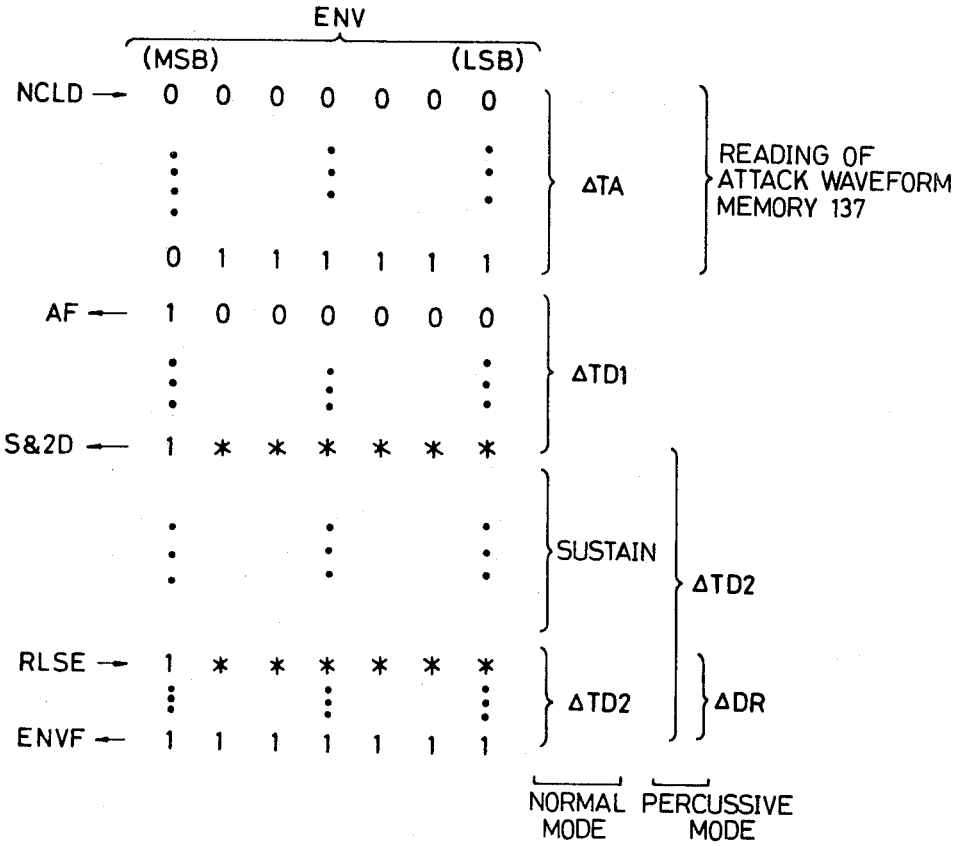
FIG. 22 is an explanatory diagram for outlining an envelope calculation for a normal mode or a percussive mode.

The data selector 141 which plays an important part in the normal mode and in the percussive mode is illustrated in detail in FIG. 21. FIG. 22 indicates the relations between the variations of the values of envelope data ENV and the generations of various data accompanying the variations, in the normal mode and in the percussive mode.

The new claim load signal NCLD supplied from the claim logic 64 (FIGS. 8 and 10) is applied to the OR circuit 160 (FIG. 20) to disable the AND circuit group 162. Accordingly, all the bits of the envelope data ENV are set to "0" at the start of assignment. Since the new claim load signal NCLD is produced only once, the AND circuit group 162 is maintained enabled thereafter. As the mode is not the staccato mode, both the staccato-on signal STAON and the staccato-off signal STAOF are "0", and the AND circuit group 162 and the AND circuit 159 are rendered conductive. Accordingly, the output of the adder 140 is applied to the shift register 138 (FIG. 16) as it is.

As indicated in FIG. 22, the value of the envelope data is increased gradually until all the bits thereof are changed to "1" from "0". This increment rate is determined from the variation data ΔTA, ΔTD1, ΔTD2 and ΔDR. At the start, the variation data ΔTA for attack is repeatedly added by the adder 140. By this repetitive addition of the data ΔTA, the value of the envelope data ENV is gradually increased. When the attack finish signal AF is produced, the data ΔTA is switched to the data ΔTD1 for first decay.

Figure 23:
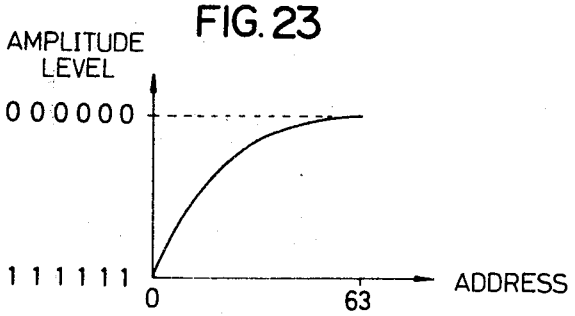
FIG. 23 is a graphical representation indicating one example of a waveform stored in an attack waveform memory in FIG. 16.

During the addition of the data ΔTA, the most significant bit of the envelope data ENV is "0", and the amplitude value data read out of the attack waveform memory 137 (FIG. 16) is selected by the selection gate 139. During this period, the 6-bit address for the memory 137 is increased from "000000" to "111111" (63 in decimal notation). Attack waveform amplitude levels at sixty-four sample points from address 0 to address 63 are stored in the attack waveform memory 137 as shown in FIG. 23. The amplitude levels are expressed as the amounts of attenuation, or the negative logarithms, as described before. The amplitude level 0 (corresponding to address 0) is "1 1 1 1 1 1", and the maximum amplitude level (corresponding to address 63) is "0 0 0 0 0 0".

The envelope data ENV is only increased. Therefore, when the most significant bit (MSB) is set to "1" once, then the envelope data ENV outputted by the shift register 138 is selected by the selection gate 139 until the envelope is completed.

The six less significant bits of the envelope data are increased gradually from "0 0 0 0 0 0" by the repetitive addition of the first decay variation data ΔTD1. The six less significant bits are selected, as envelope amplitude data, by the selection gate 139 as they are. The data "0 0 0 0 0 0" corresponds to the maximum amplitude level in the negative logarithmic expression as described above. Therefore, the gradual increment of the value from "0 0 0 0 0 0" means that the levels is decreased gradually from the maximum amplitude level. Accordingly, an envelope waveform for the first decay portion (TD1) as shown in FIGS. 14(*a*) and 14(*b*) can be obtained.

Upon arrival to the first decay level (LD), the comparator 155 (FIG. 20) outputs the signal S&2D. In the case of the normal mode, the data are not selected by the data selector 141, that is, the variation data ΔENV is set to "0" to maintain the value of the envelope data ENV unchanged. Thus, the envelope for a sustain portion maintained at the first decay level (LD) is obtained. Thereafter, when the release signal RLSE is produced in response to the key release, the second decay variation data ΔTD2 is selected, and this data ΔTD2 is repeated subjected to addition in the adder 140. As a result, the value of the envelope data ENV is gradually increased, and finally all the bits of the envelope data are set to "1". Thus, the envelope completion signal ENVF is produced, and the addition of the data ΔTD2 is stopped. The increment of the amplitude data in negative logarithmic expression means the decrement of the actual amplitude level. Therefore, an envelope for the second decay portion (TD2) as shown in FIG. 14(*a*) can be obtained. After the generation of the envelope finish signal ENVF, the bits of the data ENV are maintained at "1". This means that the damping is most advanced.

In the percussive mode, the second decay variation data ΔTD2 is selected immediately when the signal S&2D is produced. This data ΔTD2 is repeatedly added. Thus, an envelope waveform for the second decay portion (TD2) in the percussive mode can be obtained as shown in FIG. 14(*b*). If the envelope completion signal ENVF is produced before the key release, then the damping factor variation data ΔDR is not used. However, if the key is released during the damping and the release signal is produced, then the data ΔTD2 is switched to the data ΔDR, and this data ΔDR is repeatedly added until the production of the envelope finish signal ENVF.

Logics are provided in the data selector 141 (FIG. 21) so as to switch the data ΔTA, ΔTD1, ΔTD2 and ΔDR as described above. The data ΔTA is applied to a gate 163 which is gate-controlled by the output of an AND circuit 164. A signal obtained by inverting the attack finish signal AF is applied to the AND circuit 164. When the attack finish signal AF is "0", the data ΔTA is selected by the gate 163, and it is supplied as the envelope variation data ΔENV to the adder 140 (FIG. 20) through an OR circuit 165. When the attack finish signal AF is set to "1", then the data ΔTA is not selected.

The data ΔTD1, ΔTD2 and ΔDR are applied to gates 166, 167 and 168, respectively. The gates 166, 167 and 168 are gate-controlled by the outputs of an AND circuit 169 and OR circuits 170 and 171, respectively. The attack finish signal AF and a signal obtained by applying the signal S&2D to an inverter 172 are applied to the AND circuit 169. Therefore, the data ΔTD1 is selected for the period of time from the instant of the rise of the attack finish signal AF to the instant immediately before the rise of the signal S&2D.

The outputs of AND circuits 173 and 174 are applied to the OR circuit 170. The normal mode signal NORM, the release signal RLSE, and a signal obtained by inverting the envelope completion signal ENVF are applied to the AND circuit 173. Accordingly, in the normal mode, when the level reaches the first decay level (LD), the data are not selected until the key release, and the first decay level is maintained. Upon key release (RLSE="1"), the data ΔTD2 is selected. Upon completion of the envelope (ENVF="1"), the AND circuit 173 is disabled, and the data ΔTD2 is blocked.

Applied to the AND circuit 174 are the percussive mode signal PERM, a signal obtained by inverting the release signal RLSE, and a signal obtained by inverting the envelope completion signal ENVF. Therefore, in the percussive mode, immediately when the level reaches the first decay level (LD), the data ΔTD2 is selected (because the release signal RLSE is "0", and its inverted signal is "1"). When the key is released, then the AND circuit 174 is disabled, and the data ΔTD2 is blocked.

Applied to the AND circuit 174 are the percussive mode signal PERM, the release signal RLSE, and the signal obtained by inverting the envelope completion signal ENVF. Therefore, upon release of the key, the AND circuit 175 is enabled, and the output of the AND circuit 175 is applied through an OR circuit 171 to the gate 168 to permit the selection of the data ΔDR. Thus, in the percussive mode, when the key is released, the data ΔTD2 is switched to the data ΔDR. If the envelope is completed before the key is released, then the signal ENVF is set to "1", and therefore the data ΔDR is not selected.

An AND circuit 176 is provided for the absolute ending mode". The absolute ending mode signal FORCE, and the signal obtained by inverting the envelope completion signal ENVF are applied to the AND circuit 176. A signal obtained by inverting the absolute ending mode signal FORCE is applied to the above-described AND circuits 164, 169, 173, 174 and 175. Therefore, in the "absolute ending mode", the AND circuits 164, 169, 173, 174 and 175 are disabled.

In FIG. 20, the absolute ending mode signal FORCE provided by the AND circuit 150 is applied to the damping factor memory 145. In response to this absolute ending mode signal FORCE, the damping factor memory 145 reads out the highest rate, i.e., the data ΔDR of the highest value. In this operation, the damping factor data DR applied to the other input terminal of the damping factor memory 145 is disregarded. In other words, the absolute ending mode signal FORCE takes precedence over the damping factor data DR.

Accordingly, when the gate 168 is opened by the output "1" of the AND circuit 176 in FIG. 21, the data ΔDR inputted to the gate 168 is the maximum data read out by the absolute ending mode signal FORCE. Thus, the rate of increase of the envelope data ENV is very slow, and an envelope waveform damping abruptly can be obtained. In this manner, the "absolute ending mode" is achieved.

The envelope data ENV outputted by the shift register 138 (FIG. 16) in time division manner in response to the time slots is applied also to the comparator 66 in FIG. 8, and is utilized as data representative of the partials assigned to the time slots.

In the manner as described above, the envelope waveform amplitude signal provided at the output side of the selection gate 139 (FIG. 16) is applied one input terminal of the peak level scaler 178 (FIG. 16), to the other input terminal of which is applied a peak level factor read out of the peak level ROM 109. The peak level ROM 109 receives peak level data LP* which are supplied in time division manner in correspondence with the time slots through the line 106 from the interface unit 13 (FIG. 15), and reads out in logarithmic expression a peak level factor corresponding to the data LP*.

The peak level scaler 178 operates to scale the envelope waveform amplitude signal supplied from the selection gate 139 with the aforementioned peak level factor. For this purpose, an adder may be employed as the peak level scaler 178 because the two inputs thereto are in logarithmic expression. As the entire envelope waveform is scaled with the peak level (LP), the first decay level cannot be determined only by the first decay data (LD), that is, the actual first decay level is (LD·LP) as indicated in FIGS. 14(*a*) and 14(*b*).

The envelope waveform amplitude signal which has been scaled (hereinafter referred to as "an envelope scale factor log E") and is outputted by the peak level scaler 178 is applied to the envelope scaler 125. This envelope scaler 125 operates to scale with the envelope scale factor E the amplitude of the sine wave signal (sin nqR) of a partial which is read out of the sine wave table 128, and to obtained a partial waveform signal (E sin nqR) to which an envelope has been given. As the two inputs to the scaler 125 are in logarithmic expression, an adder can be employed as the scaler 125.

The partial waveform signal log(E sin nqR) outputted by the envelope scaler 125 is supplied to the logarithmic-linear converter 179, where it is converted into linear data. The output (E sin nqR) of the logarithmic-linear converter 179 is applied to the accumulator 180. In this accumulator 180, the waveform signals E sin nqR of the partials assigned to the time slots which are successively supplied with the timing of the clock pulse $\phi_0$ are accumulated, whereby a waveform obtained by combining the partial amplitudes in one sample interval. Although the accumulator 180 carries out the accumulation in response to the clock pulse $\phi_0$, the accumulation contents thereof are cleared by the signal BTMAX (FIG. 9(*b*)) supplied from the counter 68 (FIG. 9(*a*)), for every 256 time slots. This signal BTMAX is used also as a load instruction for the register 181. Although not illustrated in detail, a slight time delay is set between the load and the clear so that the accumulator 180 is cleared after the accumulation result of the accumulator 180 has been loaded into the register 181 according to the signal BTMAX.

The register 181 operates to hold the partial composite waveform amplitude Σ(E sin nqR) for one sample interval (FIG. 9(*b*)). The contents thus held are rewritten every generation of the signal BTMAX. The contents Σ(E sin nqR) of the register 181 is applied, as the output musical tone waveform of the tone generator unit 14, to the digital-to-analog converter 15 (FIG. 1), where it is converted into an analog signal.

Detailed Description of the Partial Assignment Process Program

Figure 24:
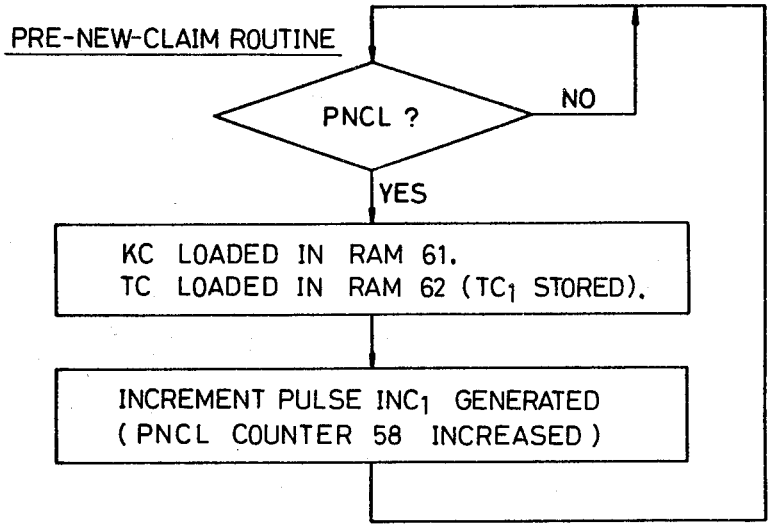
FIG. 24 is a flow chart of a pre-new-claim routine shown in FIG. 2.

First, processing the pre-new-claim data PNCL will be described with reference to FIGS. 4 and 24.

Upon generation of the pre-new-claim data PNCL, the key code KC and the touch data TC (the first touch data $TC_1$) are written in the address positions, which are specified by the count value PNCLD of the PNCL counter 58, in the RAM's 61 and 62, respectively. Thereafter, as the increase pulse $INC_1$ is applied to the PNCL counter 58, the count value PNCLC of the PNCL counter 58 is increased to advance the addresses. Thereafter, upon generation of the pre-new-claim data PNCL of another key, the key code and the touch data TC concerning the key are stored in the addresses thus advanced in the RAM's.

In the above-described manner, the key code KC and touch data $TC_1$ of a key depressed are stored in the addresses in the RAM's 61 and 62 beginning with the addresses smallest in number.

Now, processing the new claim data NCL and the new release data NRLS will be described.

Figure 25:
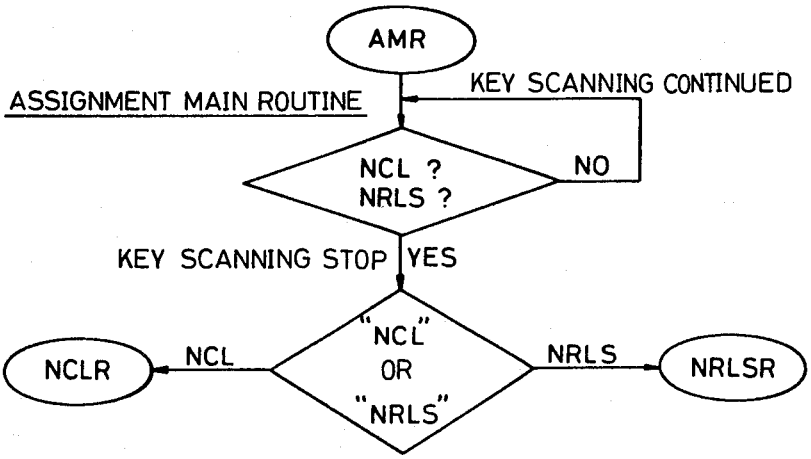
FIG. 25 is a flow chart of an "assignment main routine"

At the start, the new claim data NCL and the new release data NRLS are processed in a common "assignment main routine". FIG. 25 is a flow chart indicating the assignment main routine. In the assignment main routine, when the new claim data NCL or the new release data NRLS is produced, the key scanning is suspended; and in case of the new claim data NCL the program is advanced to a new claim routine NCLR, and in case of the new release data NRLS the program is advanced to a new release routine.

*New Claim Routine

The flow chart of the new claim routine NCLR is as indicated in FIGS. 26 through 29.

When the new claim data NCL is produced, a program operation for "key on again" decision is carried out according to the procedure indicated in FIG. 26. A set signal FQSET is applied to the absolute ending flip-flop 100 (FIG. 15) with the timing of generation of the signal BTMAX which is generated for every sample interval of a musical tone waveform. As a result, the set output FQ of the flip-flop 100 is set to "1", and the AND circuit 124 (FIG. 17) in the envelope mode control circuit 98 is enabled. Therefore, in the time slot where the comparator 101 (FIG. 15) produces the key coincidence signal KEQ, the two less significant bits $EM_0$, $EM_1$ of the envelope data is set to "1 1". The key code KC applied to one input terminal of the comparator 101 from the key logic unit 11 represents a key to be assigned (which is the key newly depressed to provide the new claim data NCL), and the contents of this code are fixed since the key scanning has been suspended. The key codes representative of the partials assigned to the respective time slots are supplied to the other input terminal of the comparator 101 from the shift register 91 (FIG. 15) in time division manner. Therefore, the generation of the key coincidence signal KEQ from the comparator 101 means that the key to which the partial assigned to the time slot, where the signal KEQ has been generated, belongs is the same as a newly depressed key to be assigned. That is, this means that a key released once is depressed again, i.e., "key on again". As the data $ME_2$ representative of key release is "1" in the time slot where the key coincidence signal has been produced, the envelope data $EM_2$, $EM_1$, $EM_0$ is set to "1 1 1", thus specifying the "forcible ending mode". Accordingly, the envelope of the partial assigned to the time slot where the key coincidence signal KEQ has been produced is damped abruptly.

After the set signal FQSET was supplied to the flip-flop 100, the generation of the signal BTMAX is monitored again. Upon generation of the signal BTMAX, a reset signal FQRESET is applied to the flip-flop 100. As a result, the set output FQ is set to "0", because during one period of the signal BTMAX, the comparison of all the time slots in the comparator 101 is completed, and thereafter it is unnecessary to keep the signal FQ at "1". The envelope mode data $EM_2$, $EM_1$, $EM_0$ set to "1 1 1" is stored and held being circulated through the shift register 92 (FIG. 15) and the envelope mode control circuit 98.

Thereafter, or in parallel with the program concerning the key-on-again decision described above, a key touch signal computation program indicated in FIG. 26 is carried out. In this key touch signal computation program, the contents of the RAM 61 are read out successively in the opposite direction (toward the address smaller in number) so as to look for the same key code as that of the key which has produced the data NCL in the RAM 61, because the key code has been produced earlier than the data PNCL concerning the same key and the key code of that key has been stored in an address whose address number is smaller than that of the currently specified address (PNCLC) in the RAM 61. The first touch data $TC_1$ stored in processing the data PNCL concerning the key which has produced the data NCL is stored in the address position in the RAM 62 whose address number is the same as that of the address where the key code looked for is stored. The first touch data $TC_1$ read out of that address in the RAM 62 is subtracted from the touch data TC (the second touch data $TC_2$) which is supplied together with the new claim data NCL to the key logic unit 11.

First, the load signal $LOD_8$ is supplied to the address counter 60 (FIG. 12), so that the current count value PNCLC of the PNCL counter 58 (FIG. 4) is inputted into the counter 60. Simultaneously, the key code KC (representative of the key which has produced the new claim data NCL) supplied from the key logic unit 11 is inputted into a register (not shown) in the ALU 24 (FIG. 1). The count value PNCLC inputted into the counter 60 is independent of the key which has produced the data NCL.

Then, the key code KC (concerning the data NCL) stored in the aforementioned register in the ALU 24 is compared with the key code KC (stored according to the data PNCL) read out of the RAM 61 in FIG. 4. When both are not coincident with each other, the decrease pulse $DEC_1$ is applied to the address counter 60 (FIG. 12). The RAM 61 is placed in the read mode with (PNCL="0")(R/W="0")), and the key code KC stored in the address corresponding to the address signal ADRS from the address counter 60, which has been selected by the selector 59, is read out. Since the count value PNCLC has been inputted into the address counter 60, the contents in the addresses in the RAM 61 (and the RAM 62) are read out beginning with the address corresponding to the count value PNCLC. In other words, the enable signal $ENB_1$ is supplied to the RAM 61 (and the RAM 62), so that the contents in the address corresponding to the count value PNCLC loaded in the counter 60 are read out. In the case where the key code KC stored in the ALU 24 is not coincident with the key code KC read out of the RAM 61, the adecrease pulse $DEC_1$ is applied to the counter 60, to subtract one (1) from the count value of the counter 60. As a result, the current address number specified for reading out in the RAM 61 (62) is smaller by one than the previous one. Thereafter, the enable signal $ENB_1$ is supplied to the RAM 61 (62) to read out the key code stored in the current address. In the above-described manner, the count value of the address counter 60 is reduced successively and the specified address number in the RAM 61 (62) is also successively reduced until the coincidence of the key codes KC is obtained.

Upon detection of the coincidence of the key codes KC, the touch data read of the RAM 62 (that is, the first touch data $TC_1$ concerning the key which has produced the data NCL) is loaded into the register in the ALU 24. In addition, the touch data (that is, the touch data $TC_2$ concerning the key which has produced the data NCL) supplied from the key logic unit 11 in which the scanning is suspended is loaded into the ALU 24, whereby subtraction ($TC_2-TC_1$) is carried out, to provide a value (or the key touch signal) $TC_2-TC_1$ corresponding to the difference in closure time between the first contact means $KM_1$ and the second contact means $KM_2$. Then, the load signal $LOD_1$ is applied to the touch latch 78 (FIG. 5), to load the key touch signal $TC_2-TC_1$ supplied from the ALU 24 into the touch latch 78.

Thereafter, "a program concerning tone color selection" indicated in FIG. 27 is carried out.

In this program, the storage of "control parameter memory area" is read out of the tone parameter memory 82 (FIG. 12).

First, the load signal $LOD_7$ is applied to the tone counter 87 (FIG. 12) to load a code representative of a tone color selected by the tone selector 29 into the tone counter 87. Simultaneously, the clear signal $CLR_1$ is supplied to the address counter 60 (FIG. 12) to clear the latter 60. Accordingly, the block address signal BADRS applied to the tone parameter 80 specifies the tone color block which has been specified by the tone selector 29. As the address signal ADRS from the counter 60 is "0", the first address in the selected tone color block, i.e., the first address of the "control parameter memory area" (FIGS. 13(*a*) and 13(*b*).

Next, the enable signal $ENB_4$ is applied to the tone parameter memory 82, thereby to read the data which is representative of the total number (H) of partials forming the tone color stored in the first address which has been specified by the address signals BADRS and ADRS. Then, the data (H) is stored in the register of the ALU 24. Thereafter, the increase pulse $INC_2$ is applied to the address counter 60 to increase the value of the address signal ADRS by one (1). Then, the enable signal $ENB_4$ is applied to the memory 82 again to read out the damping factor data DR, envelope mode data EM and inharmonic degree data INHM stored in the next address (cf. FIG. 13(*b*)), so that these data DR, EM and INHM are latched by the output latch unit 26 (FIG. 1). Thereafter, seven (7) is added to the contents of the address counter 60, so that the first address (1032 in FIG. 13(*c*)) in the partial data memory area #1 is specified with the six (6) empty addresses (1026 to 1031 in FIG. 13(*b*)) being skipped.

The data DR, EM and INHM latched by the output latch unit 26 are maintained stored until the assignment of all of the partials of the key which has produced the new claim data NCL is completed.

Next, "a program for one partial" indicated in FIGS. 27, 28 and 29 is carried out. In the "program for one partial", computation of various data for establishing the waveform signal of a partial to be assigned, and assignment of the partial to a suitable time slot are carried out. The "program for one partial" is repeatedly carried out; that is, it is carried out for each partial.

First, data representative of the order (n) of a partial to be assigned which has been stored in the first address in the partial data memory area (FIG. 13) is read out (in response to the application of the enable signal $ENB_9$). The order data n thus read out is inputted into the register in the ALU 24, the output latch unit 26, and the latch circuit 85 (FIG. 7). Simultaneously, the key code KC read out of the key logic 11 is latched by the latch circuit 83 in FIG. 6, and by the output latch unit 26. Furthermore, the converters 84 and 86 in FIGS. 6 and 7 are enabled, to obtain the key pitch data and order data in logarithmic expression: log $F_{KC}$ and log n. The data log $F_{KC}$ and log n thus obtained are applied to the ALU 24, where they are subjected to addition (log $F_{KC}$+log n), to obtain the partial pitch data log ($n \cdot F_{KC}$). This partial pitch data log ($n \cdot F_{KC}$) is loaded into the note latch 80 (FIG. 5).

Then the decision of "harmonic limiting" is carried out by the use of the partial pitch data log($n \cdot F_{KC}$) latched by the note latch 80. In other words, the enable signal $ENB_7$ is supplied to the note latch 80, so that its latch contents log ($n \cdot F_{KC}$) are read out and are supplied to a harmonic limiting decision logic (not shown). In this operaton, no enable signal $ENB_4$ is supplied to the memory 77 (FIG. 5), and therefore no data is read out of the memory 77.

In the harmonic limiting decision logic, it is determined whether or not the frequency should be subjected to the "harmonic limiting", from a particular bit (more significant bit) of the partial pitch data log ($n \cdot F_{KC}$). The harmonic limiting decision logic may be made up of a suitable logic such as a simple digital comparison circuit or an addition and subtraction circuit. In this example, an computing element in the CPU 22 (FIG. 1) is employed as the harmonic limiting decision logic. A setting log fH corresponding to the harmonic limiting frequency is compared with the pitch data log ($n \cdot F_{KC}$), and it is decided that the "harmonic limiting" should be effected when log $fH \leqq$ log ($n \cdot F_{KC}$): (YES).

In the case where the "harmonic limiting" is (YES), the CPU 22 produces the reset signal RST to reset the flip-flop 47 (FIG. 3) in the key logic unit 11. As a result, the key scanning by the key logic unit 11 is started again. In addition, the count value of the program counter 19 (FIG. 1) is set back to the initial value, and the program is returned to the start (AMR) of the assignment routine. Therefore, even if the partials which have not been assigned yet still exist, no particular assignment of these partials in effected for the following reason: The data are read out of ethe tone parameter memory 82 successively beginning with the partial lowest in order (n); that is, the partials are assigned successively beginning with the partial lowest in order (n). Therefore, when a partial is subjected to "harmonic limiting", the frequencies of partials to be processed thereafter are higher than the frequency of the aforementioned partial, and accordingly the partials are also subjected to "harmonic limiting".

As is apparent from the above description, as no time slot is assigned to the partials subjected to "harmonic limiting", these partials are not produced.

In the case where the "harmonic limiting" is not effected (in the case of (NO)), the increase pulse $INC_2$ is applied to the address counter 60 to increase the address signal ADRS by one (1). As a result, the peak level touch sensitivity data LPTSENS and the peak level note scale data LPNS stored in the second address in the partial data memory area are read out of the memory 82, and are inputted into the touch sensitivity latch 79 and the note scale latch 81, respectively. That is, the enable signals $ENB_9$ is supplied to the memory 82, and the load signal $LOD_2$ and $LOD_6$ are supplied to the latches 79 and 81, simultaneously from the CPU 22, respectively.

Next, the value ADRS of the address counter 61 is increased by one (1), and the peak level data LP stored in the third address of the area is read out of the memory 82. This peak level data LP thus read out is temporarily stored in the register in the ALU 24.

Next, the enable signals $ENB_4$, $ENB_2$ and $ENB_3$ are supplied to the memory 77, and the latches 78 and 79 in FIG. 5, so that the key touch signal ($TC_2-TC_1$) latched in the latch 78 and the touch factor TCF (LPTSENS) corresponding to the peak level touch sensitivity data LPTSENS latched in the latch 79 are read out of the memory 77. This touch factor TCF (LPTSENS) is applied to the ALU 24, and is added to the peak level data LP stored in the ALU 24. In practice, a multiplication result is obtained as indicated by the above-described equations (7) through (10); however, addition is carried out in the ALU 24 thanks to the logarithmic expression. Thereafter, the note scale factor NSF(LPNS) corresponding both to the partial pitch data log ($n \cdot F_{KC}$) stored in the note latch 80 and to the peak level note scale data LPNS stored in the note scale latch 81 is read out of the memory 77 and is supplied to the ALU 24, where it is added to the previous computation result to provide the computation result LP* indicated by the equation (7).

Then, the peak level computation result LP* is supplied to a minimum level decision logic (not shown), where it is decided whether or not it is smaller than the reference minimum level Lref. When the result LP is smaller than the reference minimum level Lref (LP*<Lref), then the program jumps to the routine NXTHR for the next parial (FIG. 29). As a result, in the case where the peak level LP* scaled with the touch factor and the note scale factor is smaller than the reference minimum level Lref, that partial is not assigned.

In the case where the peak level LP is equal to or larger than the reference minimum level Lref (LP*=Lref), program is continued, and the peak level data LP* held in the ALU 24 is stored in the output latch unit 26.

Next, the value ADRS of the address counter 60 is increased by one (1), so that the decay time touch sensitivity data TDTSENS and time element note scale data TMNS stored n the fourth address in the partial data memory area (FIG. 13) are read out of the memory 82. These data are loaded into the latches 79 and 81, respectively.

Then, the value ADRS of the address counter 60 is increased by one (1), so that the first decay time data TD1 stored in the fifth address in the area is read out of the memory 82 and is stored in the register in the ALU 34. Thereafter, the decay time touch factor TCF(TDTSENS) is read out of the memory 77 according to the data ($TC_2-TC_1$) and TDTSENS in the latches 78 and 79, and is added to the data TD1 in the ALU 24. Furthermore, the time element note scale factor NSF(TMNS) is read out of the memory 77 according to the data in the latches 80 and 81 (FIG. 5), and is added to the previous addition result in the ALU 24. Thus, the first decay time data TD1* as indicated by the equation(9) is obtained. This data TD1* is latched by the output latch unit 26. For convenience in description, the process block concerning the fifth address is designated by reference numeral 182.

Then, processes indicated by blocks 183, 184 and 185 are successively carried out. The processes of the blocks 183 and 185 are similar to that of the block 182 described above; however, it should be noted that the former are different in a reading address in the tone parameter memory 82. More specifically, in the block 183, the count value of the address counter 60 is increased by one (1), so that the sixth address in the area of the memory 82 is specified, and the following addition equivalent to the equation (10) is carried out to obtain the second decay time dta TD2*:

TD2+TCF(TDTSENS)+NSF(TMNS)

This data TD2* is stored in the output latch unit 26.

In the block 184, the count value of the counter 60 is further increased by one (1), so that the data TATSENSE and LD stored in the 7th addresses in the area of the memory 82 is read out. This data TATSENS is latched by the touch sensitivity latch 79, while the first decay level data LD is latched by the output latch unit 26.

In the block 185, the count value of the counter 60 is still further increased by one (1), so that the attack time data TA stored in the 8th address in the area of the memory 82 is read out, and the following addition equivalent to the above-described equation (8) is carried out to obtain the attack time data TA*:

TA+TCF(TATSENSE)+NSF(TMNS)

This data TA* is stored in the output latch unit 26.

When the data stored in all of the addresses in one partial data memory area (FIG. 13(*c*)) have been read out and the computations using these data have been completed, all the data necessary for producing the partial are provided for the output latch unit 26 (FIG. 1).

Next, the claim signal CLM is supplied to the claim logic 64 (FIGS. 8 and 10) from the CPU 22. Then, it is determined whether or not a susable time slot is available in the claim logic 64 as described with reference to FIGS. 10 and 11. If a usable time slot is available, the new claim load signal NCLD is produced in one time slot (smallest in envelope amplitude level). This new claim load signal NCLD is applied to the select gates 94, 95, 96 and 97 (FIG. 15) and the envelope mode control circuit 98 in the tone generator interface unit 13 (FIG. 15). As a result, the data INHM, n, KC, EM, LP*, LD, TA*, TD1*, TD2* and DR latched in the output latch unit 26 are loaded into the respective shift registers 89, 90, 91, 92 and 93 in the time slot where the new claim load signal NCLD has been produced. The data thus loaded are stored (held in circulation) in the shift registers 89, 90, 91, 92 and 93 in synchronization with the time slot. Thus, the assignment of one partial to the time slot has been completed. As shown in FIG. 20, the new claim load signal NCLD is applied also to the envelope calculator 108 to set the envelope data ENV to "0".

In the case when no usable time slot is available, the unavailable signal $\overline{AVA}$ is provided as was described before. As a result, the reset signal RST is provided, so that the key scanning is started again, and the program is returned to the start AMR (FIG. 25) of the main routine. In this case, all of the 256 time slots are effectively used (the key depression being continued, and the tone production being effected). Therefore, the key scanning is repeated until an available time slot is obtained.

When the new claim load signal NCLD is produced, the program counter increase pulse PCINC (FIG. 10) is also produced as was described before, and the program is advanced to the next step, namely, "a routine NXTHR for the next partial".

In this routine NXTHR, one (1) is subtracted from the total partial number H stored in the register of the ALU 24, to obtain the rermaining partial number H*. The subtraction of one (1) from the total partial number H is for the first partial (corresponding to the memory area #1). In the next case, one (1) is subtracted from the preceding subtraction result H*. Accordingly, upon completion of the above-described subtraction, the content of the register in the ALU 24 storing the total partial number H is rewritten into that subtraction result. Thus, whenever the assignment of one partial is completed, the content of the register is decreased by one (1) , and is finally changed to zero (0). When the subtraction result (H*) is zero (0), the assignment of all the partials forming the musical tone of the key which has produced the new claim data NCL has been completed.

Therefore, after the subtraction of one (1) described above, it is determined whether or not the subtraction result (H*) is zero (0). In case of (NO, the value ADRS of the address counter 60 is increased by one (1), and the program is returned to the start HR of the "program for one partial" (FIG. 27). As a result, the address specified in the tone parameter memory 82 is shifted to the first address in the next partial data memory area (#2 and so on). Accordingly, with respect to a partial whose order (n) is different from that of the previous one, the same "program for one partial" as the previous one is carried out according to various data different from the previous ones.

If the decision H*=0 is (YES), then the assignment of all the partials concerning one key has been completed. Therefore, the reset signal RST is produced, so that the key scanning is started again, and the program is returned to the start AMR of the "assignment main routine" (FIG. 25).

*NEW RELEASE ROUTINE

Figure 30:
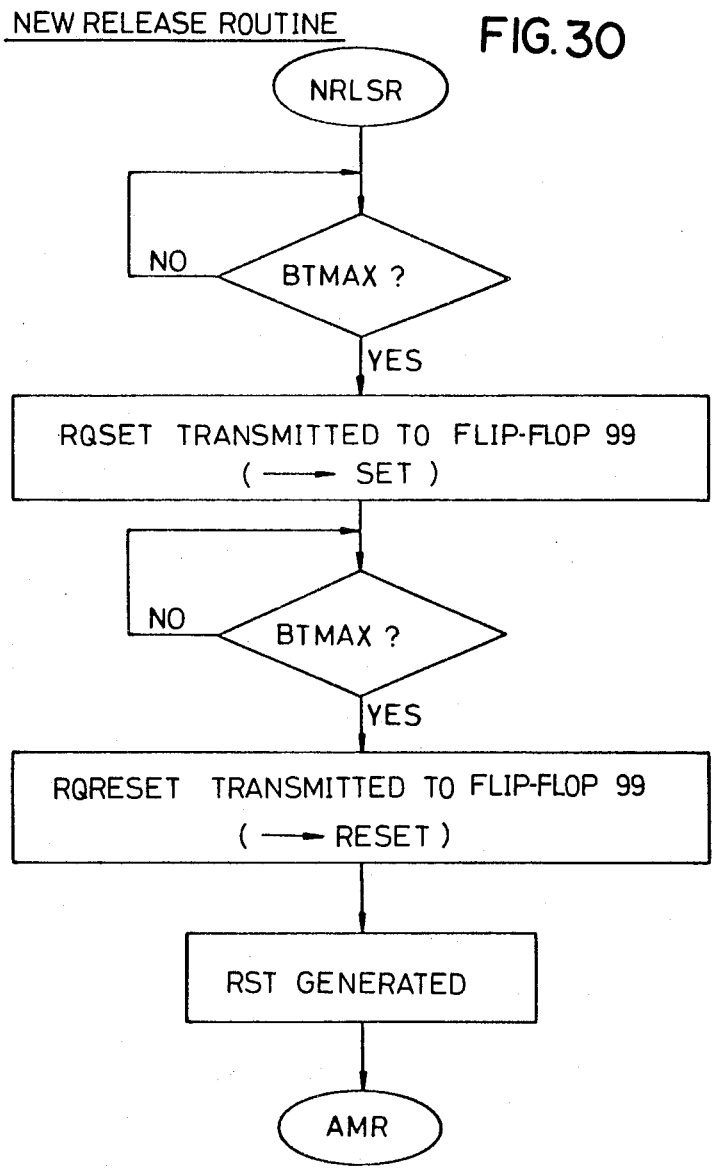
FIG. 30 is a flow chart of a new release routine.

In the new release routine NRLSR indicated in FIG. 30, with the timing of generation of the signal BTMAX (cf. FIG. 9(*b*)) after the generation of the new release data NRLS, the set signal RQSET is supplied to the release flip-flop 99 (FIG. 15). As a result, the set output RQ of the flip-flop 99 is set to "1", and the AND circuit 123 (FIG. 17) of the envelope mode control circuit 98 is enabled. Thereafter, when the above-described signal BTMAX is produced, the reset signal RQRESET is supplied to the flip-flop 99, and the output RQ is set to "0". Thus, the AND circuit 123 is maintained enabled only for one period of the signal BTMAX (256 time slots). When the comparator 101 produces the key coincidence signal KEQ during this period, then the output of the AND circuit 123 is raised to "1" in the time slot in which the signal KEQ is produced, and the data $EM_2$ representative of key release is changed to "1". That is, the key code KC supplied from the key logic unit 11 to one input side of the comparator 101 represents the key (which has been newly released) which has produced the new release data NRLS, and the partials of this key code KC have been assigned to time slots. Therefore, the same key code as this key code KC has been stored in the shift register 91 (FIG. 15). Accordingly, the time slot in which the key coincidence signal KEQ has been provided is the time slot to which the partial forming the musical tone of the key relesed has been assigned. In this time slot, the data $EM_2$ is set to "1" to represent the key release.

After the process described above, the reset signal RST is supplied to the key logic unit 11, so that the key scanning is started again and the operation is returned to the start AMR of the assignment main routine (FIG. 25).

MODIFICATIONS (1) In the above-described example, as is apparent from FIG. 13(*a*), in the tone parameter 82, 128 addresses per tone color (or 128 addresses per block) are used, and among these addresses, eight (8) addresses are used per partial to set a tone color. That is, fifteen (15) partials in maximum can be used for one tone color. (However, it should be noted that this does not mean that the use is limited up to 15 harmonic overtones.). Of course, if the capacity of the tone parameter memory 82 is increased, then the more partials can be used for one tone color.

In this case, it is possible to increase the number of partials per tone color without changing the system in the example at all. That is, in composing a tone color which requires a number of partials, a plurality of successive addresses in the tone parameter memory 82 can be used for one tone color. This can be achieved simply by supplying the carry signal CARRY of the address counter to the increase input terminal of the tone counter 87 as indicated by a line 186 in FIG. 12. When one block consisting of 128 addresses is processed, the 7-bit address counter 60 outputs one carry signal CARRY, as a result of which the count value of the tone counter 87 is increased by one (1). Accordingly, the output BADRS of the tone counter 87 is increased by one (1), and therefore the successive specification can be effected in the next block. In the case where a plurality of blocks are successively used, the total partial number H has a corresponding value (larger than fifteen). Therefore, even if the block is changed, the condition (H*=0) indicated in FIG. 29 is not satisfied. Accordingly, in the case also where the block has been changed, the operation is not returned to the "assignment main routine" AMR, but it is returned to the "program for one partial" HR. Thus, this arrangement is considerably advantageous in that it is unnecessary to change the program.

(2) In the above-described example, the assignment process is effected for every partial. However, a plurality of (for instance four or eight) partials in a group may be assigned in a parallel mode. This assignment can be achieved by a plurality of processing devices, such as the ALU peripheral logic 23, the ALU 24 and the tone parameter logic 25, provided in parallel. According to this method, the total time required for assigning partials per key can be reduced, and therefore the time delay from the depression of a key to the start of the production of the musical tone can be reduced.

(3) The microprogram system using the program production unit 17 and the CPU 22 is employed in the above-described example. However, the invention is not limited thereto or thereby. For instance, the partial assignment unit may be formed with a hard logic.

(4) In the above-described example, sixteen tone color blocks are provided, and fifteen partials are used in each tone color block. However, for a tone color which can be formed with partials the number of which is less than fifteen, the number of partial data memory areas may be reduced, so that the remaining partial data memory areas are used for another tone color.

DESCRIPTION OF THE EFFECTS

As is apparent from the above description, according to this invention, a particular number of (256 in the example) partial generating time slots are not fixedly in correspondence to particular partials, that is, they can be used for any partials. In other words, the electronic musical instrument according to the invention is so designed that partials to be produced can be assigned to optional time slots. Therefore, the electronic musical instrument according to the invention has the following advantages or merits:

(1) all of the partial generating time slots can be effectively used. Therefore, even if the highest rate of system clock is limited, the maximum number of tones to be produced with the electronic musical instrument can be relatively increased. This will be described by the utilization of the equation "$St=M\ N\ t_c$" described in the introductory part of this specification. For a tone color having a small number of partials N, the maximum number of tones M to be produced simultaneously is relatively increased because of the variation of the number of partials N. For instance, in the case where the total number of times slots is 256, and an 8-foot Tibia tone consisting of the first harmonic and the third harmonic is to be produced, 128 tones can be produced simultaneously. This cannot be achieved by the conventional electronic musical instrument at all.

(2) A partial subjected to "harmonic limiting" is not assigned to a time slot, and therefore this time slot can be utilized for the assignment of another partial. Thus, the time slots can be effectively utilized.

(3) A partial whose amplitude level is reduced by touch response and note scale is not assigned to a time slot, and therefore the time slot can be utilized for the assignment of another partial.

(4) The "truncation" is effected for every partial according to its amplitude level. Therefore, even with partials concerning the same key, a partial short in damping time is subjected to trunction, and a partial to be prolonged can be sufficiently prolonged. Thus, a reasonable truncation can be effected, and the time slots can be effectively utilized. With the conventional electronic musical instrument, such operation cannot be performed because the truncation is effected for every key. In other words, the system in which the truncation is carried out starting with the key released earliest is disadvantageous in that a partial to be prolonged is truncated. The system that the truncation is carried out beginning with the musical tone smallest in amplitude level is also disadvantageous in that, if it contains at least one prolonged partial, then the time slots for many other partials which have been damped already are not subjected to truncation; that is, they are used without profit. These disadvantages have been eliminated according to the invention.

(5) Partials of any degree (irrespective of integers or non-integers) can utilize the partial generating time slots. Therefore, the composition of inharmonic tones can be realized without adding a particular device.

(6) For the same reason, a multi-system effect can be readily obtained without particular parallel tone synthesizing channels. The term "multi-system effect" is intended to mean the effect that is obtained by simultaneously producing both a musical tone having a predetermined spectrum distribution and a musical tone having a spectrum distribution the fundamental wave and partials of which are different in pitch from those of the firstly mentioned one. According to the invention, the multi-system effect can be obtained merely by setting the order n to 1, 1.1, 2, w2.2, , 3.3 and so forth for instance according to the spectrum distribution of the desired multi-system effect, in one tone color block (or a plurality of blocks for one tone color) in the tone parameter memory 82. Thus, according to the invention, various performance effects can be obtained without adding particular devices.

What is claimed is:

1. A polyponic electronic musical instrument of a type wherein notes to be played are selected by depression of keys, and wherein a tone is produced by separately calculating the amplitude contribution of each partial of the tone and accumulating the partials, comprising:

tone generator means for calculating partials individually at a specific number of time slots, each time slot being available for assignment to any partial of any selected note;

partial tone assignment means for assigning, responsive to depression of a key designating a selected note, each partial to be produced individually for that note to any available one of the time slots;

said tone generator means calculating the partials having been assigned to available time slots, and accumulating said calculated partials to produce said tone, assigned partials for different, concurrently selected notes being assigned to separate arbitrary time slots.

2. An electronic musical instrument as defined in claim 1 wherein said partial tone assignment means comprises:

a circuit for generating data of the depressed key in response to depression of the key;

first means for providing a set of partial tone data required for synthesizing said tone and for delivering out, in accordance with the data of the depressed key, each partial tone data one by one from among said set of partial tone data; and second means for assigning each of the delivered out partial tone data to an available one of the time slots, and for thereupon causing partial tone data for another partial to be delivered out of said first means, the set of partial tone data being sequentially assigned by the cooperation between said first means and said second means, and wherein said tone generator means is a circuit which calculates partial tone signals in accordance with partial tone data assigned to the respective time slots.

3. An electronic musical instrument as defined in claim 2 wherein said partial tone data includes at least data representing the tone pitch of the selected note and data representing the order of the partial, said order being a ratio of frequency of the partial to said tone pitch, said tone generator means calculating the data representing the tone pitch and the order of the partial to establish the frequency of said partial tone signal.

4. An electronic musical instrument as defined in claim 2 wherein said partial tone data includes at least data representing the tone pitch of the selected note and data representing the order of the partial tone, said first means is a means from which the partial tone data is delivered from the data of the lowest order upwardly and said second means includes logic which judges the frequency of the partial to be assigned from the tone pitch of the selected note and the order of the partial and, if the frequency is in excess of a predetermined value, stops assignment of said partial and remaining partials of the selected note, all still unassigned time slots thereafter being available for assignment to the partials of other concurrently selected notes.

5. An electronic musical instrument as defined in claim 2 wherein said first means has plural sets of the partial tone data, the number and the order of the partials of each set being different from those of other sets, the partial tone data of one of the sets being sequentially delivered out in accordance with the data of a depressed key and wherein said second means does not effect the assignment of the partial tone data associated with another depressed key, after assigning last partial tone data of said one of the sets, until generation of the data for that other depressed key.

6. An electronic musical instrument as defined in claim 2 wherein said data of the depressed key includes at least data for identifying the key and data correspondng to key touch, and wherein said partial tone data includes at least amplitude scale data corresponding to the tone pitch of said partial and amplitude scale data corresponding to the key touch, and wherein said second means includes logic which stops the assignment of said partials if the amplitude of said partial is below a predetermined value judging from said amplitude data of the partial to be assigned and said amplitude scale data.

7. An electronic musical instrument of a type wherein a tone is produced by generating partial tones of the tone and combining the generated partial tones, and wherein tones to be produced are selected by depression of corresponding keys on a keyborad, comprising:

tone generator means for generating desired partial tone signals individually at a specific number of time slots to each of which a partial tone signal of any order is arbitrarily assignable; and partial tone assignment means for ascertaining, in the event that all of said time slots contain previously assigned partial tone signals, the one time slot containing the partial tone signal of smallest amplitude level, and for assigning, responsive to depression of a key, one at a time each of the partial tones constituting a tone to be produced in accordance with the key depression individually to the single time slot which is ascertained at the time of assignment of that one partial tone to contain the partial tone signal of smallest amplitude level.

8. In a polyphonic electronic musical instrument of the type in which a tone generator synthesizes a tone by individually calculating on a time shared basis, during repetitive time share cycles, the sample point amplitude contributions of each individual partial for each depressed key, the improvement wherein in said tone generator there is separately established for each sample point an envelope scale factor for each partial in accordance with a selected envelope type, said improvement comprising:

first means for supplying for each partial, during each time share cycle, a set of data comprising a peak level value, attach and decay time values, and a decay level setting value, envelope calculator means, operative during each time share cycle, for providing an unscaled envelope amplitude data by combining with the envelope amplitude data that was provided for the same individual partial during the previous time share cycle an envelope change value established in response to the attach and decay time values and said decay level setting value concurrently supplied by said first means, and peak level scaler means for scaling said provided unscaled envelope amplitude data in accordance with said supplied peak level value, thereby establishing said envelope scale factor for said each partial, said tone generator utilizing said envelope scale factor in said tone synthesis, and wherein;

said envelope calculator means includes a comparator for comparing said previously calculated envelope amplitude data with a level established by said supplied decay level setting value, and for controlling selection of which envelope change value is utilized by said envelope calculator means from a set of such change values respectively established by different ones of said attack and decay values.

9. The improvement of claim 8 wherein said tone generator calculates the sample point amplitude contributions of each partial on a time shared basis, said first means supplying said set of data for each partial during the time shared time slot during which the associated partial amplitude contribution is calculated, said improvement further comprising:

shift register means having a storage position associated with each time slot and shifted in unison with the time sharing operation of said tone generator, each position storing the previously calculated envelope amplitude data for the partial assigned to the corresponding time slot, said envelope calculator means receiving envelope amplitude data from said shift register means and supplying the new provided envelope amplitude data back to said shift register means to replace the previous value.

10. The improvement of claim 8 wherein said instrument has a note selection keyboard and further includes:

means for scaling said peak level value and said attack and decay time values in accordance with the fundamental frequency of a selected note.

11. The improvement of claim 8 including a memory storing on attack waveform and wherein, during the attack portion of said selected envelope type, said provided envelope amplitude data is used to selectively access said memory, the resultantly read out waveform data being supplied to and scaled by said peak level scaler means in place of the provided envelope amplitude data itself.

12. The improvement of claim 8 wherein said instrument has a note selection keyboard and further includes:

means for scaling said peak level vlaue and said attack and decay time values in response to keyboard touch.

13. In a polyphonic keyboard electronic musical instrument of the type in which musical tones are generated by separately evaluating the sample point amplitude contributions of each individual partial for each selected key, the improvement comprising:

time shared tone generator interface means for storing and providing sequentially and repetitively, in time slots which are arbitrarily assigned to partials independently of partial order or selected key, partial generation information including a key code indicative of the selected key, the order n of the partial, an inharmonicity degree information, and partial amplitude information, and a time shared frequency data generator, operative during each of said assigned time slots, comprising:

first conversion means, responsive to the key code information provided during a given time slot, for providing a first signal indicative of the logarithm of the frequency of the note designated by the selected key and a signal indicative of the octave of said selected key, second conversion means, responsive to said partial order n information provided during said given time slot and receiving said octave indicative signal, for providing a second signal indicative of the logarithm of the product of said partial order multiplied by said octave, means for combining said first and second signals to provide a third signal indicative of the logarithm of the partial tone frequency of the partial of order n, and scaler means, responsive to said inharmonicity degree information and to said third signal, for providing a resultant signal indicative of the frequency of said partial of order n as scaled by said inharmonicity degree, said tone generator means utilizing said resultant signal to evaluate the amplitude contribution of said individual partial.

14. A polyphonic keyboard electronic musical instrument including a time-shared generator, said instrument comprising:

key logic unit means, responsive to the depression of any key in said keyboard, for initiating an assignment request signal and for providing a key code identifying the depressed key, a partial assignment unit, receiving said request signal and said key code and including:

data processing and logic unit for producing frequency and envelope information for each partial of a tone identified by the depressed key, a tone parameter logic unit storing for each of several selectable tone colors a corresponding set of parameter data for each individual partial of a tone to be generated with that selected tone color, an output latch unit for storing frequency and envelope information produced by said data processing and logic unit, and program unit means for directing said processing and logic units to produce and to enter into said output latch unit frequency and envelope information for each partial to be included in the synthesis of the tone identified by the received key code, utilizing data from said tone parameter logic unit, said program unit means also assigning each such partial to an arbitrary one of a plurality of time-shared time slots, and tone generator interface means, connected to said output latch and controlled by said program unit means, for separately storing the frequency and envelope information for each partial to be included in the synthesis of the tones for each of plural depressed keys, and for supplying this information repetitively and successively to said tone generator in the respective time-shared time slots that were arbitrarily assigned to said partials by said program unit means.

15. An electronic musical instrument according to claim 14 further comprising:

minimum amplitude detection means, cooperating with said tone generator, for detecting the lowest envelope amplitude contribution of any group of partials that are being synthesized by said tone generator unit, and truncation means, cooperating with said tone generator interface unit means and operative when all of said time slots have been assigned to partials to be produced, for causing each partial of a newly depressed key to be stored and assigned to a time slot formerly assigned to that partial for a released key which has the lowest amplitude of any such assigned partials for released keys, as detected by said minimum amplitude detection means.

16. An electronic musical instrument according to claim 14 wherein said toner generator interface unit comprises:

a plurality of shift registers each having a number of storage locations corresponding to the total number of time slots for which partials can be produced by said tone generator in time shared fashion, means for shifting in unison all of said shift registers so that the data from corresponding locations in said registers are supplied in unison to said tone generator unit, said partial assignment unit gating said frequency and envelope information for each newly assigned partial into corresponding locations in said shift registers, one of said shift registers storing in each location a key code identifying, for the partial information in each corresponding location in the other registers, the depressed key with which that partial is associated, comparator means for comparing the key code of a newly released key with the key code of every location of said one shift register as the data from corresponding locations in the other registers are supplied to said tone generator, and envelope mode control means, associated with a separate one of said shift registers which stores envelope mode data for each partial, for modifying the contents of said separate one shift register locations each time said comparator indicates equality, said separate shift register thereby supplying to said tone generator unit a revised envelope mode signal for each partial associated said newly released key.

17. An electronic musical instrument according to claim 14 wherein said program unit means in said partial assignment unit assigns to an arbitrary available time slot associated storage position in said tone generator interface unit means the frequency and envelope information for each partial of each key code that is detected, said program unit means further inhibiting the initiation by said key logic unit means of further assignment request signals during the assignment operation, and enabling said key logic unit means to scan for additional newly depressed keys upon completion of the assignment operation.

18. In a polyphonic electronic musical instrument of the type in which a tone generator synthesizes a tone by separately calculating the sample point amplitude contributions of each individual partial of each selected note, and having means for producing a keyboard touch response indicative signal, the improvement comprising:

a scale factor memory storing a set of preestablished touch response scale factors and note scale factors, a tone parameter memory storing a set of information for each partial, said information including the order n of said partial, the peak amplitude of said partial, a note scale data for scaling said peak amplitude with regard to the fundamental frequency of a selected note, and at least one touch sensitivity scale data for scaling the attack and/or decay times of said partial in accordance with said touch response indicative signal, and note latch means for ascertaining and storing, upon the depression of a key, a signal indicative of the pitch of each corresponding partial, said pitch being ascertained from the fundamental frequency of the note associated with the depressed key and the order n of the corresponding partial, and for storing the note scale data obtained from the tone parameter memory for the corresponding partial, touch sensitivity latch means for storing a touch sensitivity scale data obtained from said tone parameter memory for the corresponding partial, and for storing a signal indicative of the touch response with which the corresponding key is depressed, memory access means for selectively (a) utilizing the contents of said note latch means as an access address for said scale factor memory, thereby to read out the corresponding stored note scale factor, and (b) utilizing the contents of said touch sensitivity latch means as an access address for said scale factor memory thereby to read out the corresponding touch response scale factor, and amplitude determining means for utilizing each scale factor read out from said scale factor memory in determining the amplitude contribution of each partial in the resultant synthesis by said tone generator.

19. The improvement of claim 18 wherein said amplitude determining means includes:

calculation circuitry, operative in the event that said memory access means selectively utilizes both the contents of said note latch means and the contents of said touch sensitivity latch means, for utilizing both said read out touch responsive scale factor and said read out note scale factor separately to scale the partial peak amplitude and touch sensitivity data read from said tone parameter memory to establish scaled values thereof for utilization by said tone generator.

20. The improvement according to claim 18 further including:

first conversion means for providing a first signal representing the logarithm of the note frequency identified by a key code specifying the depressed key, second conversion means for providing a second signal representing the logarithm of the partial order n, and combining means for computing from said first and second signals a third signal representing the logarithm of the effective frequency of the partial of order n, said third signal being stored in said note latch means as said pitch indicative signal.

21. A polyphonic keyboard electronic musical instrument in which a tone generator is time shared to synthesize a musical tone in response to the selection of one or more notes designated by respective note codes, comprising:

a tone parameter logic unit storing at least one set of data defining parameters of individual partials to be included in a tone synthesis, a tone generator interface unit having:

first means, cooperating with said tone parameter logic unit, for deriving from data accessed from said tone parameter logic unit amplitude and frequency designating information for each partial of each musical tone to be synthesized, second means for separately storing said information derived by said first means, and third means for sequentially, repetitively providing said stored information to said tone generator in respective, arbitrarily assigned time slots, and computation means, in said tone generator, for individually computing from the information supplied by said tone generator interface means in each respective time slot, the frequency and relative amplitude of each individual partial, said tone generator utilizing said computed frequency and partial amplitude information in the synthesis of said musical tone.

22. A musical instrument according to claim 21 wherein said tone parameter logic unit stores, for each partial of order n, data selected from the group consisting of peak amplitude level, sustain level, touch sensitivity amplitude scaler, note dependent amplitude scaler, attack time, initial decay time, final decay time, touch sensitivity envelope time scaler and note dependent envelope time scaler, all of said data being utilized by said tone generator interface unit to derive said separately stored information, said computation means including envelope calculator means responsive to said stored information and to information indicative of key depression and release, note code and touch response, for sequentially, repetitively and individually calculating an envelope amplitude scale factor for each individual partial, said envelope scale factors being utilized by said tone generator in said synthesis.

23. An electronic musical instrument according to claim 21 wherein said tone parameter logic unit also stores data indicating the degree of inharmonicity of each partial, the inharmonicity degree data for each assigned partial also being stored by said tone generator interface unit together with the order value n for repetitive and sequential provision to said tone generator, said computation means including a frequency data generation circuit, responsive to said inharmonicity degree data, said order value n and a note code designating a depressed key, for producing in each respective time slot frequency data representing the effective frequency of the partial being computed in the corresponding time slot, said tone generator using said frequency data in said synthesis.

24. An electronic musical instrument according to claim 21 wherein said tone parameter logic unit stores a plurality of sets of parameter defining data, each set associated with a separate tone color, together with:

a tone color selector, and program control means, responsive to the selection of each note, for interrogating said tone color selector and for providing to said tone generator interface unit the parameter defining data from the set associated with the selected tone color.

25. An electronic musical instrument according to claim 21 further comprising:

touch responsive means for detecting the transit time of key depression, and wherein said tone parameter logic unit stores data defining a touch sensitivity scaler, and further comprising:

touch response calculation means, responsive to said detected key depression transit time and to the touch sensitivity scaler for each individual partial, for computing for each individual partial separate touch scaled envelope amplitude and/or time duration defining information and for supplying said information to said tone generator interface unit for use by said computation means.

26. A polyphonic keyboard electronic musical instrument in which a time shared tone generator synthesizes a tone by separate evaluation of each partial associated with each note selected by key depression, the improvement comprising:

tone parameter storage means for storing, for every tone partial, separate amplitude and/or envelope duration touch sensitivity scale factors for scaling the amplitude and/or envelope duration of the respective partial, touch responsive means for determining the elapsed transit time of each key during the depression thereof, said time being indicative of keyboard touch, touch calculation means, responsive to the elapsed transit time determined by said touch responsive means and operative prior to tone production, for computing amplitude and/or envelope duration scale values for each partial in response to the contents of said touch responsive means and the scale factors for said each partial accessed from said tone parameter storage means, and tone generator interface unit means for providing said computed scale values independently to said tone generator in the respective time-shared time slots associated with corresponding individual partials for use in said evaluation.

27. An electronic musical instrument according to claim 26 wherein said touch responsive means comprises:

a first matrix of key switches mounted so as to be actuated as the depression of each key is begun, a second matrix of key switches mounted so as to be actuated when depression of each respective key is substantially completed, key switch matrix scanning means for initially detecting the contents of a clock-advanced counter upon detection of closure of a switch in said first matrix, and for subsequently detecting the contents of said same counter in response to detection of closure of a switch in said second matrix for the same corresponding key, and for forming the difference therebetween, said difference signal being indicative of the depression trans time of said key.

28. An electronic musical instrument according to claim 27 further comprising:

first means, operative in response to detection of actuation of a switch in said first matrix, for effectuating storage of the contents of said touch counter in a memory, and concurrently storing in the same memory the key code identifying said depressed key, second means, responsive to the initial actuation of a switch in said second matrix, for determining the contents of said touch counter at the time of said second matrix switch actuation, and for forming said difference indicative of key depression transit time.

* * * * *